US012180693B1

(12) United States Patent
Lu

(10) Patent No.: US 12,180,693 B1
(45) Date of Patent: Dec. 31, 2024

(54) BIDET WITH INTEGRATED BUILT-IN WATER TANK

(71) Applicant: Guangdong Shiguanwei Sanitary Ware Co., Ltd., Chaozhou (CN)

(72) Inventor: Liuping Lu, Chaozhou (CN)

( * ) Notice: Subject to any disclaimer, the term of this patent is extended or adjusted under 35 U.S.C. 154(b) by 0 days.

(21) Appl. No.: 18/625,949

(22) Filed: Apr. 3, 2024

Related U.S. Application Data

(63) Continuation of application No. 18/458,461, filed on Aug. 30, 2023, now abandoned.

(51) Int. Cl.
*E03D 9/08* (2006.01)

(52) U.S. Cl.
CPC ..... *E03D 9/08* (2013.01)

(58) Field of Classification Search
None
See application file for complete search history.

(56) References Cited

U.S. PATENT DOCUMENTS 5,502,845 A * 4/1996 Hayashi ..... E03D 11/02 4/425
2021/0348374 A1* 11/2021 Sun ..... E03D 3/00

FOREIGN PATENT DOCUMENTS

KR 20100106654 A * 10/2010 ..... E03D 5/10

* cited by examiner

*Primary Examiner* — Christine J Skubinna

(57) ABSTRACT

A bidet with an integrated built-in water tank, including a seat, a water inlet assembly, and a jetting assembly. The seat includes a bidet main body, a shell, and a partition; the bidet main body includes a bedpan and a drain pipe; the shell is arranged at a periphery of the bidet main body; the shell includes a front sidewall, a bottom wall, a left sidewall, a right sidewall, and a rear sidewall; a bottom opening is defined between the front sidewall and the bottom wall; the partition extends upwardly from the bottom wall; the partition, the bottom wall, the left sidewall, the right sidewall, and the rear sidewall enclose to form a water tank that is opened upwardly; the partition, the shell, and the bedpan are of an integrated ceramic structure; the water inlet assembly and the jetting assembly are disposed in the water tank.

19 Claims, 36 Drawing Sheets

BIDET WITH INTEGRATED BUILT-IN WATER TANK

CROSS REFERENCE

This application is a Continuation of the U. S. application Ser. No. 18,458,461 filed on Aug. 30, 2023, and entitled "BIDET WITH INTEGRATED BUILT-IN WATER TANK", now pending, the entire disclosures of which are incorporated herein by reference.

TECHNICAL FIELD

The present disclosure relates to technical field of sanitary ware, and in particular to a bidet with an integrated built-in water tank.

BACKGROUND

Bidets, serving as toilets, are conventionally arranged with built-in water tanks that can be divided into two kinds, one is that the water tank and the seat are separated with the water tank being placed in the wall, the other is that the water tank and the seat are installed in an integrated (one-piece) manner. The split-type tanks are not as popular as integrated-type tanks because they are not easy to install. The internal structure of the seat is complex, such as the lower surface of the bidet main body, and the curved sewage pipe, and the seat is usually a ceramic structure. Therefore, it is necessary to provide multiple process holes on the shell of the seat in order to facilitate the manufacture of the seat, for example, the process holes are provided between a bottom wall of the shell and a front sidewall of the shell. As a result, water cannot be stored between the shell and the bidet main body.

In order to facilitate manufacturing and installation, the existing bidet with an integrated built-in water tank is generally designed that a water tank is arranged at a top of a rear end of the seat, or a plastic water tank is arranged in an inner cavity of the rear end of the seat. Further, since a sufficient height difference is required, it is necessary to adopt a water inlet valve and a water pump or pressurize the air in the integrated water tank. However, these technical solutions have problems that the water storage is in a small amount and water supply through the inlet valve is too slow due to low water pressure in the water consumption peak period, which may lead to cases that the bidet cannot be flushed even in one time. In addition, for the designs where the water tank is arranged on the top, the installation space of the intelligent toilet cover will be occupied, and the manufacturing difficulty of the seat is improved; for the designs of the plastic water tanks, problems also exist of resonant noise from the plastic tank and smart toilet cover when the pump starts the water, as well as of water leakage due to deterioration after a longer period of use.

SUMMARY OF THE DISCLOSURE

The main purpose of the present disclosure is to propose a bidet with an integrated built-in water tank, aiming at solving the technical problems of the existing bidet with an integrated built-in water tank having a low water storage capacity in the water tank, unreliable flushing, and insufficient practicality.

In order to achieve the above purposes, the present disclosure provides a bidet with an integrated built-in water tank, including a seat, a water inlet assembly, and a jetting assembly; wherein the seat includes a bidet main body, a shell, and a partition;

the bidet main body includes a bedpan and a drain pipe in communication with the bedpan;

the shell is arranged at a periphery of the bidet main body; the shell includes a front sidewall, a bottom wall, a left sidewall, a right sidewall, and a rear sidewall; a bottom opening is defined between the front sidewall and the bottom wall facing a front portion of the bedpan;

the partition extends upwardly from the bottom wall; the partition, the bottom wall, the left sidewall, the right sidewall, and the rear sidewall enclose to form a water tank that is opened upwardly; the partition, the shell, and the bedpan are of an integrated ceramic structure;

the water inlet assembly and the jetting assembly are disposed in the water tank; the water inlet assembly includes a water inlet pipe and a water valve assembly connected in series to the water inlet pipe; the jetting assembly includes a jetting pipe and a water pump connected in series to the jetting pipe, and the jetting pipe is in communication with the bedpan.

In some embodiments, the rear sidewall defines a water inlet installation hole, and the water inlet assembly further includes a water inlet fitting; an outlet of the water inlet fitting is connected to an inlet of the water inlet pipe; the water inlet fitting is removably connected to the water inlet installation hole.

In some embodiments, the rear sidewall includes a base and a bulge that bulges inwardly from the base; the bulge defines a cavity that is opened toward an outside; the water inlet installation hole is defined on the bulge and is in communication with the cavity; an outer end of the water inlet fitting is disposed in the cavity.

In some embodiments, the bulge is connected to a lower portion of the base, and the bulge includes a top plate and an enclosure plate; the top plate extends forwardly from an inner surface of the base, the enclosure plate extends upwardly from the bottom wall, the enclosure plate is connected to the top plate and the base, and the enclosure plate, the top plate, the base, and the bottom wall enclose to define the cavity; the water inlet installation hole is defined on the top plate, and the water inlet pipe and the water valve assembly are disposed above the bulge.

In some embodiments, the bulge is connected to an upper portion of the base, the bulge includes a top plate, an enclosure plate, and an installation plate; the top plate extends forwardly from an inner surface of the base, the installation plate extends downwardly from a front edge of the top plate, and the enclosure plate is connected to the top plate and the installation plate; the enclosure plate, the top plate, and the installation plate enclose to define the cavity; the water inlet installation hole is defined on the installation plate, and the water inlet pipe and the water valve assembly are disposed on a front side of the bulge.

In some embodiments, the water inlet fitting includes a fitting body, a sealing ring, and a fastener; the fitting body includes a tube portion and a limiting flange disposed on an outer peripheral surface of an inner end of the tube portion, and the outer peripheral surface of the tube portion defines an outer thread; the tube portion passes through the water inlet installation hole; the limiting flange is disposed on an inner side of the rear sidewall, the sealing ring is disposed between the limiting flange and the rear sidewall, and the fastener is threadedly mated with the tube portion and disposed on an outer side of the rear sidewall.

In some embodiments, the partition extends upwardly to be connected to the bedpan, and an upper portion of the rear sidewall defines a window connected to an outside.

In some embodiments, the drain pipe has a curved portion extending into the water tank; the drain pipe is arranged in the middle in a left-right direction; the water inlet assembly is disposed on a first side of the drain pipe, and the water pump is disposed on a second side of the drain pipe, the first side and the second side being opposite to each other in the left-right direction.

In some embodiments, an inner wall surface of an upper portion of the bedpan defines an annular flushing groove; the jetting assembly further includes a three-way valve; the jetting pipe includes a main path, a first branch path connected to an outlet of the three-way valve, and a second branch path connected to another outlet of the three-way valve; the main path is connected to an outlet of the water pump and an inlet of the three-way valve; an outlet of the first branch path is in communication with a bottom of the bedpan, and an outlet of the second branch path is in communication with the annular flushing groove on the upper portion of the bedpan.

In some embodiments, the partition extends upwardly to be connected to the bedpan, and the partition defines a through hole for the second branch path to pass through.

As proposed by the present disclosure, the bidet with an integrated built-in water tank is arranged with an integrated ceramic structure of the partition, the shell, and the bedpan. In this way, while retaining the bottom opening, the upwardly-opened water tank is formed by enclosing the partition, the bottom wall, the left sidewall, the right sidewall, and the rear sidewall, such that the space in a rear portion of the seat is fully utilized, and the formed water tank has a large capacity and can cooperate with the water pump for a long and stable flushing operation. Moreover, since the bottom opening is retained and the water tank has an opening facing upward, an outer surface of the bidet main body can be easily accessed from the outside, such that the setting of the water tank does not affect the shaping of the bidet main body. The opening on an upper portion of the water tank also facilitates the installation of a smart toilet cover, whereby a lower raised portion at a rear end of the smart toilet cover can be embedded in the water tank, thereby making the overall height of the product lower, which in turn enhances the installation adaptability or reduces the space occupation. Since the water tank is constructed of ceramic material and is integrally structured with the bidet main body and the rest of the shell, it is less likely to resonate with vibration of the water pump, which can provide the user with a better silent experience.

A bidet with an integrated built-in water tank, including a seat, a water inlet assembly, and a jetting assembly; wherein the seat includes a bidet main body, a shell, and a partition;

the bidet main body includes a bedpan and a drain pipe in communication with the bedpan;

the shell is arranged at a periphery of the bidet main body; the shell includes a bottom wall, a left sidewall, a right sidewall, and a rear sidewall; the rear sidewall includes a first rear sidewall and a second rear sidewall disposed facing each other in a front-rear direction, the second rear sidewall defines a hanging hole and a drain through hole;

the partition and the first rear sidewall are disposed opposite to each other in the front-rear direction and both extend upwardly from the bottom wall, and a front portion of the bedpan protrudes from a front side of the partition; the partition and the first rear sidewall are disposed on a front side of the second rear sidewall; an installation cavity is defined between the first rear sidewall and the second rear sidewall, and the drain pipe passes through the first rear sidewall and has an external connection end extending into the installation cavity, the external connection end being disposed at a position corresponding to the drain through hole; the partition, the first rear sidewall, the bottom wall, the left sidewall, and the right sidewall enclose to form a water tank that is opened upwardly;

the water inlet assembly includes a water inlet pipe and a water valve assembly connected in series to the water inlet pipe; the jetting assembly includes a jetting pipe and a water pump connected in series to the jetting pipe; an inlet of the water pump and an inlet of the water inlet pipe are arranged in the water tank, and the jetting pipe is in communication with the bedpan.

In some embodiments, the bidet further includes an overflow pipe passing through the first rear sidewall; wherein an inlet end of the overflow pipe is disposed in the water tank, and an outlet end of the overflow pipe extends into the installation cavity.

In some embodiments, the outlet end of the overflow pipe is in communication with the external connection end.

In some embodiments, the seat further includes a connector protruding on a rear surface of the first rear sidewall and connected to an outer peripheral surface of the external connection end; an inner cavity of the connector is in communication with an inner cavity of the external connection end; an overflow installation hole is defined on the first rear sidewall corresponding to the connector and in communication with the inner cavity of the connector, and the outlet end of the overflow pipe is sealingly fixed to the overflow installation hole.

In some embodiments, an outer peripheral surface of the outlet end of the overflow pipe is arranged with a limiting flange and an elastic snap; the limiting flange and the elastic snap are spaced apart in a drainage direction of the overflow pipe;

the bidet further includes a sealing ring sleeved on the outer peripheral surface of the outlet end of the overflow pipe, and the elastic snap abuts against a rear surface of the first rear sidewall;

the sealing ring is pressed between the limiting flange and a front surface of the first rear sidewall and is sealingly mated with the limiting flange and the first rear sidewall, respectively.

In some embodiments, the first rear sidewall defines a water inlet installation hole, and the water inlet assembly further includes a water inlet fitting; an outlet of the water inlet fitting is connected to an inlet of the water inlet pipe; the water inlet fitting is removably connected to the water inlet installation hole; the partition, the first rear sidewall, the shell, the bedpan, and the connector are of an integrated ceramic structure.

In some embodiments, the overflow pipe has a reservoir section being in the form of an arch with a concave side facing upward.

In some embodiments, the overflow pipe includes an odor barrier structure; the overflow pipe further includes an inline section and a reservoir section connected to an upper end of the inline section; the inlet end of the overflow pipe is formed at the reservoir section; the odor barrier structure is formed at the reservoir section, and the outlet end of the overflow pipe is formed at a lower end of the inline section; the inline section extends in a vertical direction, and a main portion of the reservoir section is in a form of an arch with a concave side facing upward; the reservoir section has a connection port arranged downwardly to be connected to the upper end of the inline section; the water inlet assembly further includes a water replenishment assembly; the water replenishment assembly includes a water replenishment valve, and a water replenishment pipe; a water replenishment inlet of the water replenishment pipe is connected to the water replenishment valve, and a water replenishment outlet of the water replenishment pipe is connected to the inlet end of the overflow pipe.

In some embodiments, the bidet further includes a side branch pipe; wherein an end of the side branch pipe is in communication with an upper portion of the bedpan, and the other end of the side branch pipe is in communication with the inlet end of the overflow pipe.

In some embodiments, the overflow pipe includes an odor barrier structure; the overflow pipe further includes an inline section and a reservoir section connected to an upper end of the inline section; the inlet end of the overflow pipe is formed at the reservoir section; the odor barrier structure is formed at the reservoir section, the inline section extends along a front-rear direction, and the outlet end of the overflow pipe is formed at a rear end of the inline section; a main portion of the reservoir section is in a form of an arch with a concave side facing upward;

the bidet further includes an extraction assembly, the extraction assembly including an extraction pipe and an extraction fan connected in series with the extraction pipe; an end of the extraction pipe is in communication with the upper portion of the bedpan, and the other end of the extraction pipe is in communication with a downstream portion of a reservoir area of the reservoir section.

In some embodiments, the inlet end of the overflow pipe is arranged with an inlet grill defining an insertion hole, and the water replenishment outlet of the water replenishment pipe 35*c* is inserted with the insertion hole.

In some embodiments, the shell further includes a front sidewall disposed on the front side of the partition; a first opening is defined between the front sidewall and the partition and disposed at a bottom and corresponding to the front portion of the bedpan; a second opening is defined between the front sidewall and the first rear sidewall and disposed at the bottom; the partition, the first rear sidewall, the shell, and the bedpan are of an integrated ceramic structure.

As proposed by the present disclosure, the bidet with an integrated built-in water tank is arranged with the partition and the first rear sidewall which can directly cooperate with the shell to enclose to form the water tank, thereby making full use of the irregular space at the rear portion of the seat. Further, the water tank is with a large capacity, and the setting of the water tank does not affect the shape of the bidet main body. The opening on an upper portion of the water tank also facilitates the installation of a smart toilet cover, whereby a lower raised portion at a rear end of the smart toilet cover can be embedded in the water tank, thereby making the overall height of the product lower, which in turn enhances the installation adaptability or reduces the space occupation.

A bidet with an integrated built-in water tank, including a seat, a water inlet assembly, a jetting assembly, and an overflow pipe;

wherein the seat includes a bidet main body, a shell, and a water tank; the bidet main body includes a bedpan and a drain pipe in communication with the bedpan; the shell is arranged at a periphery of the bidet main body;

the water inlet assembly and the jetting assembly are disposed in the water tank; the water inlet assembly includes a water inlet pipe and a water valve assembly connected in series to the water inlet pipe; the jetting assembly includes a jetting pipe and a water pump connected in series to the jetting pipe, and the jetting pipe is in communication with the bedpan;

an inlet end of the overflow pipe extends into the water tank.

In some embodiments, an outlet end of the overflow pipe is in communication with the drain pipe.

In some embodiments, the shell includes a bottom wall, and a lower portion of the drain pipe is integrally connected to the bottom wall; a position, of an upper surface of the bottom wall, adjacent to the drain pipe is arranged with an installation tab being hollow; an inner cavity of the installation tab is in communication with the drain pipe, a top of the installation tab defines an overflow installation hole in communication with the inner cavity of the installation tab, and a lower end of the overflow pipe is sealingly fixed to the overflow installation hole.

In some embodiments, the shell includes a front sidewall, a bottom wall, a left sidewall, a right sidewall, and a rear sidewall; a bottom opening is defined between the front sidewall and the bottom wall facing a front portion of the bedpan;

the seat further includes a partition; the partition extends upwardly from the bottom wall;

the partition, the bottom wall, the left sidewall, the right sidewall, and the rear sidewall enclose to form a water tank that is opened upwardly; the installation tab, the partition, the shell, and the bedpan are of an integrated ceramic structure.

In some embodiments, an outer peripheral surface of the outlet end of the overflow pipe is arranged with a limiting flange and an elastic snap; the limiting flange and the elastic snap are spaced apart in a drainage direction of the overflow pipe, and the elastic snap is positioned lower than a position of the limiting flange;

the bidet further includes a sealing ring sleeved on the outer peripheral surface of the outlet end of the overflow pipe, and the elastic snap abuts against an inner surface of the installation tab;

the sealing ring is pressed between the limiting flange and the installation tab and is sealingly mated with an upper surface of the limiting flange and an upper surface of the installation tab, respectively.

In some embodiments, the overflow pipe includes an odor barrier structure.

In some embodiments, the overflow pipe further includes an inline section and a reservoir section connected to an upper end of the inline section; the inlet end of the overflow pipe is formed at the reservoir section; the odor barrier structure is formed at the reservoir section, and the outlet end of the overflow pipe is formed at a lower end of the inline section.

In some embodiments, the inline section extends in a vertical direction, and a main portion of the reservoir section is in a form of an arch with a concave side facing upward; the reservoir section has a connection port arranged downwardly to be connected to the upper end of the inline section.

In some embodiments, the inline section is disposed adjacent to the drain pipe, and the reservoir section is arranged on a side of the inline section away from the drain pipe.

In some embodiments, the rear sidewall of the shell is defines a water inlet installation hole, and the water inlet assembly further includes a water inlet fitting; an outlet of the water inlet fitting is in communication with an inlet of the water inlet pipe; the water inlet fitting is removably connected to the water inlet installation hole; the water inlet assembly further includes a water replenishment assembly; the water replenishment assembly includes a water replenishment valve, a water replenishment pipe, and a water replenishment outlet, the water replenishment valve being disposed adjacent to the water inlet fitting; a water replenishment inlet of the water replenishment pipe is connected to the water replenishment valve, and a water replenishment outlet of the water replenishment pipe is connected to the inlet end of the overflow pipe.

In some embodiments, the bidet further includes an overflow pipe and a side branch pipe; wherein an inlet end of the overflow pipe extends into the water tank, and an outlet end of the overflow pipe is in communication with the drain pipe; an end of the side branch pipe is in communication with an upper portion of the bedpan, and the other end of the side branch pipe is in communication with the inlet end of the overflow pipe; the upper portion of the bedpan defines a diversion groove arranged horizontally; both the jetting pipe and the side branch pipe are in communication with the diversion groove.

In some embodiments, the bidet further includes an overflow pipe and an extraction assembly; an inlet end of the overflow pipe extends into the water tank, and an outlet end of the overflow pipe is in communication with the drain pipe;

the overflow pipe includes an odor barrier structure, and the overflow pipe includes an inline section and a reservoir section connected to an upper end of the inline section; the inlet end of the overflow pipe is formed at the reservoir section, the odor barrier structure is formed at the reservoir section, and the outlet end of the overflow pipe is formed at a lower end of the inline section; the inline section extends in a vertical direction, and a main portion of the reservoir section is in a form of an arch with a concave side facing upward; the reservoir section has a connection port arranged downwardly to be connected to the upper end of the inline section;

the extraction assembly includes an extraction pipe and an extraction fan connected in series to the extraction pipe; an end of the extraction pipe is in communication with an upper portion of the bedpan, and the other end of the extraction pipe is in communication with the inline section.

As proposed by the present disclosure, for the bidet with an integrated built-in water tank, the inlet end of the overflow pipe extends into the water tank arranged with the water inlet assembly and the jetting assembly, such that even if the water inlet assembly malfunctions and results in an overfilling of the water, the excess water can be discharged out of the inlet end of the overflow pipe, which thereby reduces the risk of a leakage of the water from the bidet. Furthermore, due to the structure of the overflow pipe within the water tank, the bidet with an integrated built-in water tank is provided with a water level line defined by a mandatory standard.

BRIEF DESCRIPTION OF THE DRAWINGS

In order to more clearly illustrate the technical solutions in the embodiments of the present disclosure, the accompanying drawings to be used in the description of the embodiments will be briefly introduced in the following. Obviously, the accompanying drawings in the following description are only some of the embodiments of the present disclosure, and for those skilled in the art, other accompanying drawings can be obtained based on these drawings without creative labor.

DETAILED DESCRIPTION

Figure 1:
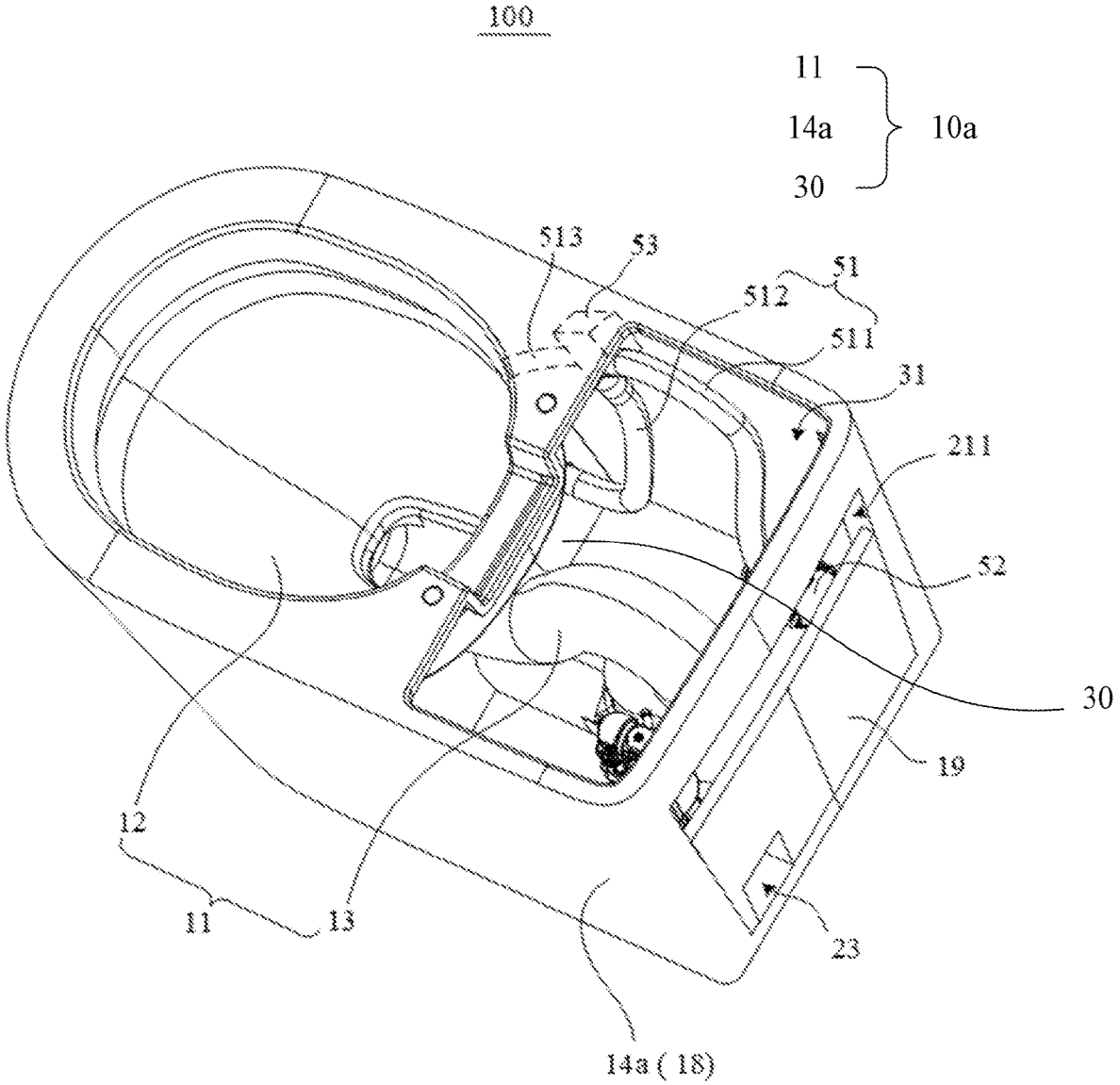
FIG. 1 is a perspective structural schematic view of a bidet with an integrated built-in water tank according to a first embodiment of the present disclosure.
Figure 2:
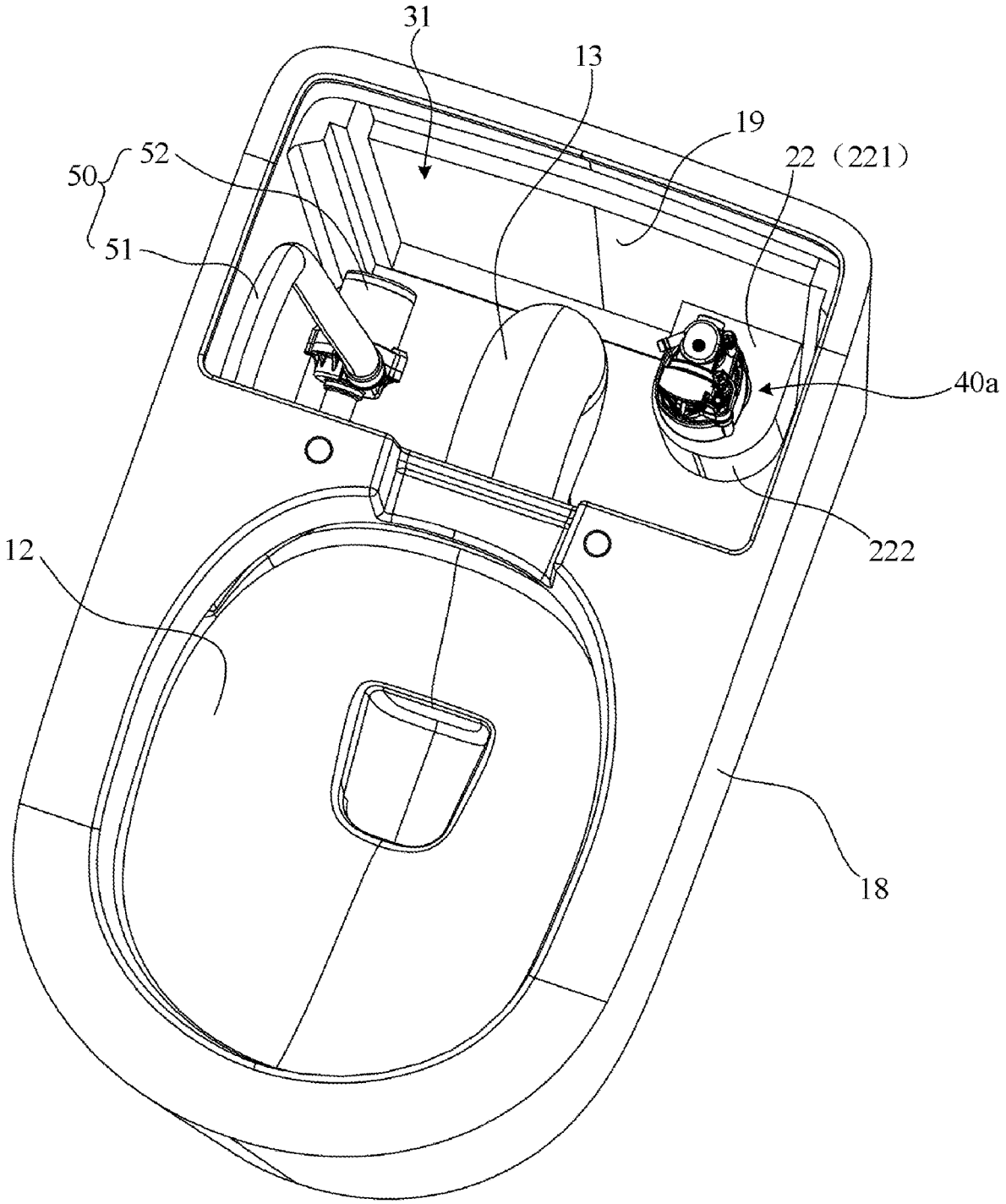
FIG. 2 is a perspective structural schematic view of another angle of the bidet with an integrated built-in water tank as shown in FIG. 1.
Figure 3:
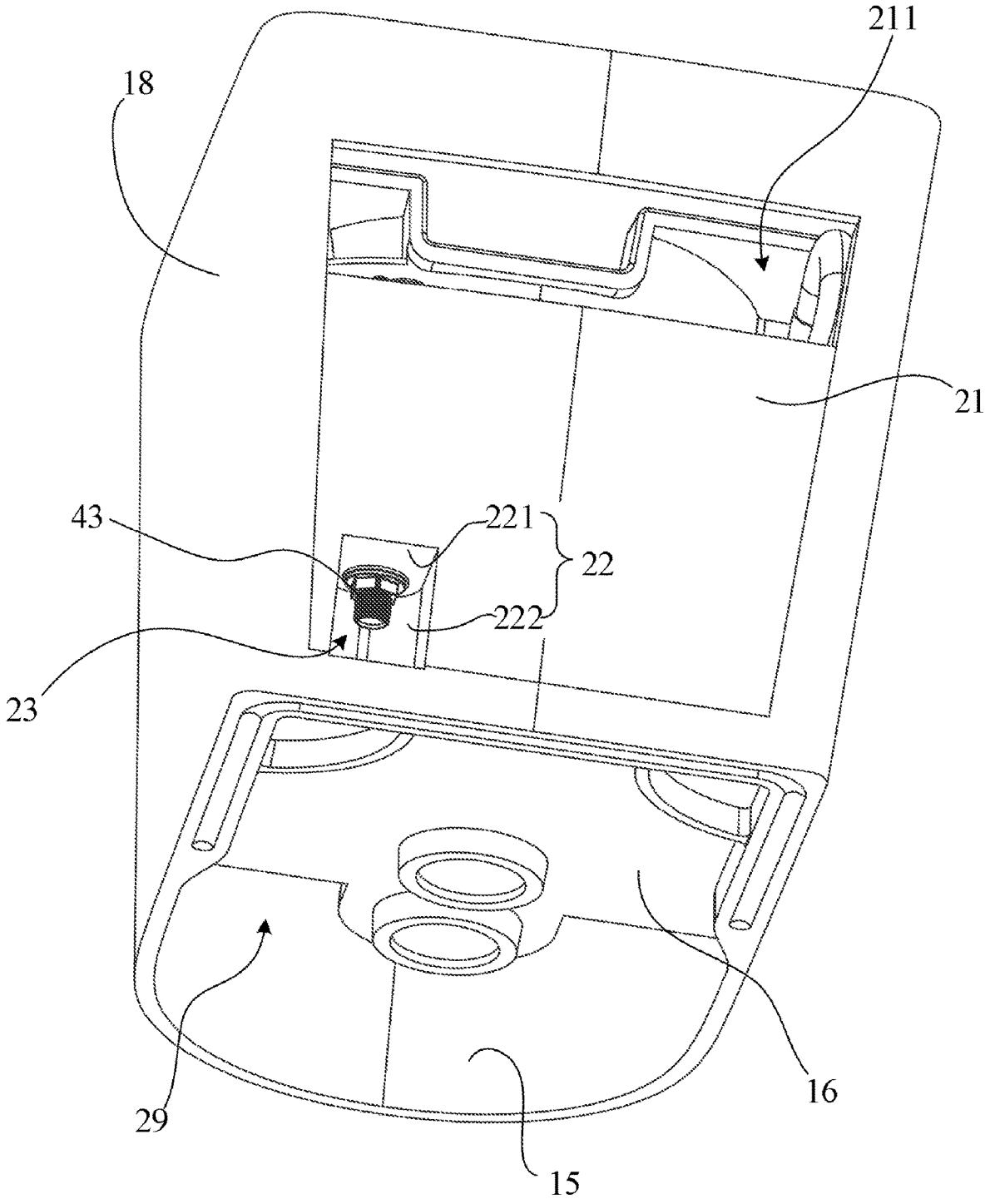
FIG. 3 is a perspective structural schematic view of a bottom of the bidet with an integrated built-in water tank as shown in FIG. 1.
Figure 4:
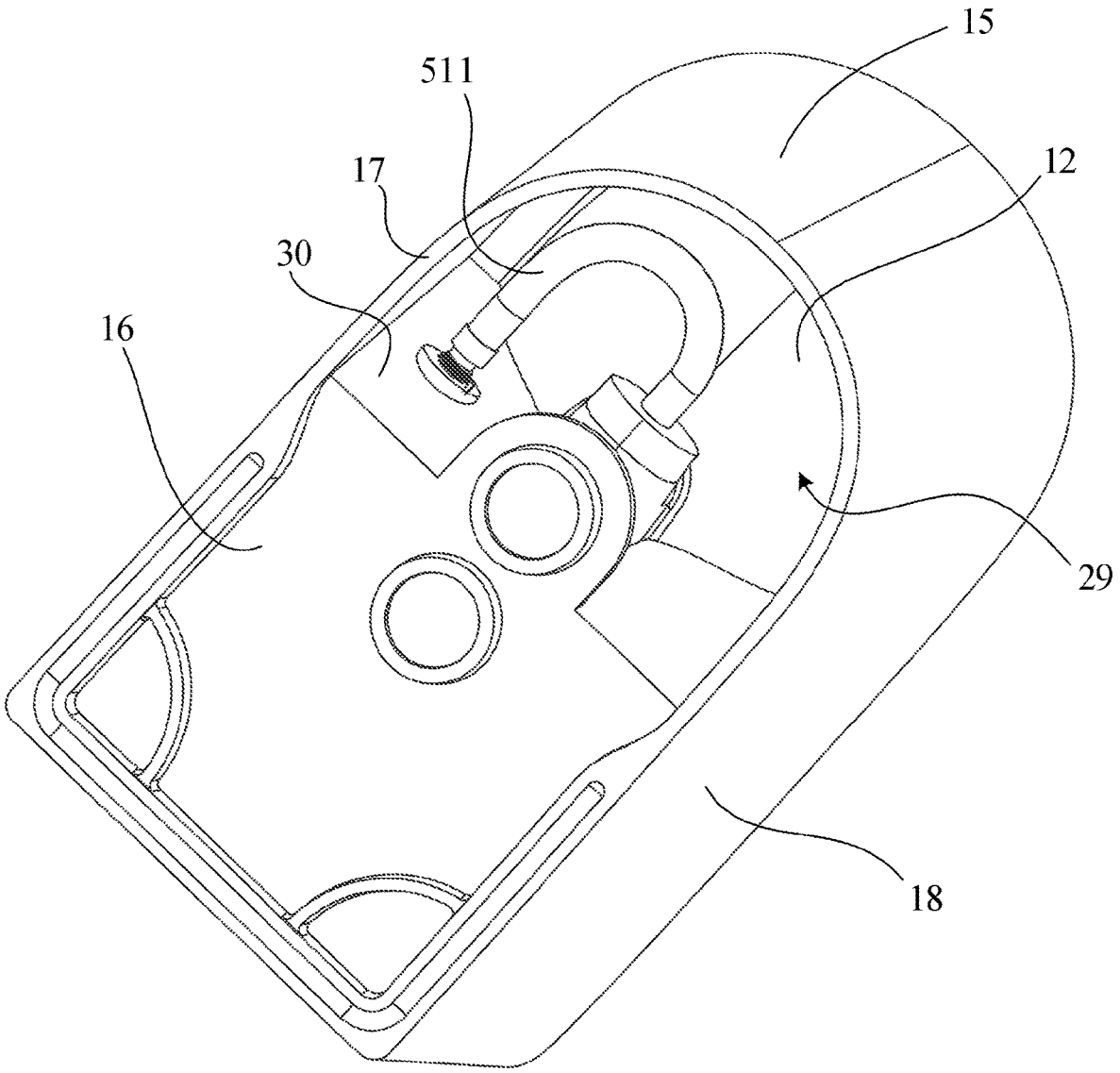
FIG. 4 is a perspective structural schematic view of another angle of the bottom of the bidet with an integrated built-in water tank as shown in FIG. 1.
Figure 5:
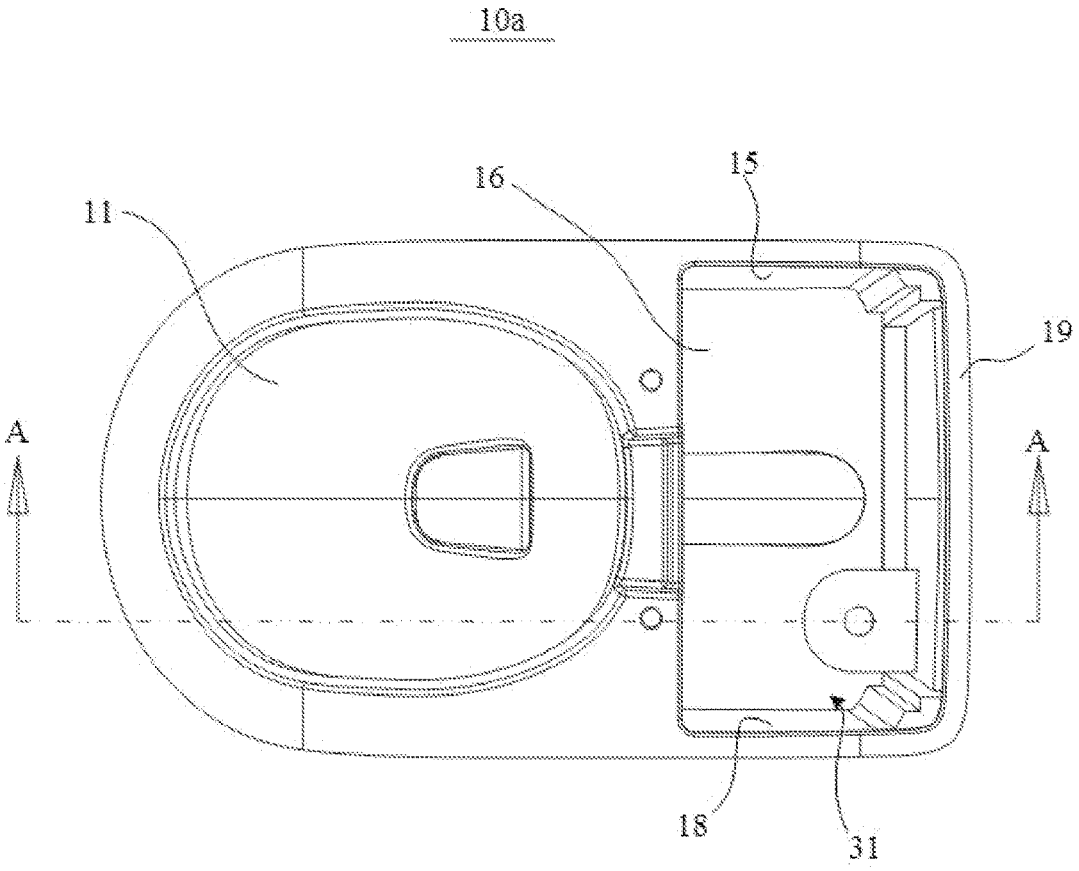
FIG. 5 is a top structural schematic view of a seat in FIG. 1.

The technical solutions in the embodiments of the present disclosure will be described clearly and completely in the following in conjunction with the accompanying drawings in the embodiments of the present disclosure, and it is obvious that the described embodiments are only a part of the embodiments of the present disclosure and not all of the embodiments. Based on the embodiments in the present disclosure, all other embodiments obtained those skilled in the art without creative labor fall within the scope of the present disclosure.

Referring to FIGS. 1-7 or FIGS. 8-15, in the first and second embodiments, the present disclosure proposes a bidet 100, 200 with an integrated built-in water tank, including a seat 10*a*, 10*b*, a water inlet assembly 40*a*, 40*b*, and a jetting assembly 50; the seat 10*a*, 10*b* includes a bidet main body 11, a shell 14*a*, 14*b*, and a partition 30.

The bidet main body 11 includes a bedpan 12 and a drain pipe 13 connected to the bedpan 12.

The shell 14*a*, 14*b* is arranged at a periphery of the bidet main body 11; the shell 14*a*, 14*b* includes a front sidewall 15, a bottom wall 16, a left sidewall 17, a right sidewall 18, and a rear sidewall 19, 24; a bottom opening 29 is defined between the front sidewall 15 and the bottom wall 16 facing a front portion of the bedpan 12.

The partition 30 extends upwardly from the bottom wall 16; the partition 30, the bottom wall 16, the left sidewall 17, the right sidewall 18, and the rear sidewall 19, 24 enclose to form a water tank 31 that is opened upwardly; the partition 30, the shell 14*a*, 14*b*, and the bedpan 12 are of an integrated ceramic structure.

The water inlet assembly 40*a*, 40*b* and the jetting assembly 50 are disposed in the water tank 31; the water inlet assembly 40*a*, 40*b* includes a water inlet pipe 41 and a water valve assembly 42 connected in series to the water inlet pipe 41; the jetting assembly 50 includes a jetting pipe 51 and a water pump 52 connected in series to the jetting pipe 51, and the jetting pipe 51 is connected to the bedpan 12.

In the embodiments, the seat 10*a*, 10*b* is a main structure; the water inlet assembly 40*a*, 40*b* and the jetting assembly 50 are disposed on the seat 10*a*, 10*b*; the bidet main body 11 and the shell 14*a*, 14*b* of the seat 10*a*, 10*b* may be adopted from the related art; the bedpan 12 is configured to receive excrement, and the jetting assembly 50 is configured to jet water into an inner cavity of the bidet main body 11, so as to discharge the excrement into a pipe connected to a septic tank through the drain pipe 13. The drain pipe 13 is usually arranged with a water reservoir for odor prevention, and the drain pipe 13 may be further arranged with an upwardly-arched curved portion to prevent backflow. The shell 14*a*, 14*b* is not only a cosmetic part, but also provides support for the bidet main body 11. The seat 10*a*, 10*b* may be installed either on a bottom surface or on a vertical surface, such as on a wall or on a stand having a vertical installation surface. The water inlet assembly 40*a*, 40*b* and the jetting assembly 50 may be adopted from the related art; the water valve assembly 42 may be either a manual valve or an electromechanical automatic valve, such as a solenoid valve, or a purely mechanical automatic valve.

As proposed by the present disclosure, the bidet 100, 200 with an integrated built-in water tank is arranged with an integrated ceramic structure of the partition 30, the shell 14*a*, 14*b*, and the bedpan 12. In this way, while retaining the bottom opening 29, the upwardly-opened water tank 31 is formed by enclosing the partition 30, the bottom wall 16, the left sidewall 17, the right sidewall 18, and the rear sidewall 19, 24, such that the space in a rear portion of the seat 10*a*, 10*b* is fully utilized, and the formed water tank 31 has a large capacity and can cooperate with the water pump 52 for a long and stable flushing operation. Moreover, since the bottom opening 29 is retained and the water tank 31 has an opening facing upward, an outer surface of the bidet main body 11 can be easily accessed from the outside, such that the setting of the water tank 31 does not affect the shaping of the bidet main body 11. The opening on an upper portion of the water tank 31 also facilitates the installation of a smart toilet cover, whereby a lower raised portion at a rear end of the smart toilet cover can be embedded in the water tank 31, thereby making the overall height of the product lower, which in turn enhances the installation adaptability or reduces the space occupation. Since the water tank 31 is constructed of ceramic material and is integrally structured with the bidet main body 11 and the rest of the shell 14*a*, 14*b*, it is less likely to resonate with vibration of the water pump 52, which can provide the user with a better silent experience.

Further, the rear sidewall 19, 24 defines a water inlet installation hole 20, 25, and the water inlet assembly 40*a*, 40*b* further includes a water inlet fitting 43; an outlet of the water inlet fitting 43 is connected to an inlet of the water inlet pipe 41; the water inlet fitting 43 is removably connected to the water inlet installation hole 20, 25.

In the embodiments, the water inlet fitting 43 can facilitate connection of the water inlet pipe 41 to the municipal water pipe and support the water inlet pipe 41. In some embodiments, an outlet of the water inlet pipe 41 is arranged close to the bottom wall 16, such that less noise is generated when replenishing the water.

Further, the rear sidewall 19, 24 includes a base 21, 26 and a bulge 22, 27 that bulges inwardly from the base 21, 26; the bulge 22, 27 defines a cavity 23, 28 that is opened toward an outside; the water inlet installation hole 20, 25 is defined on the bulge 22, 27 and is in communication with the cavity 23, 28; an outer end of the water inlet fitting 43 is disposed in the cavity 23, 28.

In the embodiments, installation of the seat 10*a*, 10*b* is facilitated by hiding the water inlet fitting 43 in the cavity 23, 28 of the bulge 22, 27 such that the base 21, 26 can be closer to or fit against the vertical installation surface.

Further, referring to FIGS. 1 to 7, in the first embodiment, in order to facilitate the connection of the water pipe at the bottom and to reduce the height of a main part of the water inlet assembly 40*a* for facilitating the installation of the toilet cover, the bulge 22 is connected to a lower portion of the base 21, and the bulge 22 includes a top plate 221 and an enclosure plate 222; the top plate 221 extends forwardly from an inner surface of the base 21, the enclosure plate 222 extends upwardly from the bottom wall 16, the enclosure plate 222 is connected to the top plate 221 and the base 21, and the enclosure plate 222, the top plate 221, the base 21, and the bottom wall 16 enclose to define the cavity 23; the water inlet installation hole 20 is defined on the top plate 221, and the water inlet pipe 41 and the water valve assembly 42 are disposed above the bulge 22. In the embodiments, the bulge 22 is connected to the lower portion of the base 21, defining the cavity 23 with the bottom wall 16, which can simplify the setup of the bulge 22 and is conducive to minimizing the height of the top plate 221, thereby enhancing the compactness of the bidet.

Further, referring to FIGS. 8 to 15, in the second embodiment, in order to facilitate the connection of the water pipe near the top of the seat 10*b* and to reduce the height of a main part of the water inlet assembly 40*b* for facilitating the installation of the toilet cover, the bulge 27 is connected to an upper portion of the base 26, the bulge 27 includes a top plate 271, an enclosure plate 272, and an installation plate 273; the top plate 271 extends forwardly from an inner surface of the base 26, the installation plate 273 extends downwardly from a front edge of the top plate 271, and the enclosure plate 272 is connected to the top plate 271 and the installation plate 273; the enclosure plate 272, the top plate 271, and the installation plate 273 enclose to define the cavity 28; the water inlet installation hole 25 is defined on the installation plate 273, and the water inlet pipe 41 and the water valve assembly 42 are disposed on a front side of the bulge 27.

Figure 6:
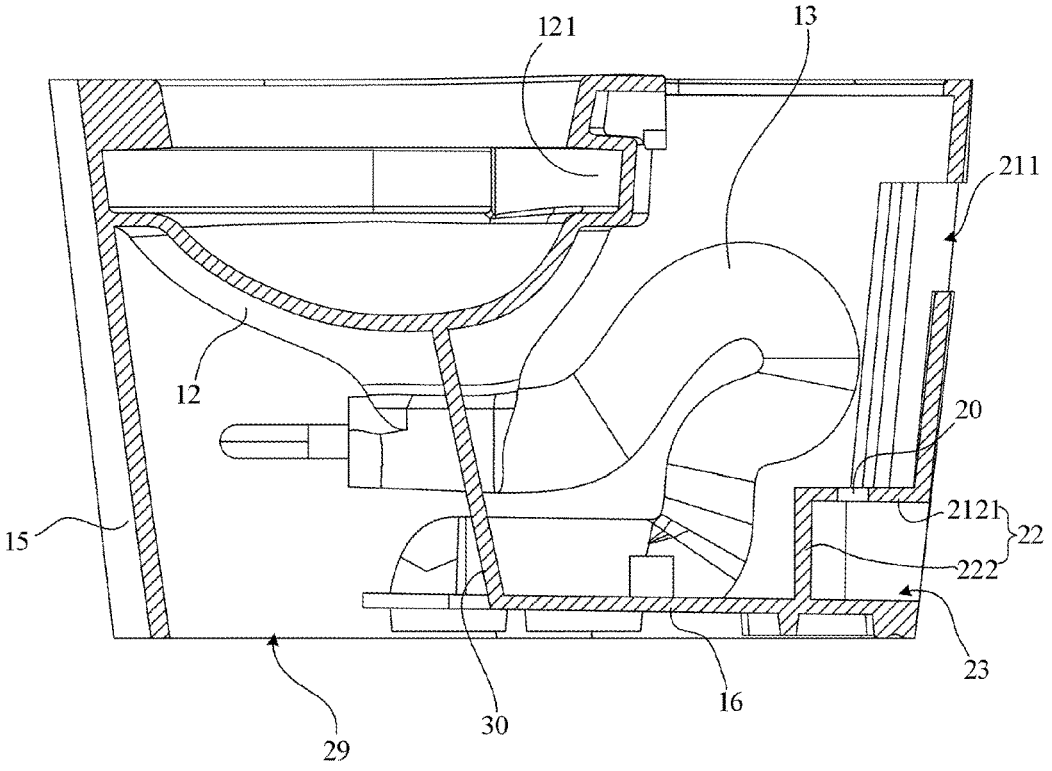
FIG. 6 is a cross-sectional structural schematic view along line A-A in FIG. 5.
Figure 7:
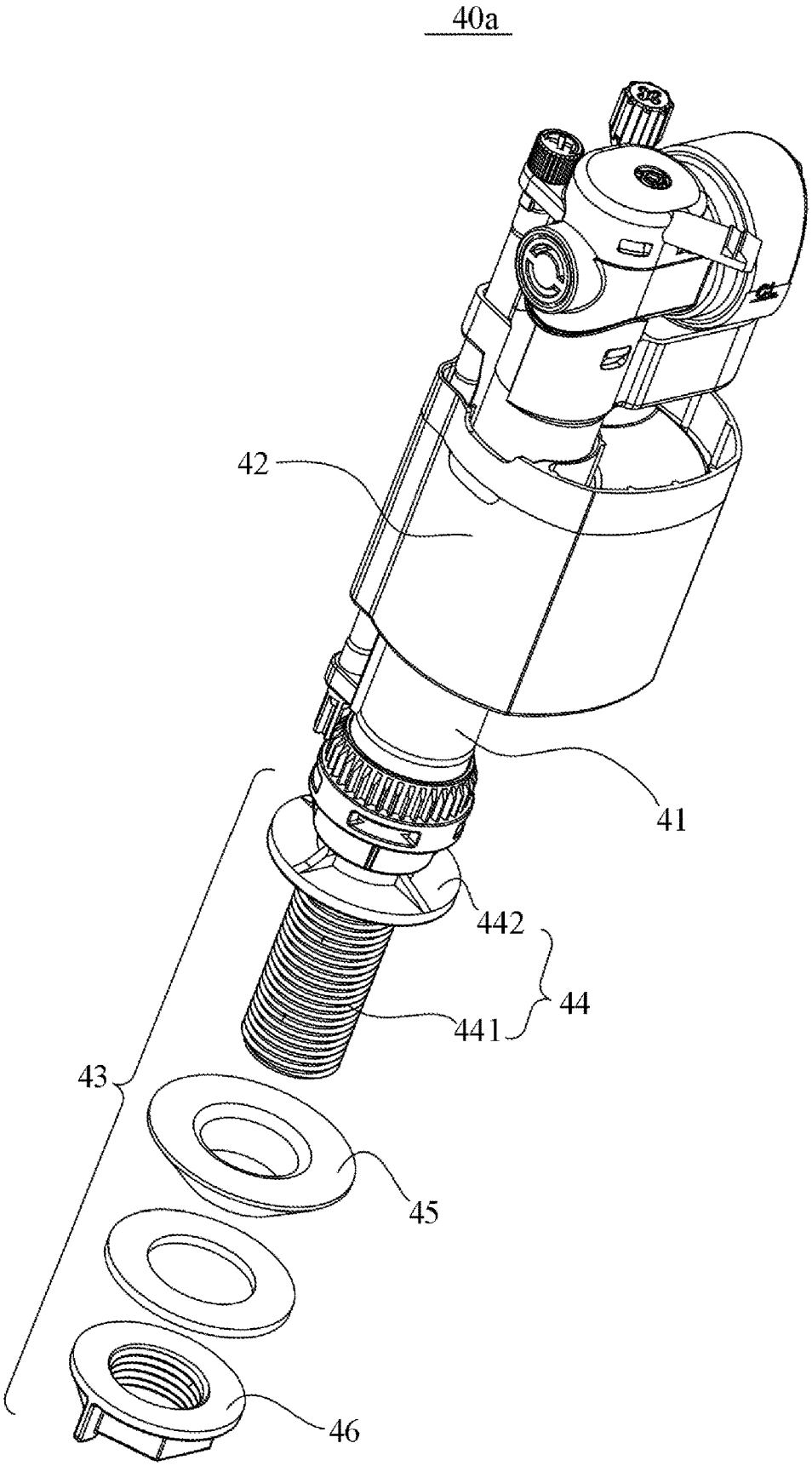
FIG. 7 is an exploded structural schematic view of a water inlet assembly in FIG. 2.
Figure 8:
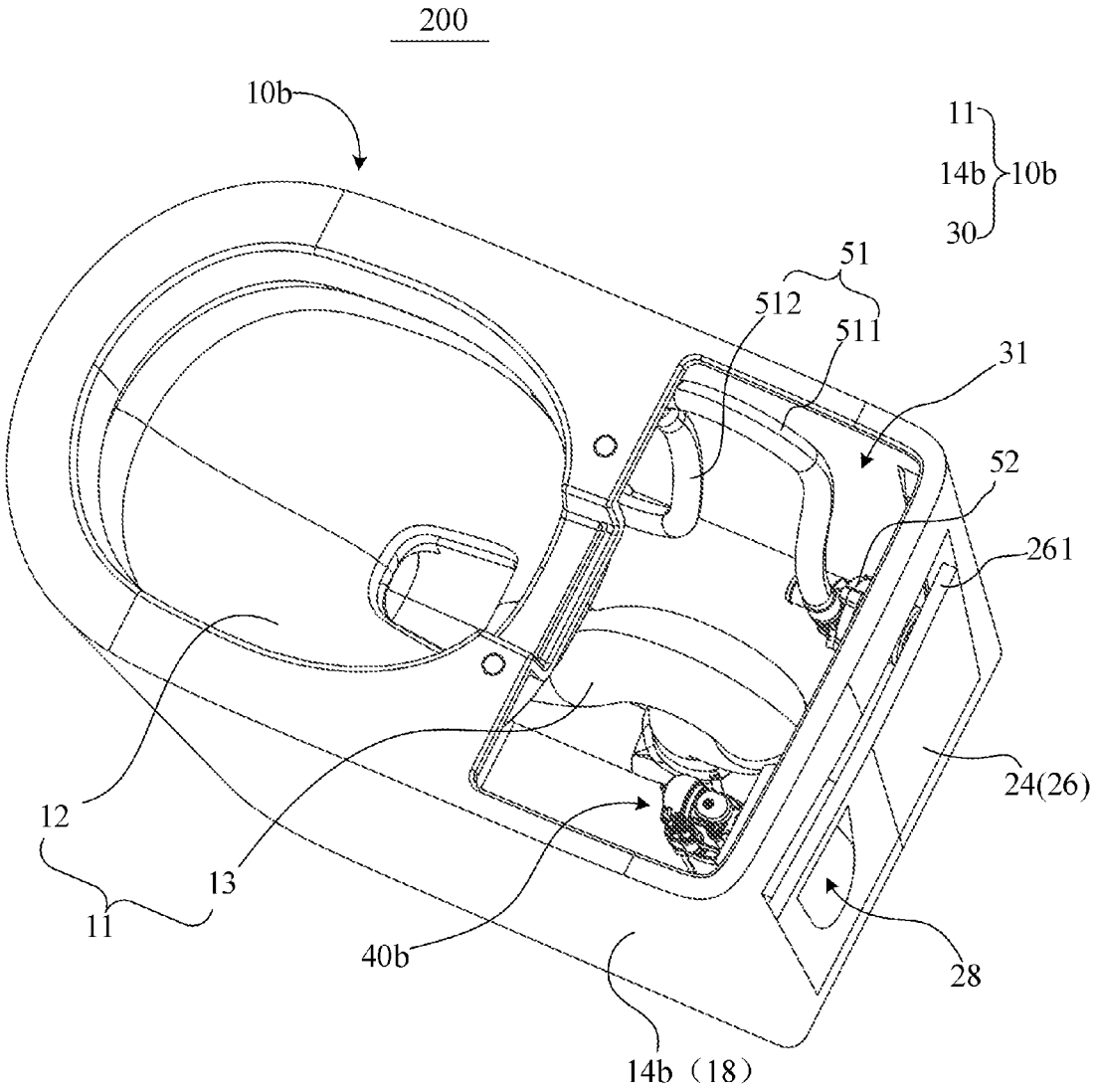
FIG. 8 is a perspective structural schematic view of a bidet with an integrated built-in water tank according to a second embodiment of the present disclosure.
Figure 9:
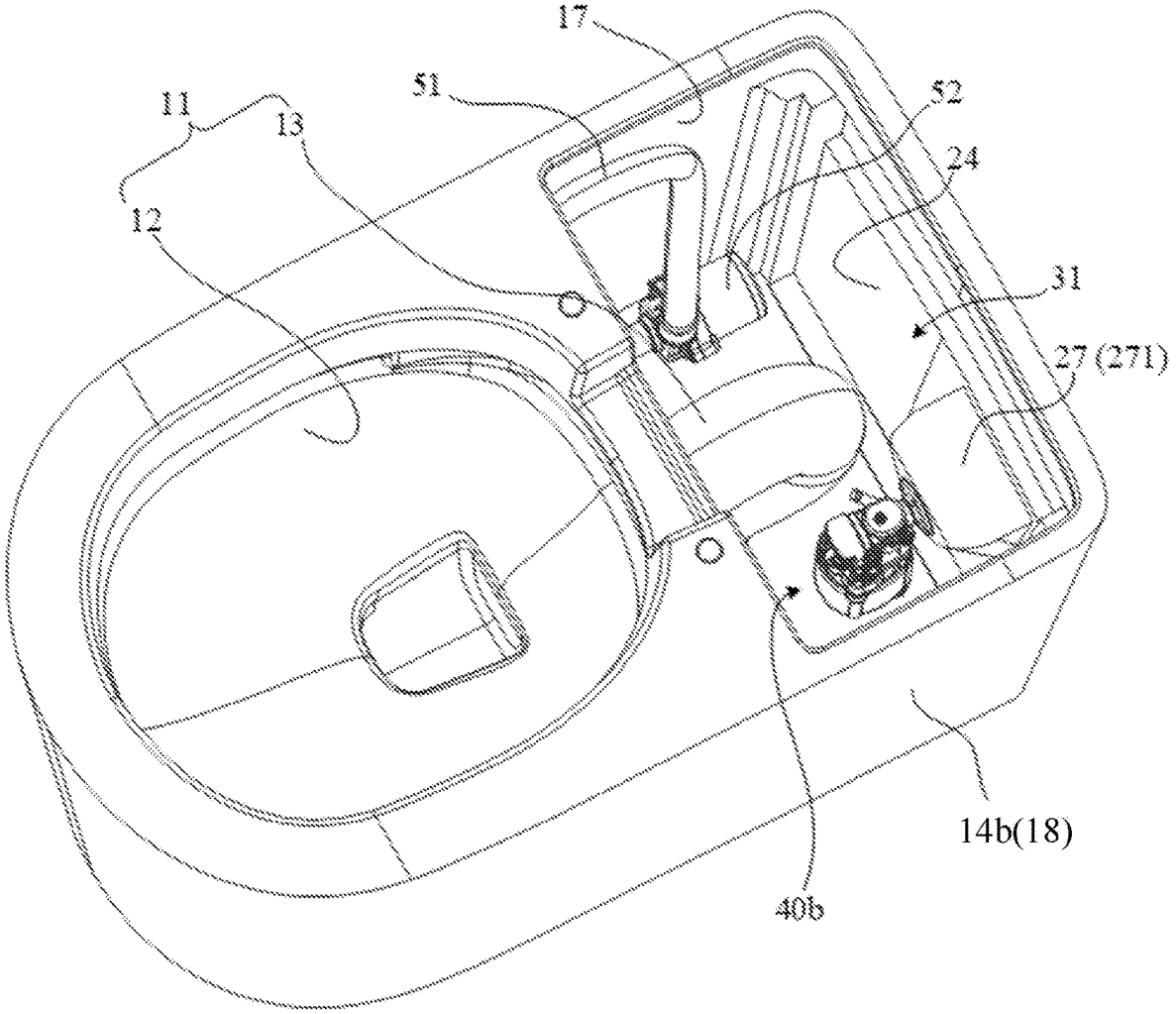
FIG. 9 is a perspective structural schematic view of another angle of the bidet with an integrated built-in water tank as shown in FIG. 8.
Figure 10:
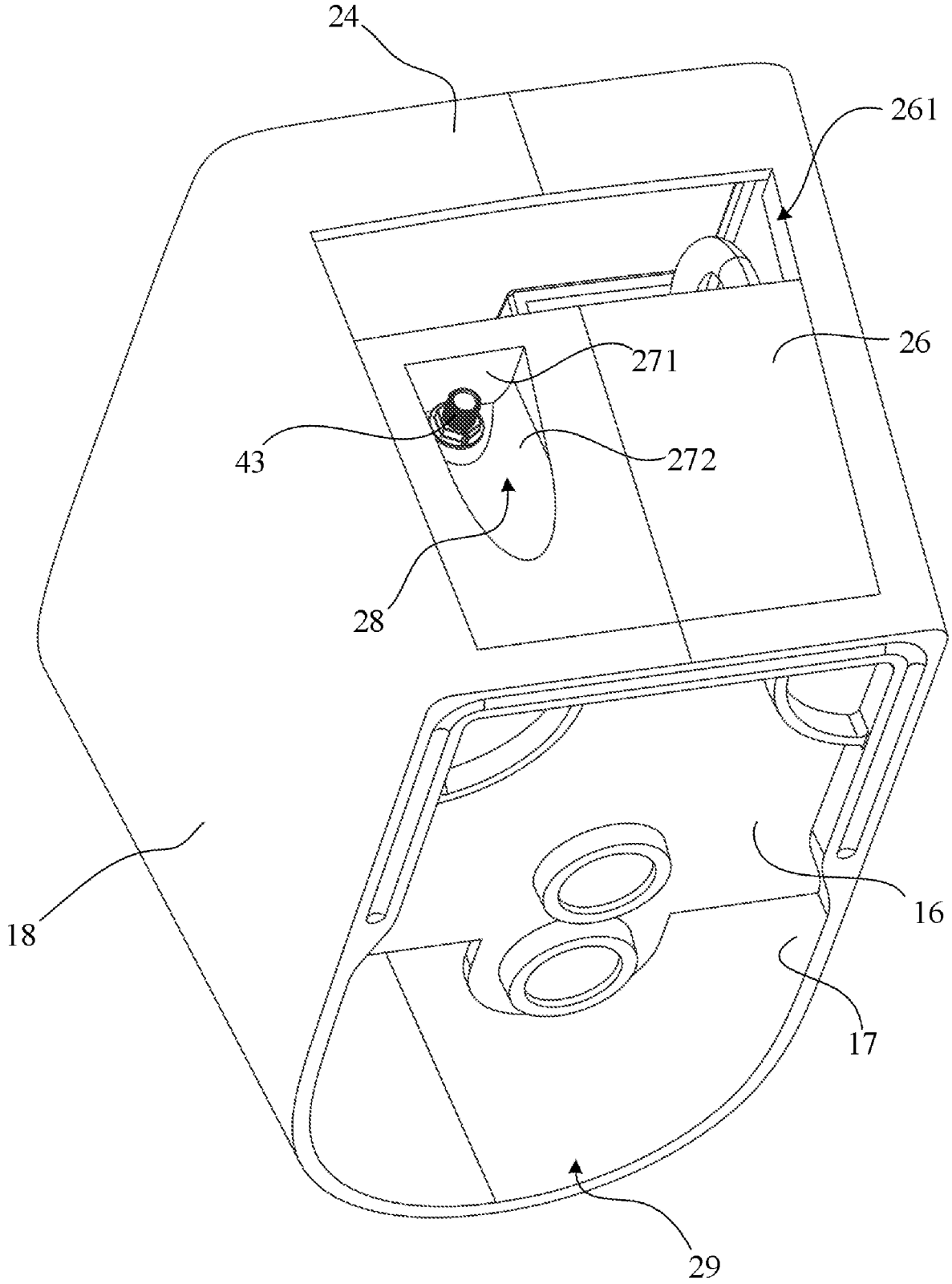
FIG. 10 is a perspective structural schematic view of a bottom of the bidet with an integrated built-in water tank as shown in FIG. 8.
Figure 11:
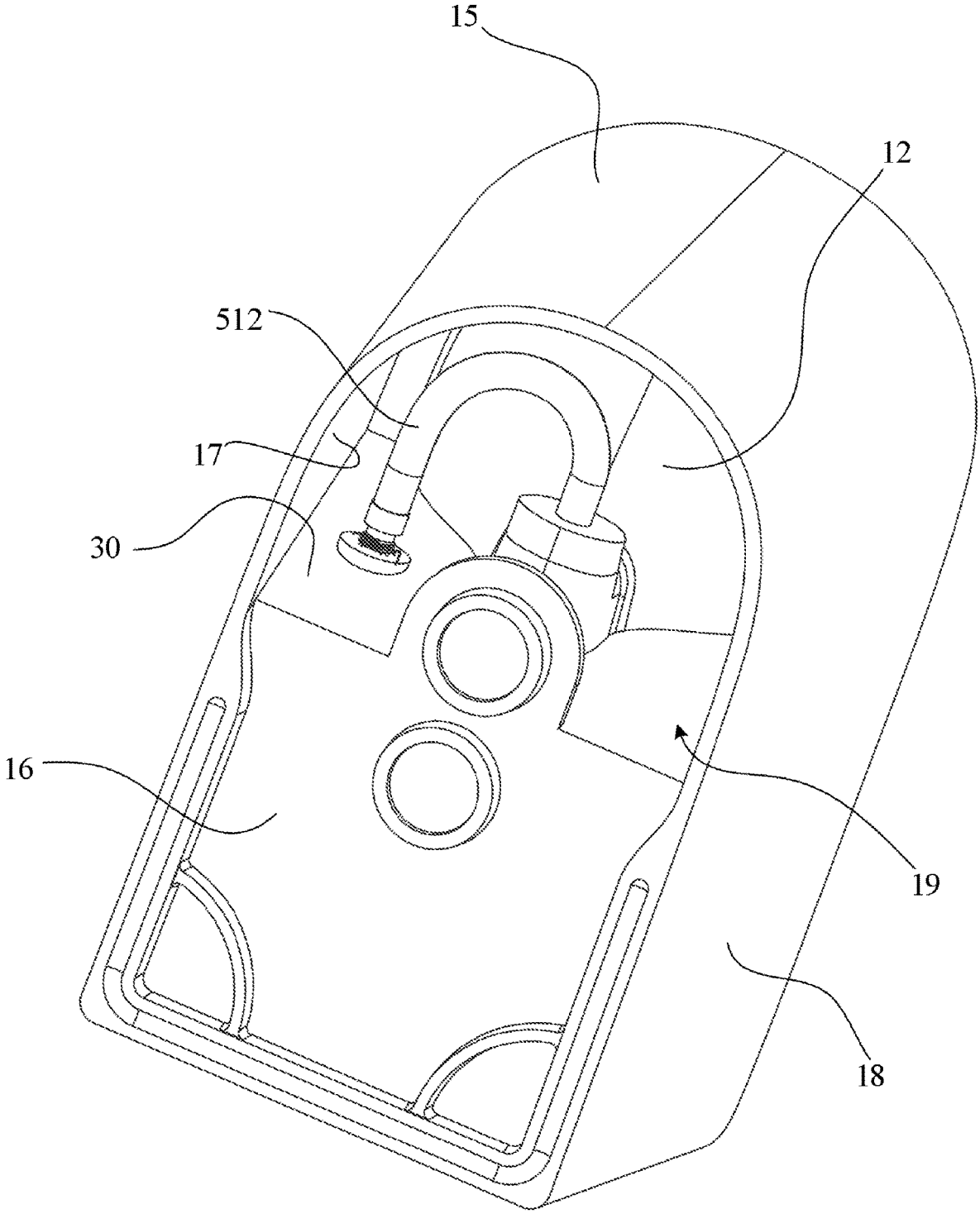
FIG. 11 is a perspective structural schematic view of another angle of the bottom of the bidet with an integrated built-in water tank as shown in FIG. 8.
Figure 12:
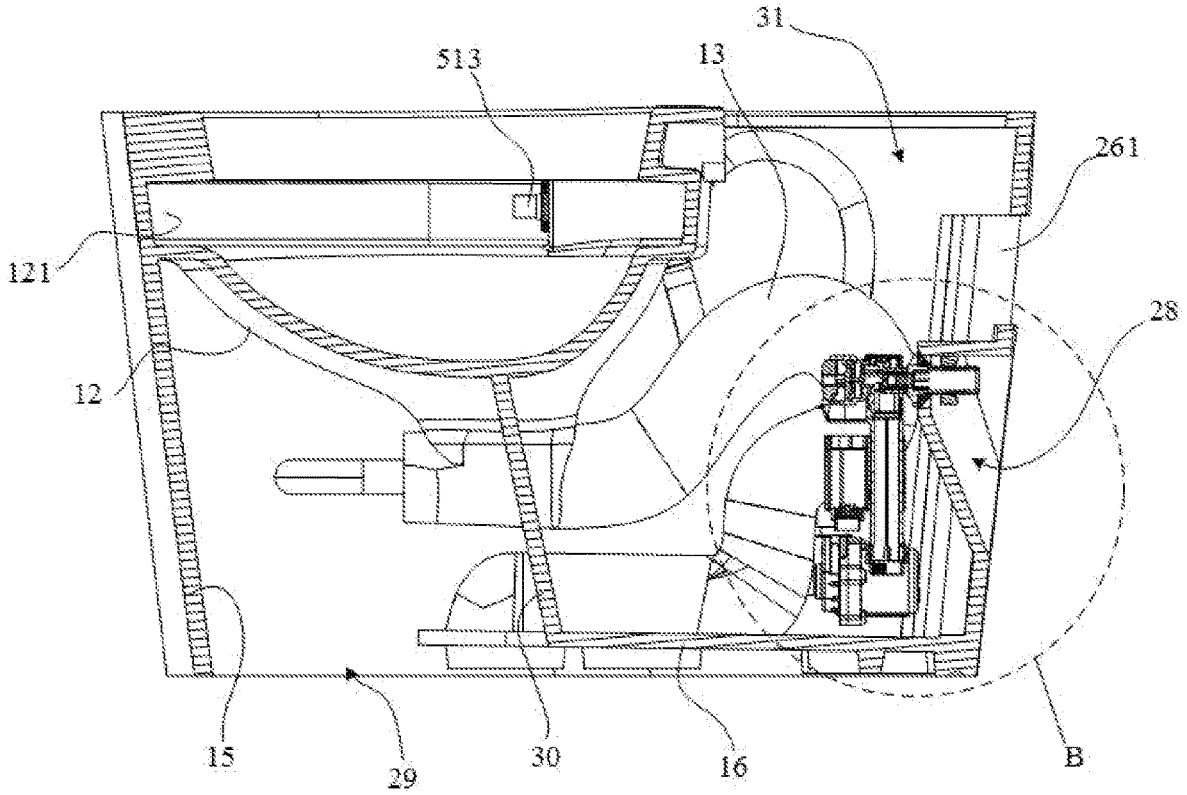
FIG. 12 is a cross-sectional structural schematic view of the bidet with an integrated built-in water tank as shown in FIG. 8.
Figure 13:
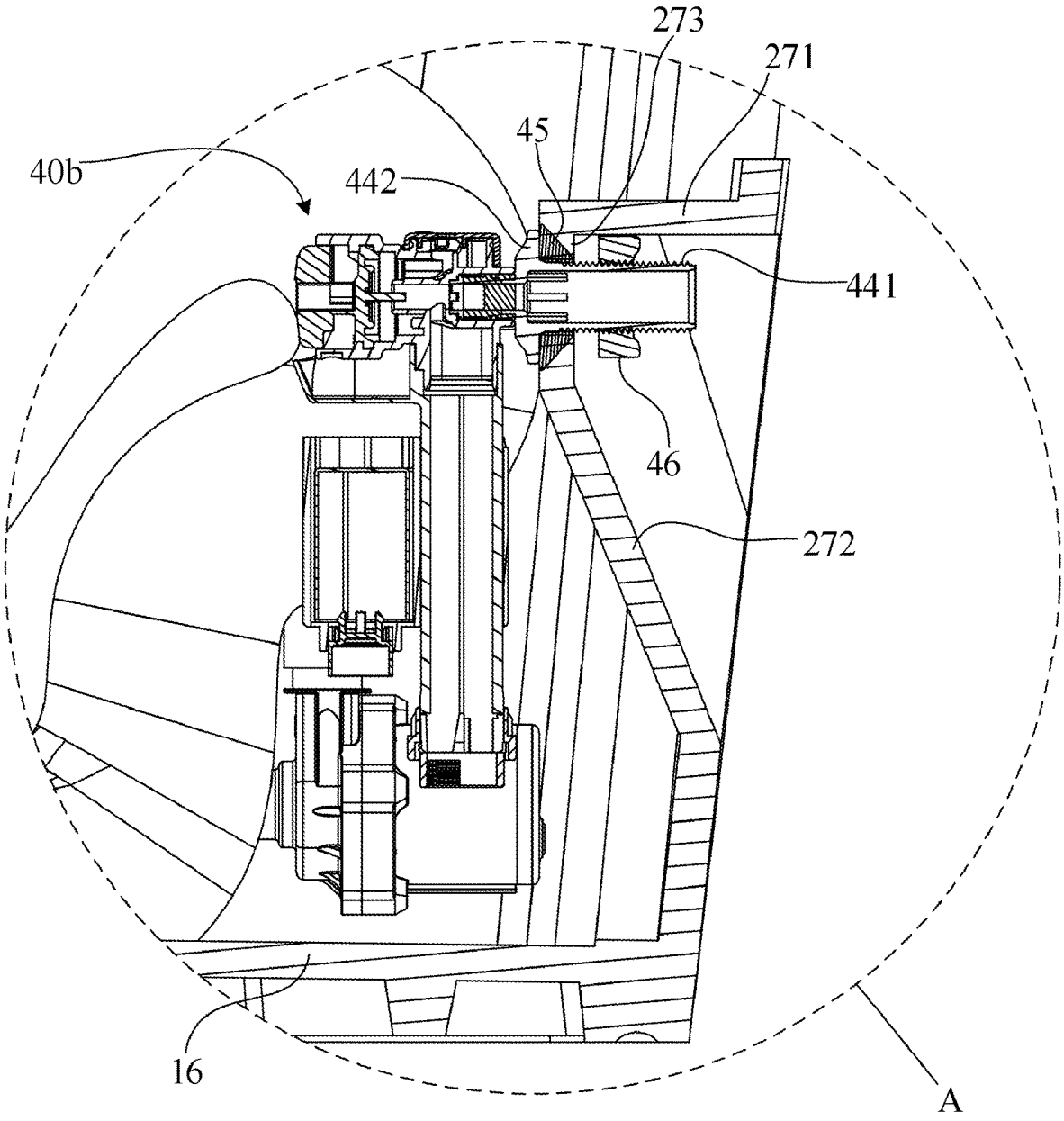
FIG. 13 is a schematic view of a partially enlarged structure at B in FIG. 12.
Figure 14:
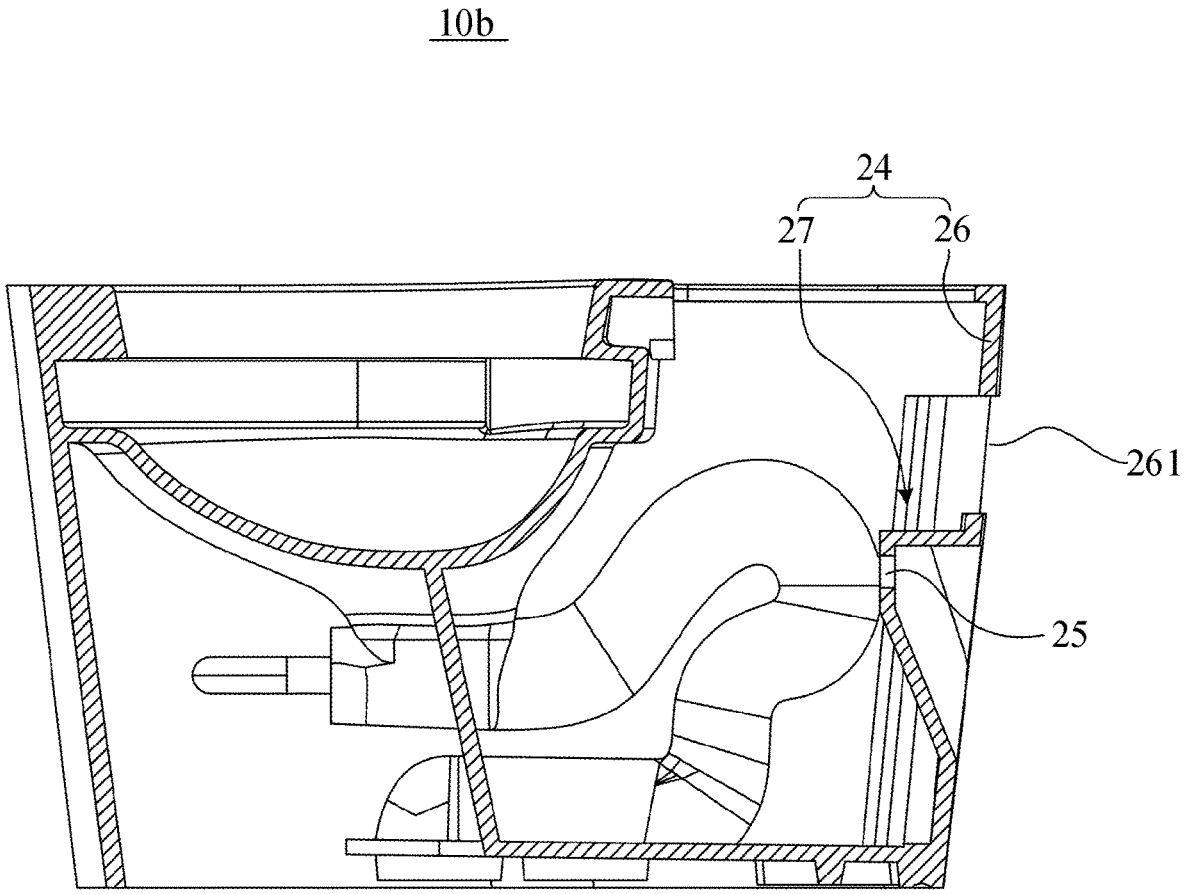
FIG. 14 is a cross-sectional structural schematic view of a seat in FIG. 12.
Figure 15:
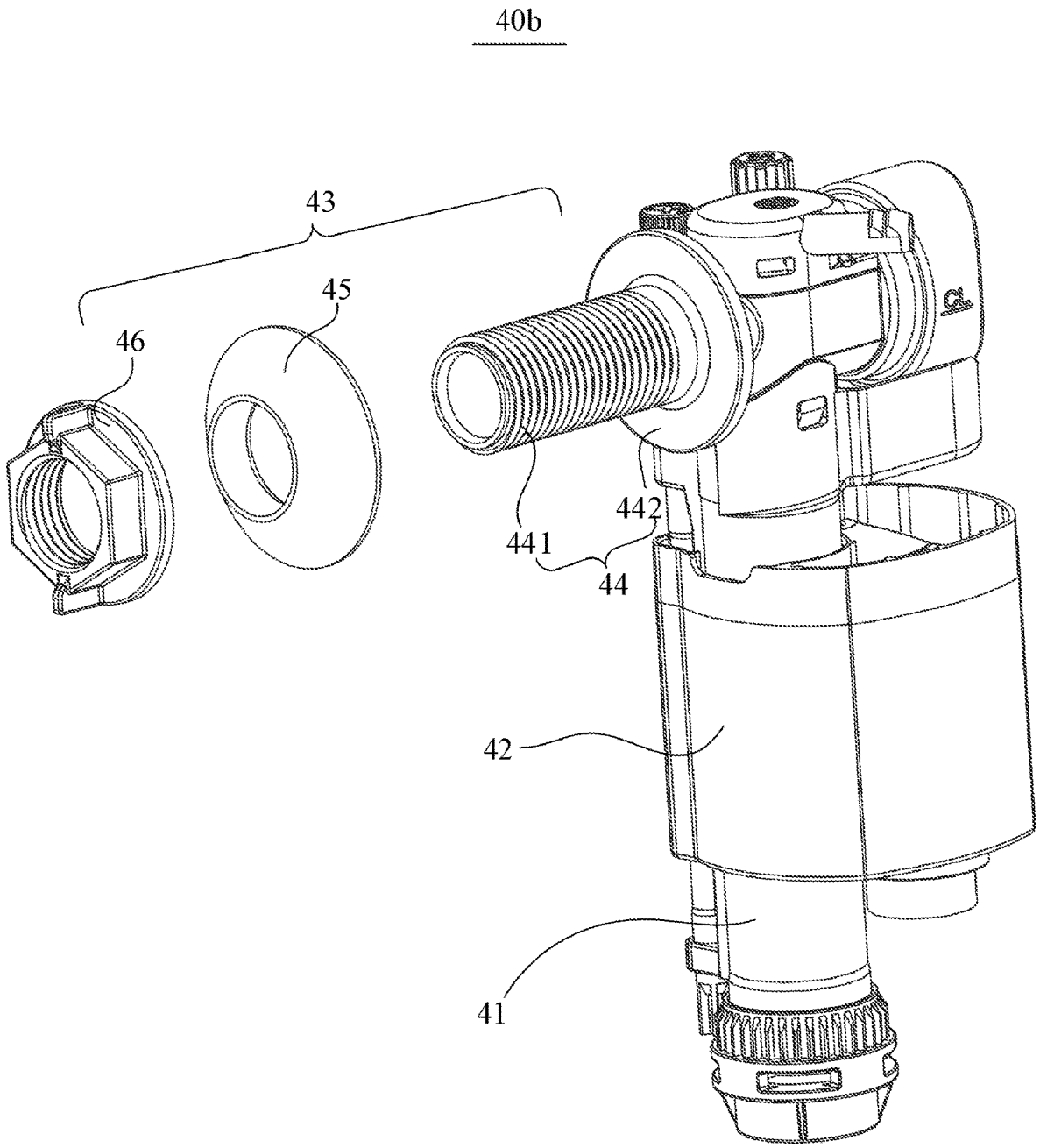
FIG. 15 is an exploded structural schematic view of a water inlet assembly in FIG. 9.
Figure 16:
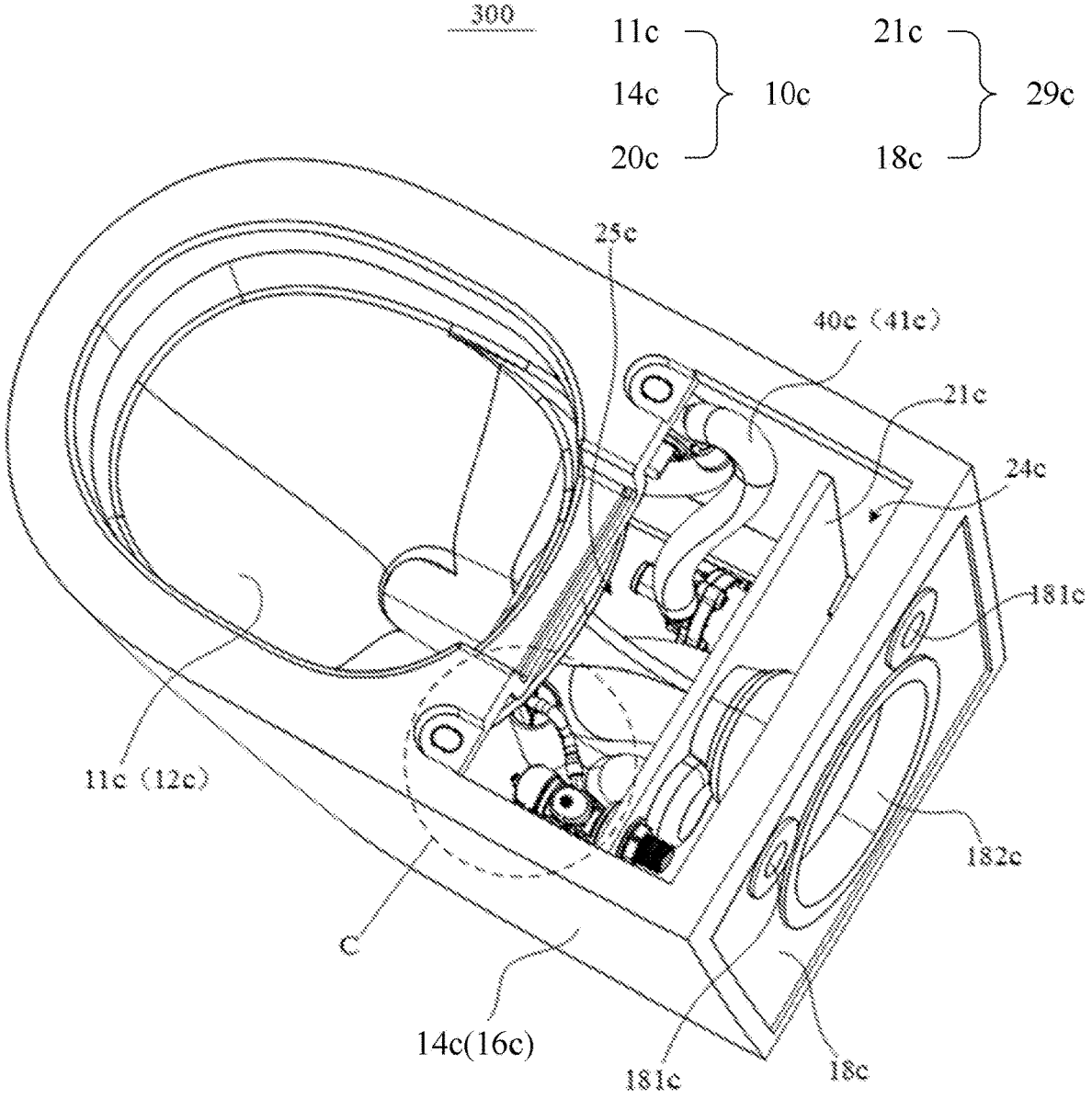
FIG. 16 is a perspective structural schematic view of a bidet with an integrated built-in water tank according to a third embodiment of the present disclosure.
Figure 17:
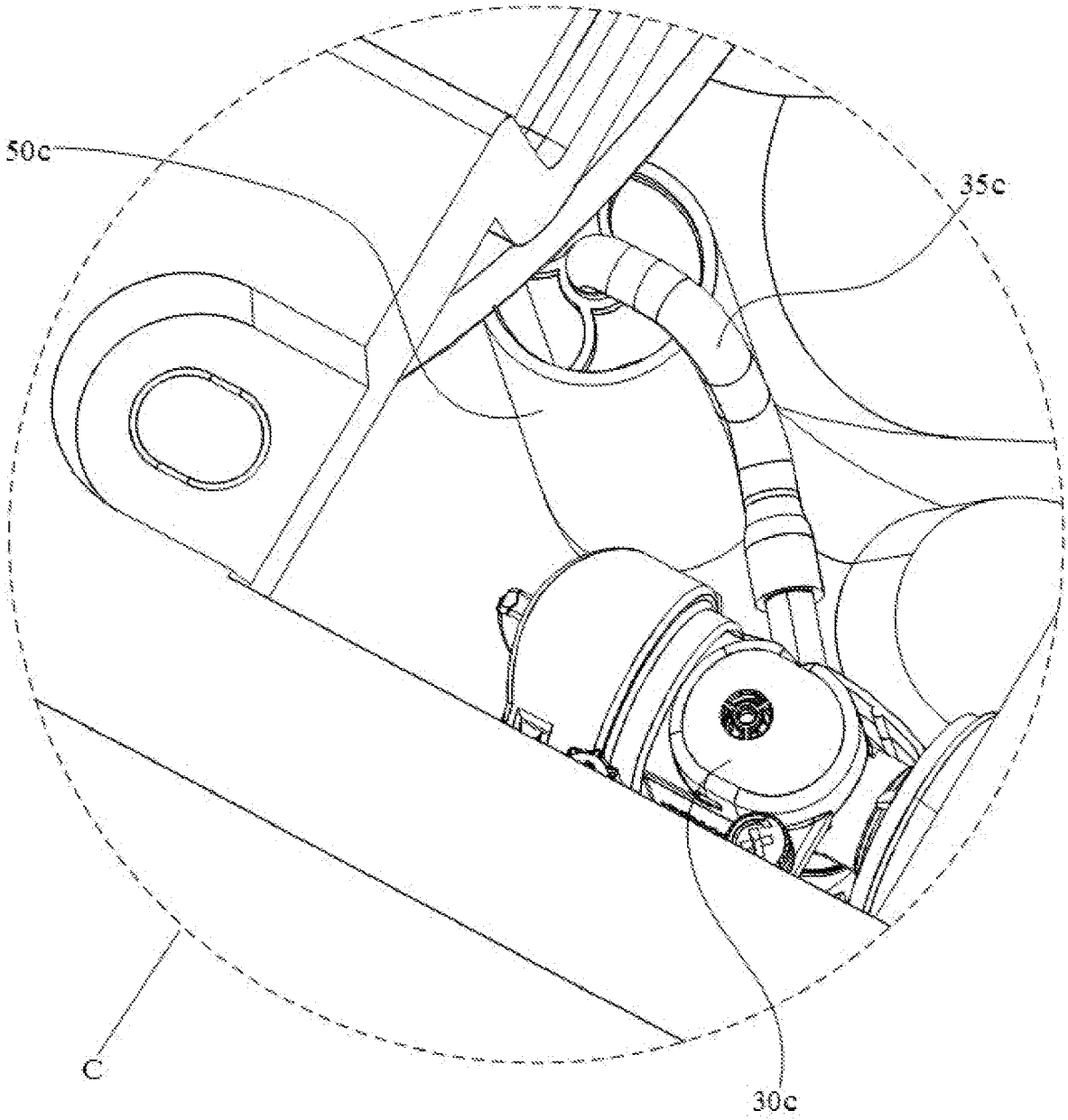
FIG. 17 is a schematic view of a partially enlarged structure at C in FIG. 16.
Figure 18:
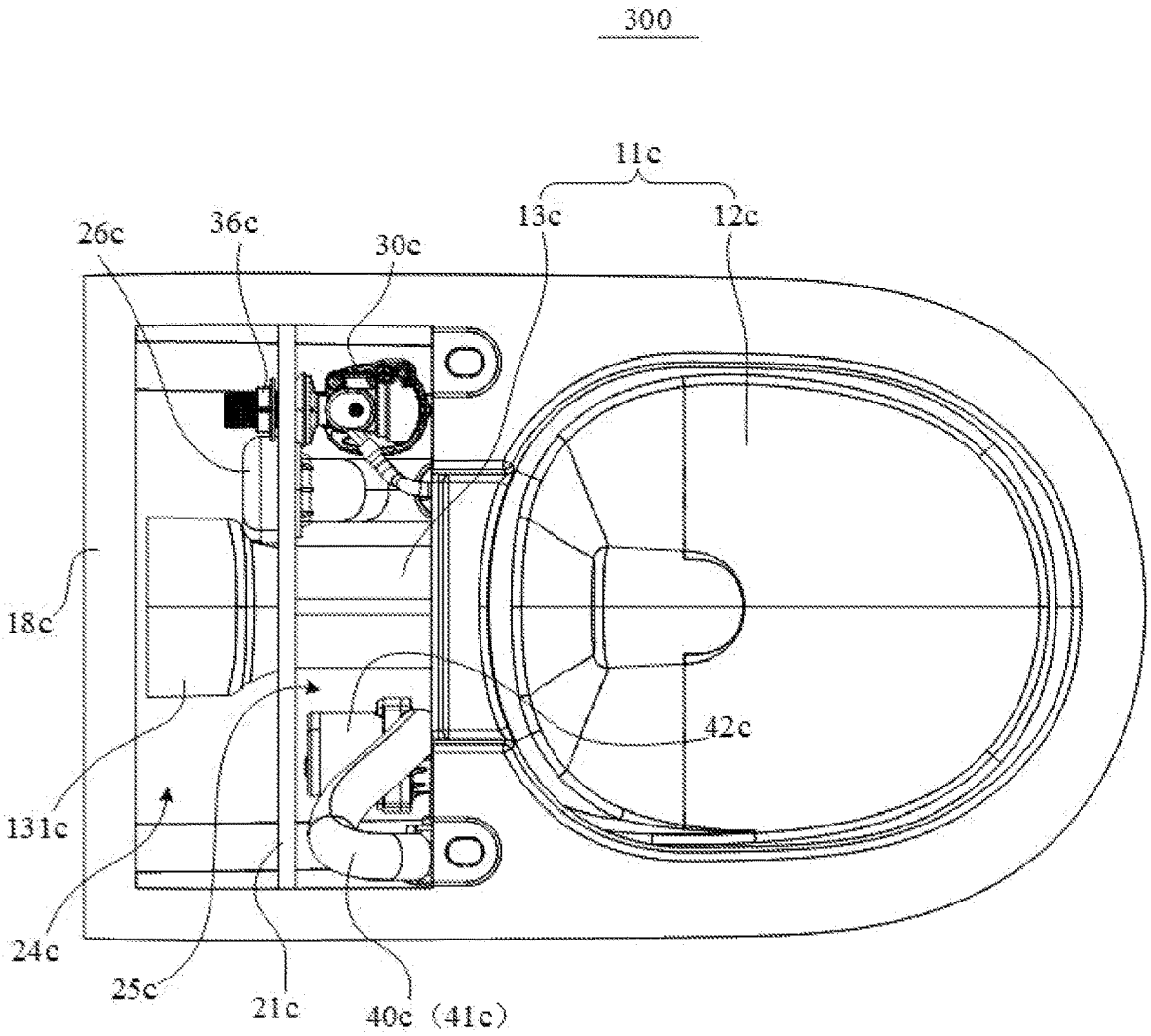
FIG. 18 is a top structural schematic view of the bidet with an integrated built-in water tank as shown in FIG. 16.
Figure 19:
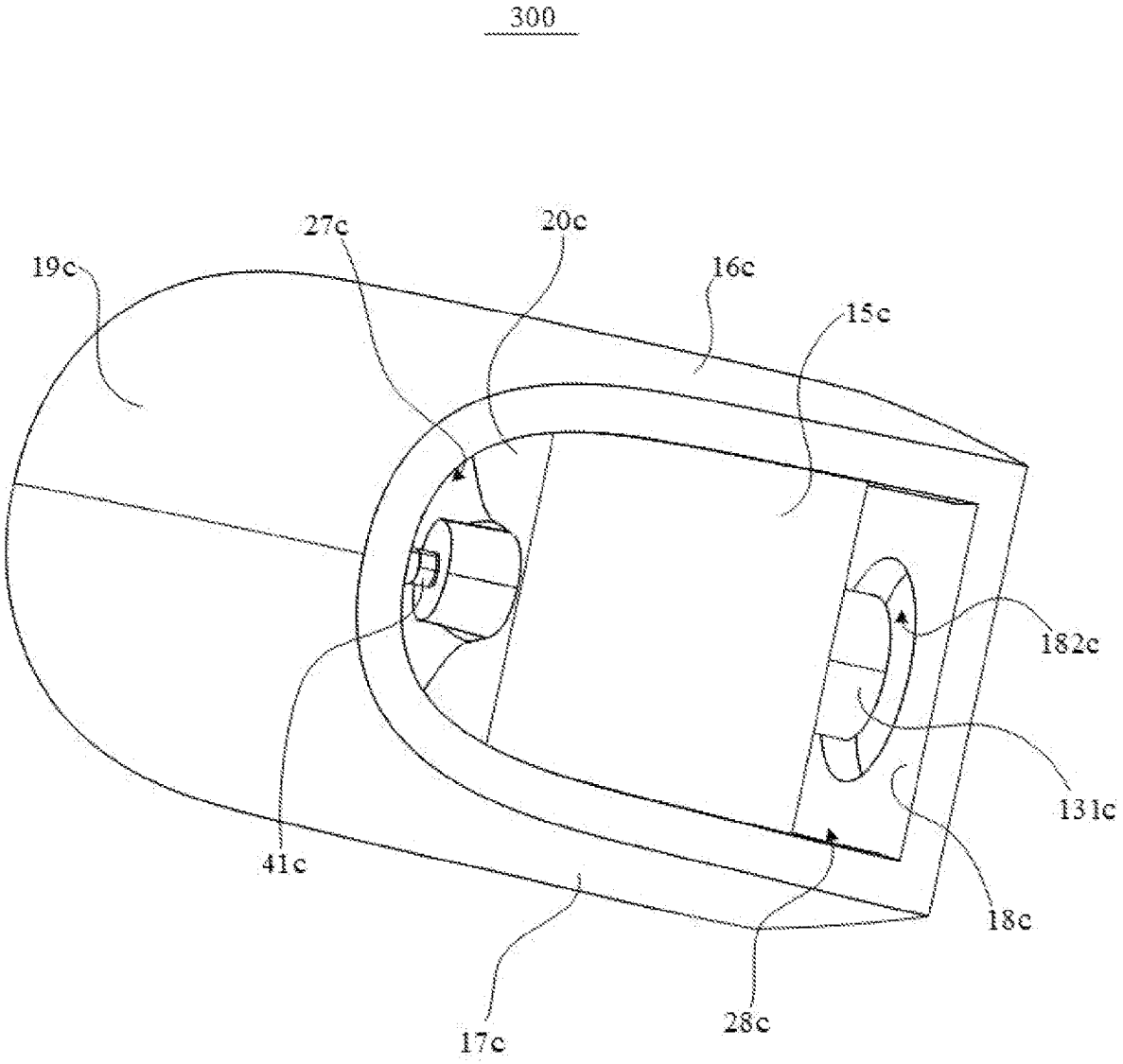
FIG. 19 is a bottom structural schematic view of the bidet with an integrated built-in water tank as shown in FIG. 16.
Figure 20:
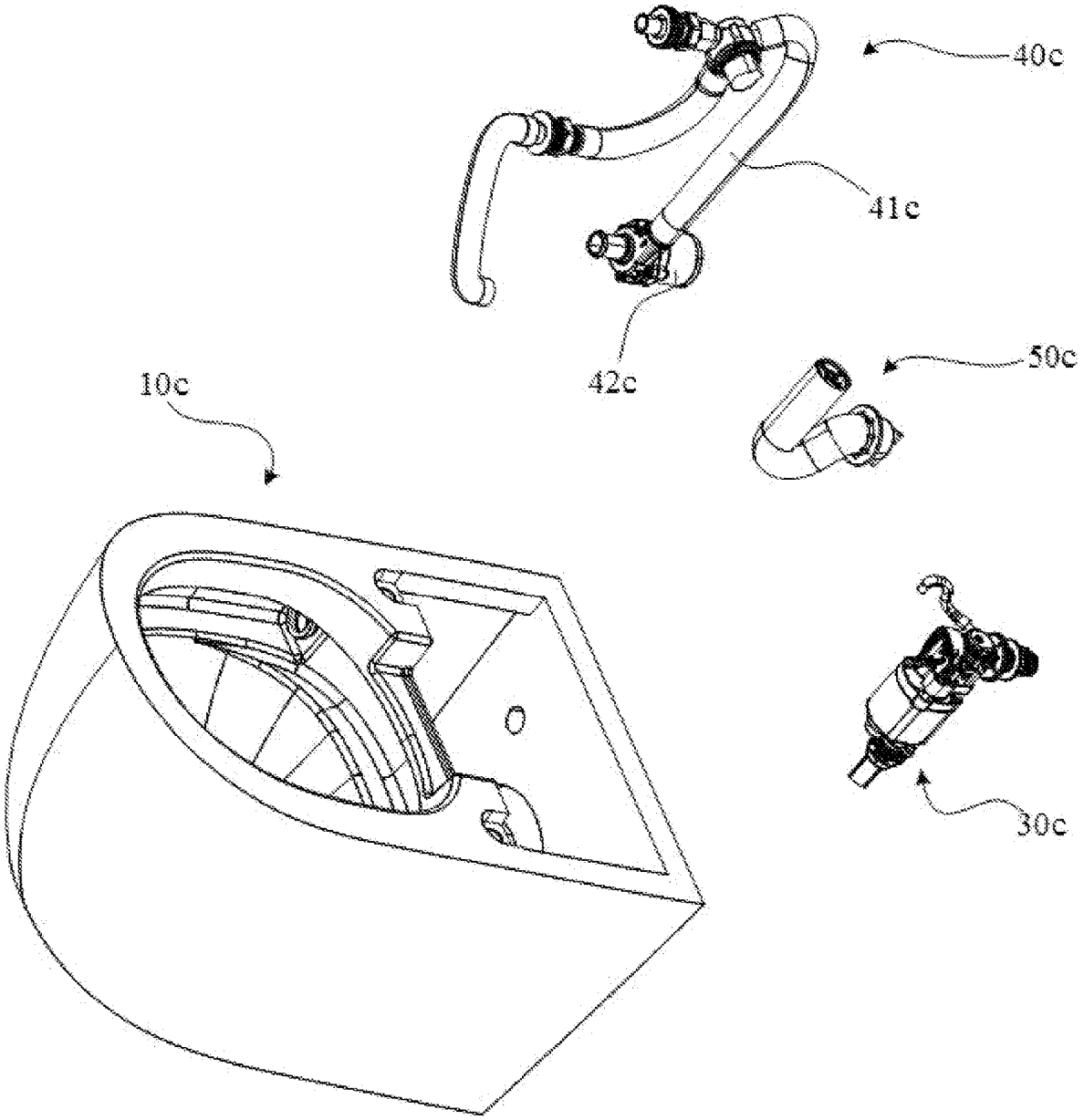
FIG. 20 is an exploded structural schematic structural view of the bidet with an integrated built-in water tank as shown in FIG. 16.

Further, referring to FIGS. 6 and 7, or referring to FIGS. 12 to 15, in the first and second embodiments, the water inlet fitting 43 includes a fitting body 44, a sealing ring 45, and a fastener 46; the fitting body 44 includes a tube portion 441 and a limiting flange 442 disposed on an outer peripheral surface of an inner end of the tube portion 441, and the outer peripheral surface of the tube portion 441 defines an outer thread; the tube portion 441 passes through the water inlet installation hole 20, 25; the limiting flange 442 is disposed on an inner side of the rear sidewall 19, 24, the sealing ring 45 is disposed between the limiting flange 442 and the rear sidewall 19, 24, and the fastener 46 is threadedly mated with the tube portion 441 and disposed on an outer side of the rear sidewall 19, 24.

In the embodiments, the sealing ring 45 can be tightly pressed between the limiting flange 442 and the rear sidewall 19, 24 by screwing the fastener 46. In some embodiments, the sealing ring 45 has a tapered sealing surface, a small diameter of the sealing surface is set close to the rear sidewall 19, 24, and the small diameter of the sealing surface is less than an inner diameter of the inlet installation hole 20, 25.

Further, referring to FIGS. 1 to 6, or referring to FIGS. 8 to 12, in the first and second embodiments, the partition 30 extends upwardly to be connected to the bedpan 12, and an upper portion of the rear sidewall 19, 24 defines a window 211, 261 connected to the outside.

In the embodiments, the partition 30 extends upwardly to be connected to the bedpan 12, thereby increasing the capacity of the water tank 31, while the window 211, 261 defined on the rear sidewall 19, 24 can realize overflow and provide the possibility of touching the bidet main body 11 from another angle. It will be appreciated that in an event that the water valve assembly 42 malfunctions and the water tank 31 is overfilled, the overflow through the window 211, 261 prevents water from soaking electromechanical parts of the smart toilet cover located above.

Further, the drain pipe 13 has a curved portion extending into the water tank 31; the drain pipe 13 is arranged in the middle in a left-right direction; the water inlet assembly 40*a*, 40*b* and the water pump 52 are located on both sides of the drain pipe 13, respectively, in the left-right direction.

In the embodiments, the curved portion of the sewage pipe 13 extends into the water tank 31, meaning that the position of the partition 30 is sufficiently forward, such that it is conducive to expanding the capacity of the water tank 31. The water inlet assembly 40*a*, 40*b* and the water pump 52 are located on the both sides, which is conducive to ensuring that there is enough installation space for each other, thereby enhancing the installation efficiency.

Further, an inner wall surface of an upper portion of the bedpan 12 defines an annular flushing groove 121; the jetting assembly 50 further includes a three-way valve 53; the jetting pipe 51 includes a main path 511, and a first branch path 512 and a second branch path 513 respectively connected to two outlets of the three-way valve 53; the main path 511 is connected to an outlet of the water pump 52 and an inlet of the three-way valve 53; an outlet of the first branch path 512 is connected to a bottom of the bedpan 12, and an outlet of the second branch path 513 is connected to the flushing groove 121 on the upper portion of the bedpan 12.

In the embodiments, the jetting assembly 50 performs rinsing by two branch paths, such that a better rinsing effect can be achieved under the premise of the same amount of water; in other words, while achieving the same rinsing effect, the two branch paths may achieve a better water-saving performance.

Further, the partition 30 extends upwardly to be connected to the bedpan 12, and the partition 30 defines a through hole for the second branch path 513 to pass through.

In the embodiments, by defining the through hole on the partition 30, the second branch path 513 can be better connected to a portion of the drain pipe 13 at the foremost end, thereby enhancing the water flow in the direction from the front to the rear, and thus enhancing the rinsing effect.

In a third embodiment, referring to FIGS. 16 to 21 and FIG. 25, a bidet 300 with an integrated built-in water tank proposed in the present disclosure includes a seat 10*c*, a water inlet assembly 30*c*, and a jetting assembly 40*c*; the seat 10*c* includes a bidet main body 11*c*, a shell 14*c*, and a partition 20*c*.

The bidet main body 11*c* includes a bedpan 12*c* and a drain pipe 13*c* connected to the bedpan 12*c*.

The shell 14*c* is disposed at a periphery of the bidet main body 11*c*; the shell 14*c* includes a bottom wall 15*c*, a left sidewall 16*c*, a right sidewall 17*c*, and a rear sidewall 29*c*; the rear sidewall 29*c* includes a first rear sidewall 21*c* and a second rear sidewall 18*c* disposed facing each other in a front-rear direction, and the second rear sidewall 18*c* defines a hanging hole 181*c* and a drain through hole 182*c*.

The partition 20*c* and the first rear sidewall 21*c* are disposed opposite to each other in the front-rear direction and both extend upwardly from the bottom wall 15*c*, and a front portion of the bedpan 12*c* protrudes from a front side of the partition 20*c*; the partition 20*c* and the first rear sidewall 21*c* are disposed on a front side of the second rear sidewall 18*c*; an installation cavity 24*c* is defined between the first rear sidewall 21*c* and the second rear sidewall 18*c*, and the drain pipe 13*c* passes through the first rear sidewall 21*c* and has an external connection end 131*c* extending into the installation cavity 24*c*, the external connection end 131*c* being disposed at a position corresponding to the drain through hole 182*c*; the partition 20*c*, the first rear sidewall 21*c*, the bottom wall 15*c*, the left sidewall 16*c*, and the right sidewall 17*c* enclose to form a water tank 25*c* that is opened upwardly.

The water inlet assembly 30*c* includes a water inlet pipe 31*c* and a water valve assembly 32*cc* connected in series to the water inlet pipe 31*c*; the jetting assembly 40*c* includes a jetting pipe 41*c* and a water pump 42*c* connected in series to the jetting pipe 41*c*; an inlet of the water pump 42*c* and an outlet of the water inlet pipe 31*c* are disposed in the water tank 25*c*, and the jetting pipe 41*c* is in communication with the bedpan 12*c*.

In the embodiments, the seat 10*c* may be a single component or may be assembled from multiple components; the seat 10*c* may be an integrated ceramic structure since the water tank 25*c* has an opening facing upward and the installation cavity 24*c* is defined between the first rear sidewall 21*c* and the second rear sidewall 18*c*. The bedpan 12*c* is configured to receive excrement, and the jetting assembly 40*c* is configured to jet water into an inner cavity of the bidet main body 11*c*, such that the excrement is discharged through the drain pipe 13*c*. In order to achieve a water saving effect, the jet pipe 41*c* may be connected to two branches, one branch jetting water from an upper edge of the bedpan 12*c* and the other branch jetting water from an inlet of the drain pipe 13*c*. The shell 14*c* is not only a cosmetic part, but also provides support for the bedpan 12*c*. The seat 10*c* can be suspended and mounted by using a fastener through the hanging hole 181*c* and a vertical surface installation structure, such as a wall or a bracket. Both the water inlet assembly 30*c* and the jetting assembly 40*c* may be adopted from the related art; the water valve assembly 32*c* may be either a manual or electromechanical automatic valve, such as a solenoid valve, or a purely mechanical automatic valve.

As proposed by the present disclosure, the bidet 300 with an integrated built-in water tank is arranged with the partition 20*c* and the first rear sidewall 21*c* which can directly cooperate with the shell 14*c* to enclose to form the water tank 25*c*, thereby making full use of the irregular space at the rear portion of the seat 10*c*. Further, the water tank 25*c* is with a large capacity, and the setting of the water tank 25*c* does not affect the shape of the bidet main body 11*c*. The opening on an upper portion of the water tank 25*c* also facilitates the installation of a smart toilet cover, whereby a lower raised portion at a rear end of the smart toilet cover can be embedded in the water tank 25*c*, thereby making the overall height of the product lower, which in turn enhances the installation adaptability or reduces the space occupation.

Further, referring to FIGS. 16 to 18, 20, and 21 to 24, in some embodiments, the bidet 300 with an integrated built-in water tank further includes an overflow pipe 50*c* passing through the first rear sidewall 21*c*; an inlet end 51*c* of the overflow pipe 50*c* is disposed in the water tank 25*c*, and an outlet end 52*c* of the overflow pipe 50*c* extends into the installation cavity 24*c*. In this way, even if the water inlet assembly 30*c* malfunctions which results in overfilling, the excess water can be discharged from the inlet end 51*c* of the overflow pipe 50*c*, thereby reducing the risk of water leakage from the bidet. In addition, due to the structure of the overflow pipe 50*c* within the water tank 25*c*, the bidet is provided with a water level line defined by a mandatory standard.

Further, the outlet end 52*c* of the overflow pipe 50*c* is in communication with the external connection end 131*c*. In this way, the overflow pipe 50*c* and the drain pipe 13*c* can share a common connection to the external pipe.

Figure 21:
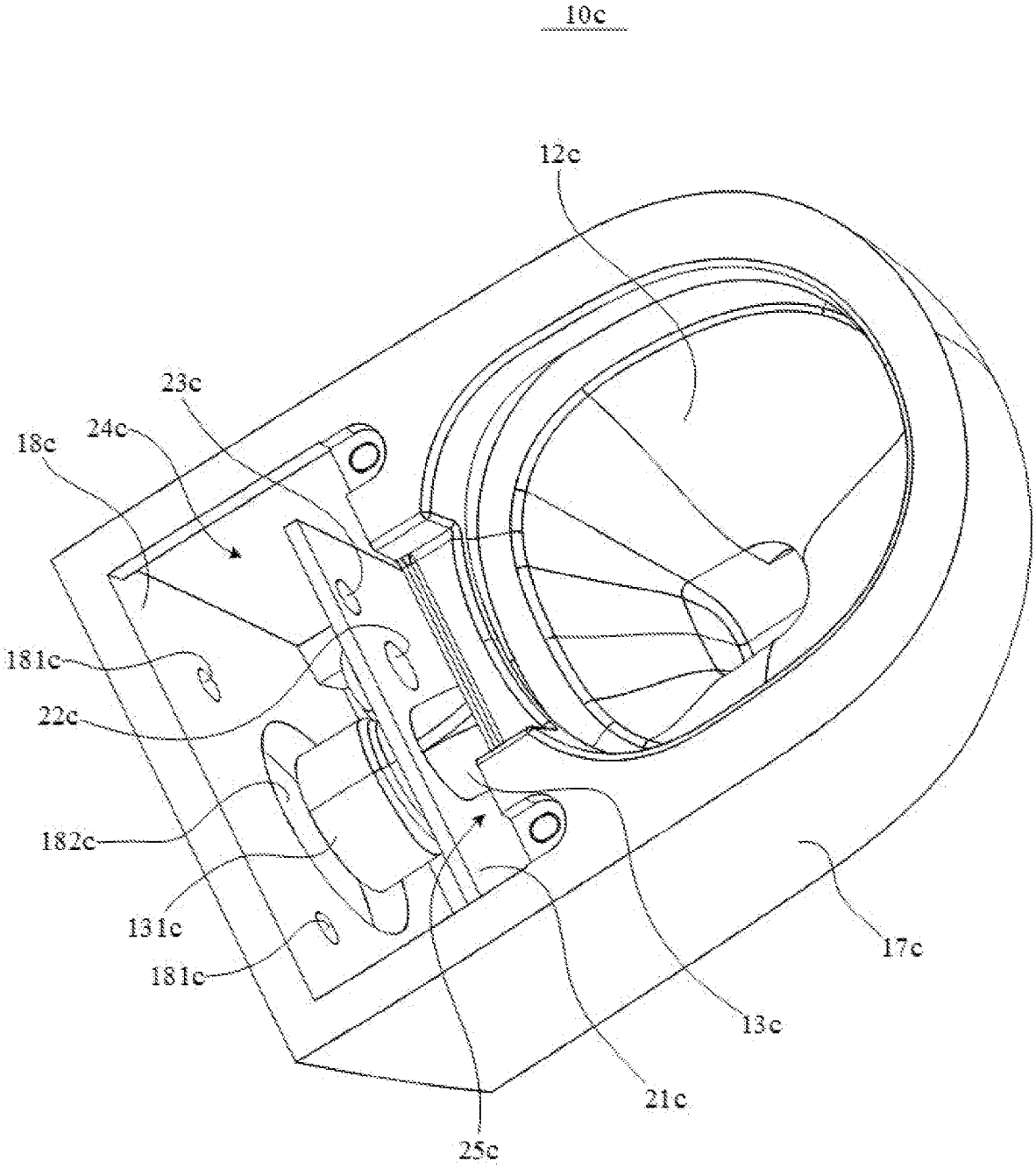
FIG. 21 is a perspective structural schematic view of a seat in FIG. 20.
Figure 22:
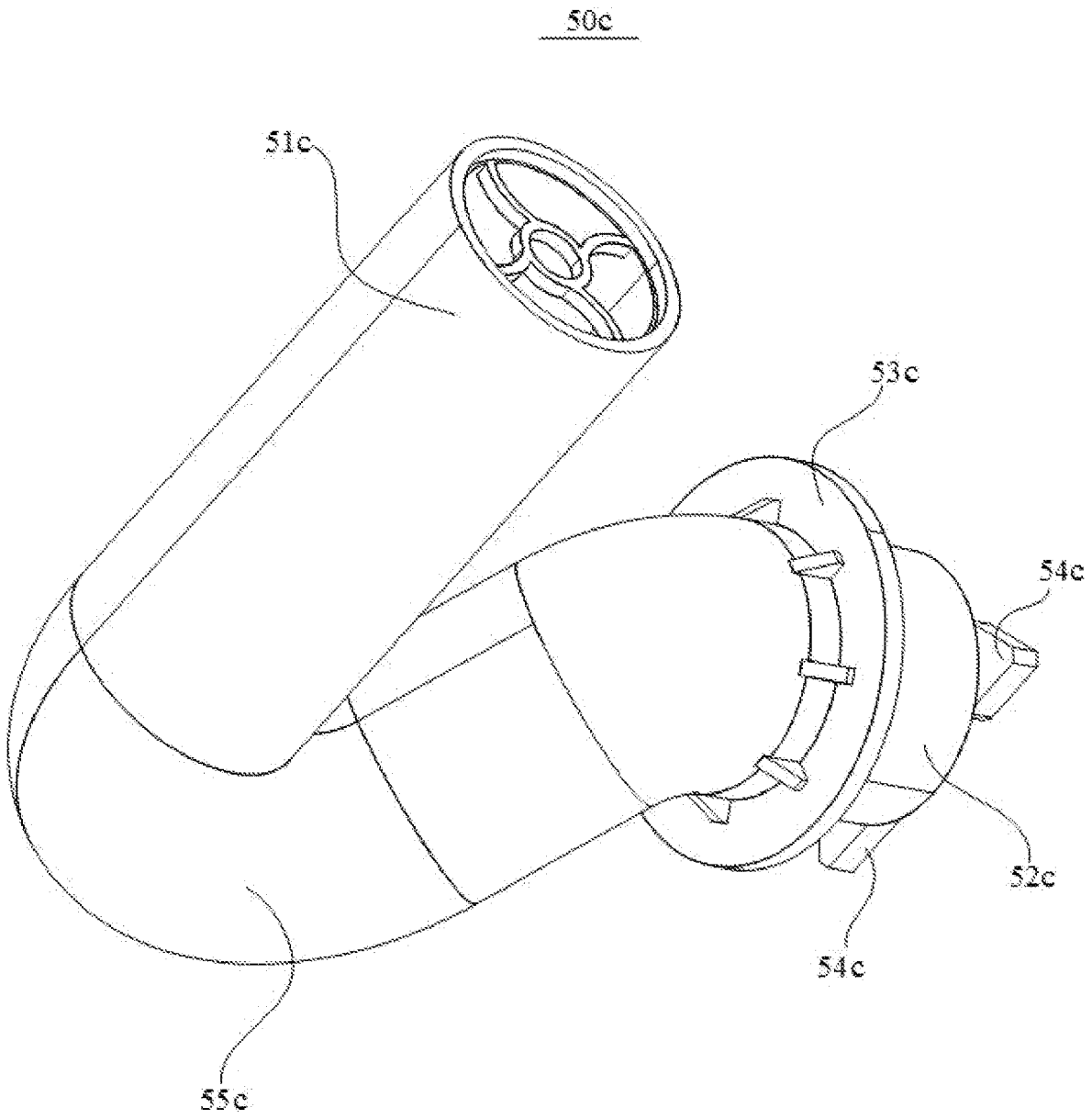
FIG. 22 is a perspective structural schematic view of an overflow pipe in FIG. 20.
Figure 23:
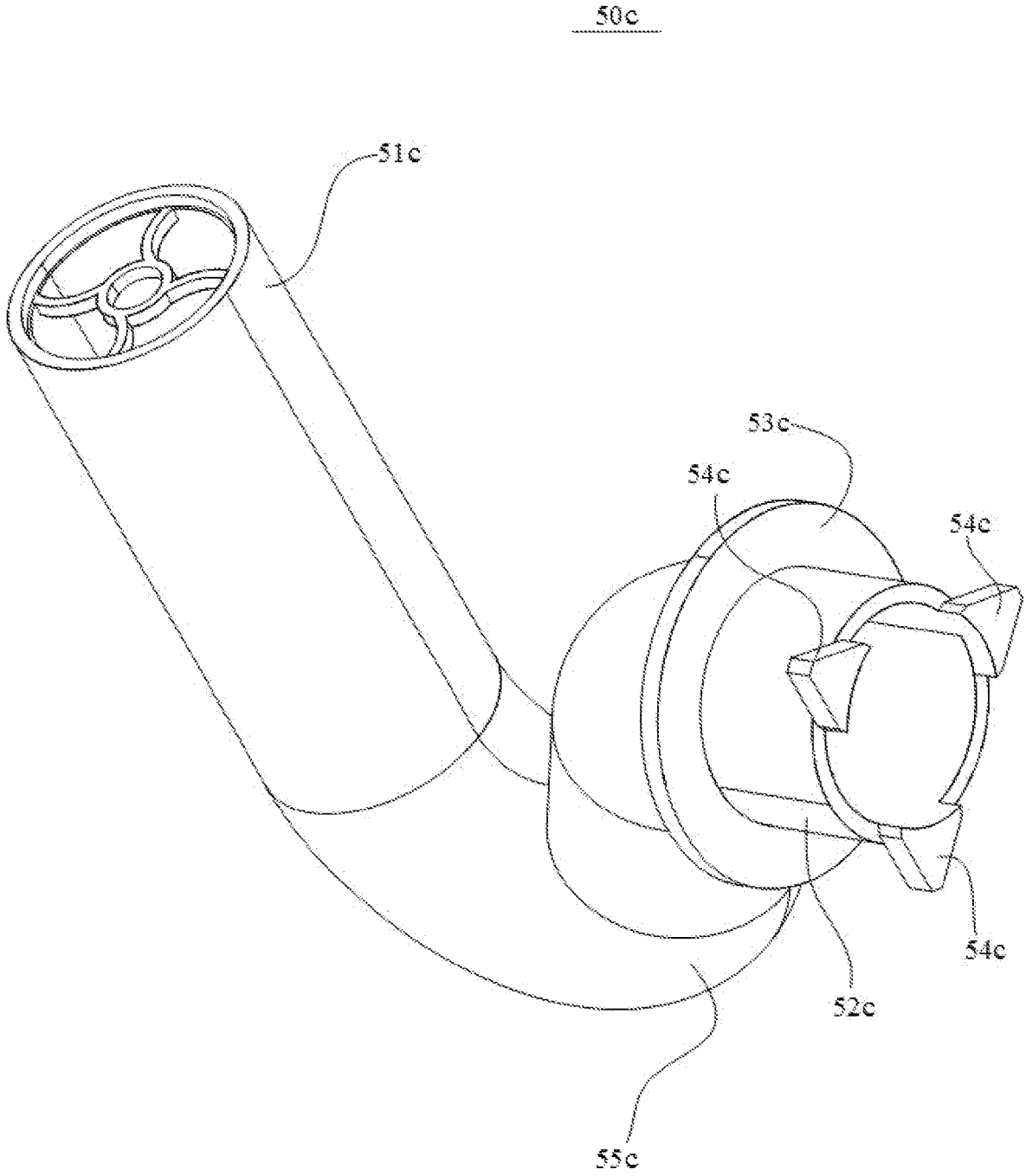
FIG. 23 is a perspective structural schematic view of another angle of the overflow pipe in FIG. 20.
Figure 24:
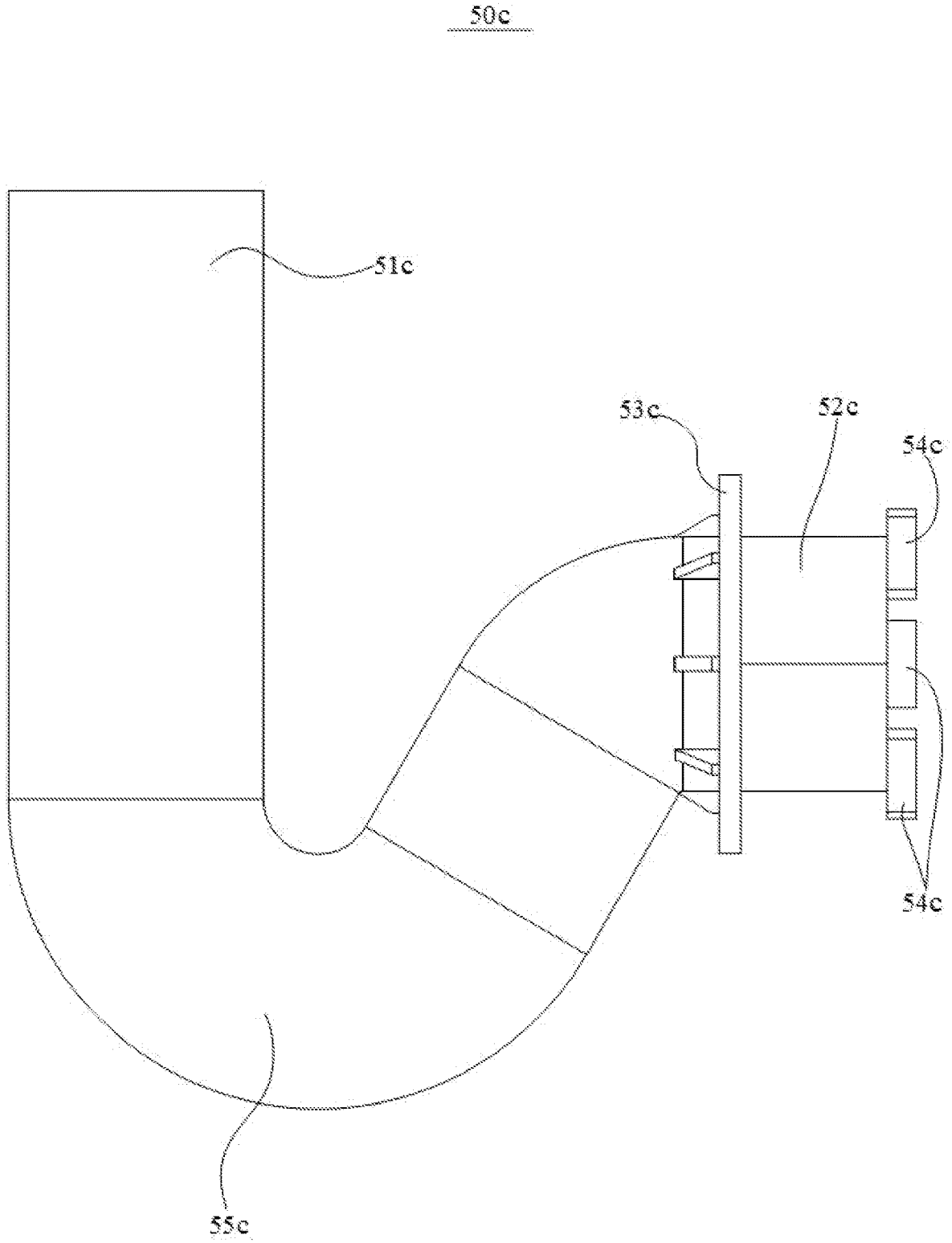
FIG. 24 is a front schematic view of the overflow pipe in FIG. 20.
Figure 25:
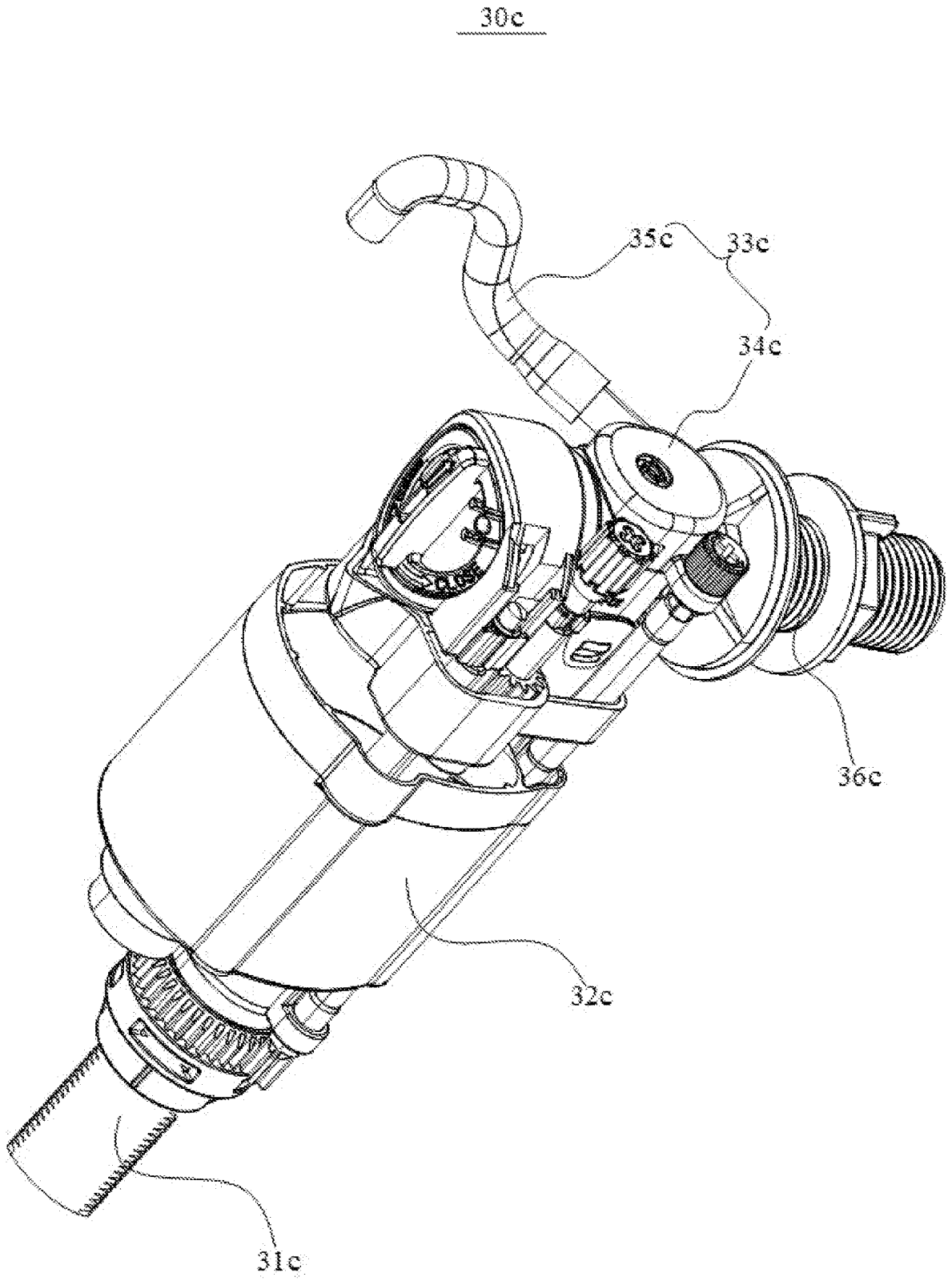
FIG. 25 is a perspective structural schematic view of a water inlet assembly in FIG. 20.
Figure 26:
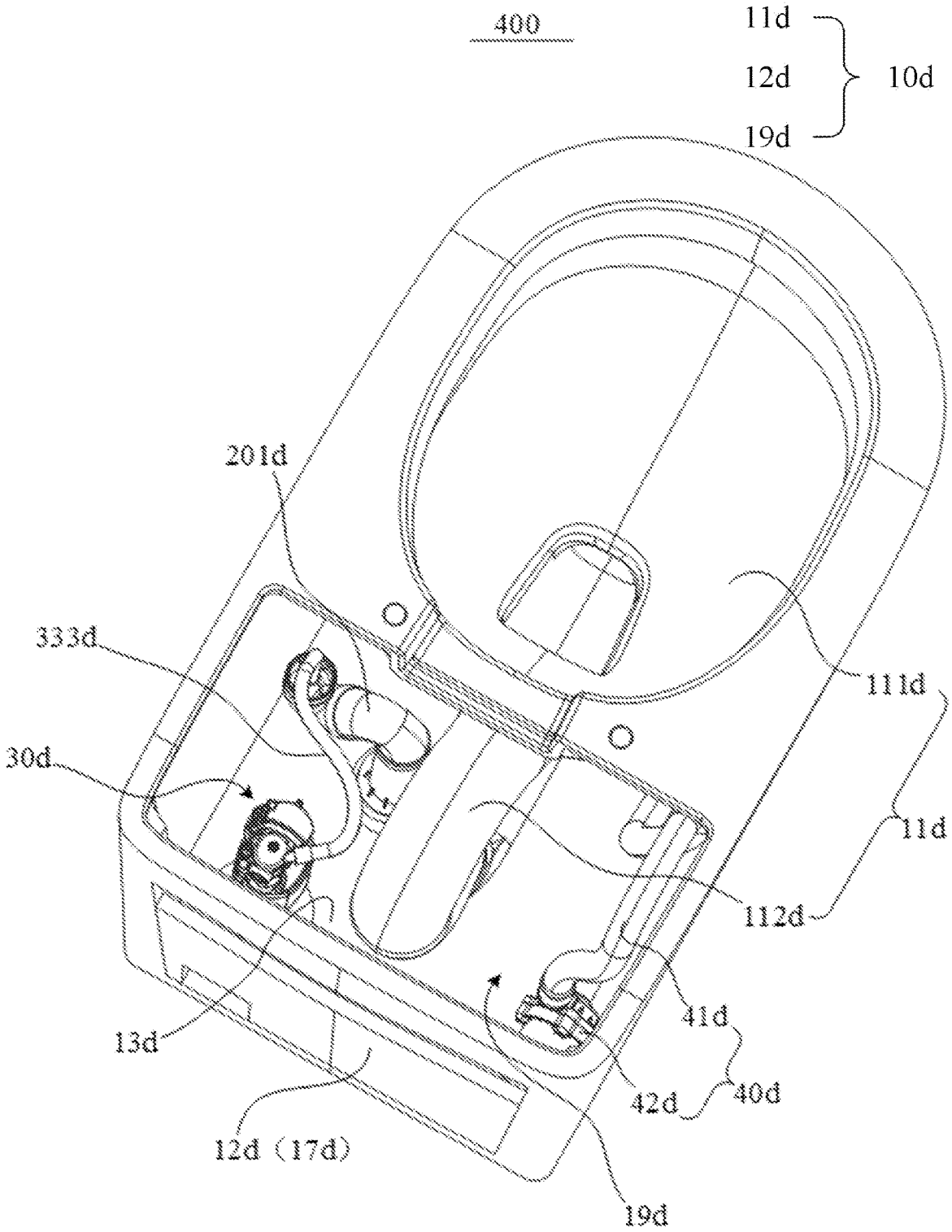
FIG. 26 is a perspective structural schematic view of a bidet with an integrated built-in water tank according to a fourth embodiment of the present disclosure.
Figure 27:
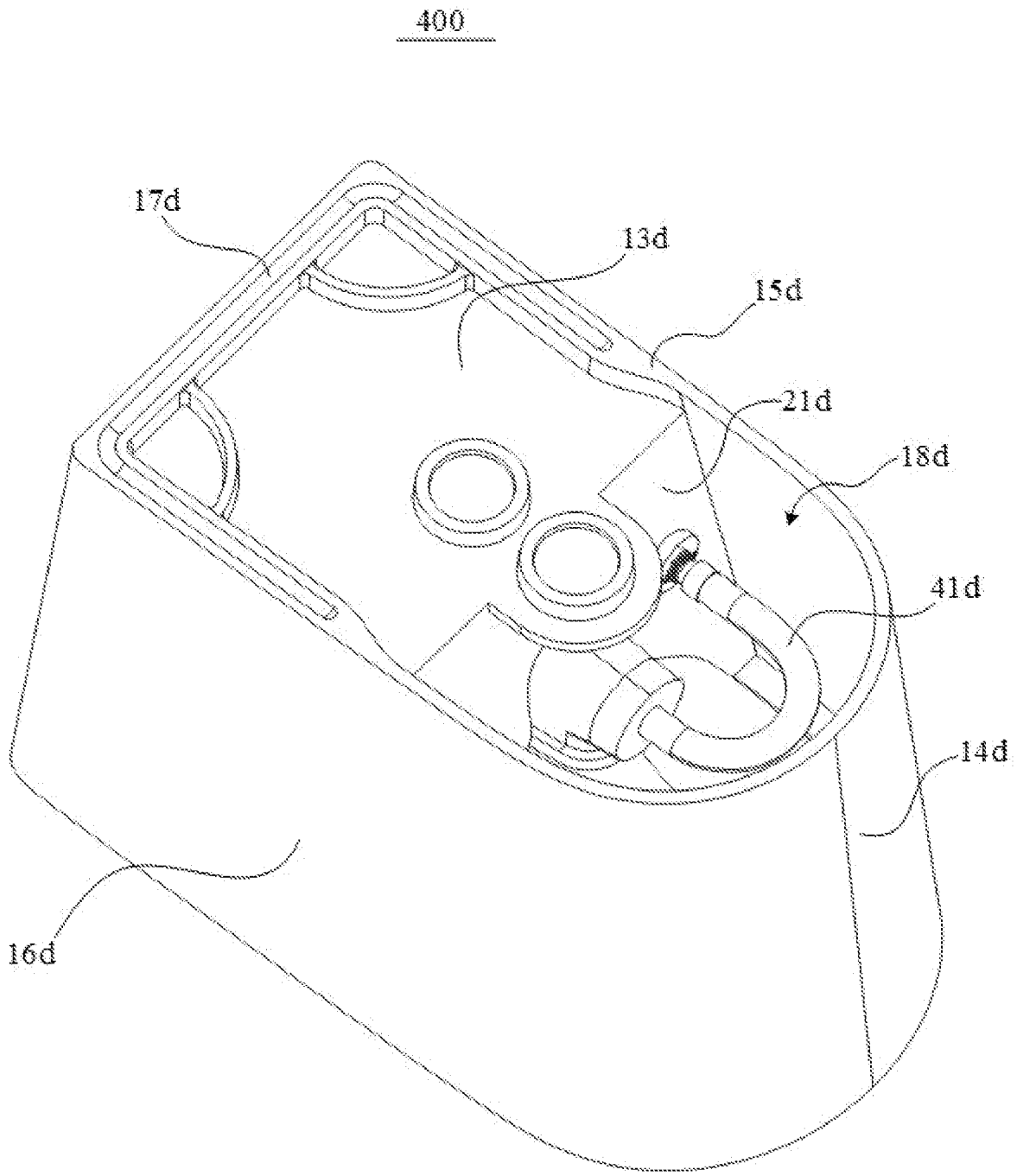
FIG. 27 is another perspective structural schematic view of the bidet with an integrated built-in water tank as shown in FIG. 26.
Figure 28:
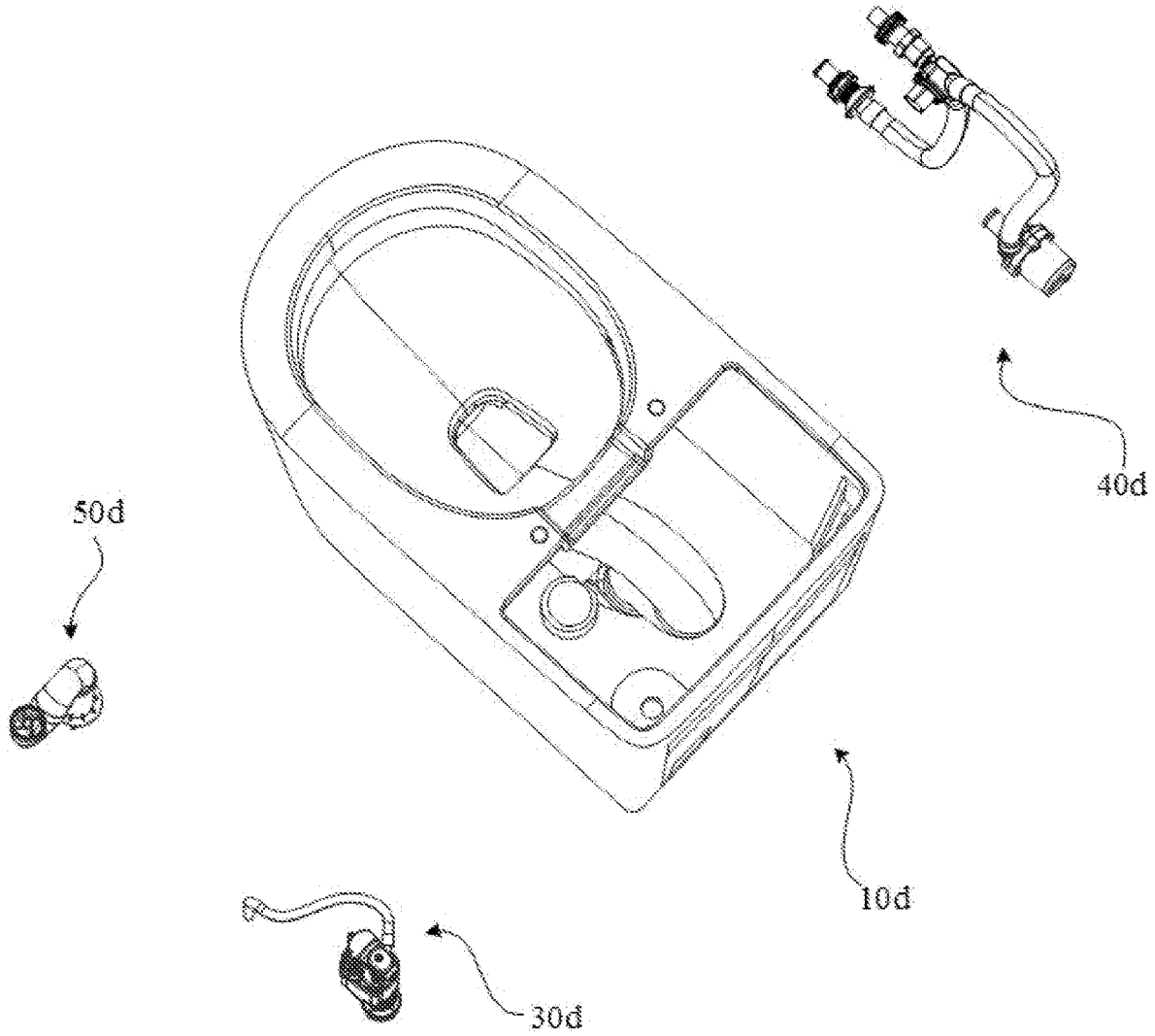
FIG. 28 is an exploded structural schematic view of the bidet with an integrated built-in water tank as shown in FIG. 26.
Figure 29:
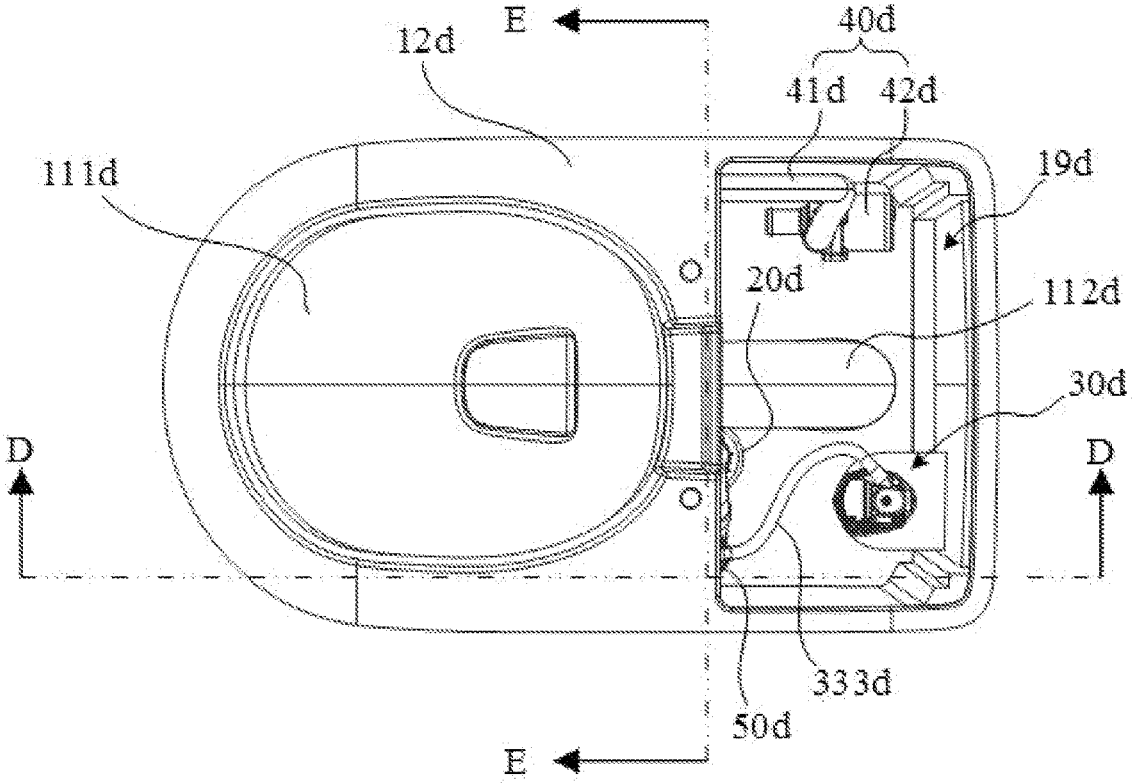
FIG. 29 is a top structural schematic view of the bidet with an integrated built-in water tank as shown in FIG. 26.
Figure 30:
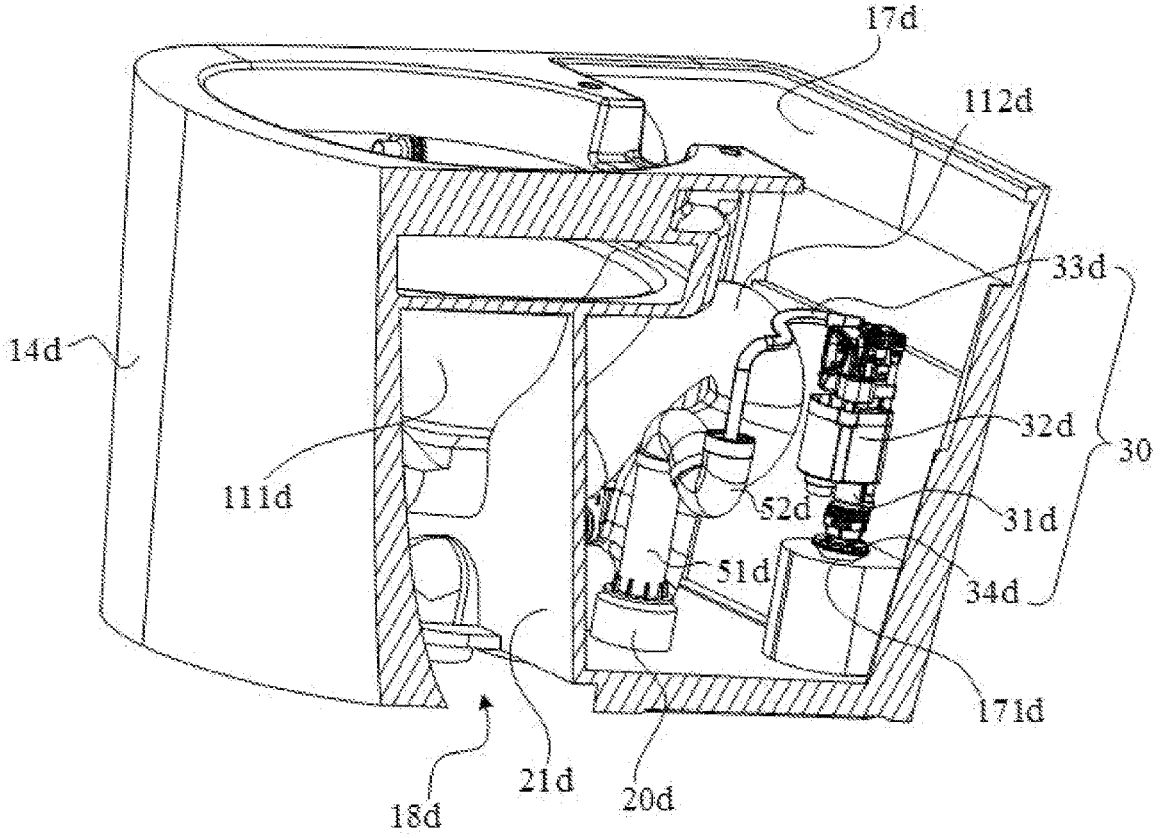
FIG. 30 is a cross-sectional structural schematic view along line D-D in FIG. 29.

Further, in order to facilitate lateral connection of the overflow pipe 50*c* to the external connection end 131*c* of the drain pipe 13*c*, the seat 10*c* further includes a connector 26*c* protruding on a rear surface of the first rear sidewall 21*c* and connected to an outer peripheral surface of the external connection end 131*c*; an inner cavity of the connector 26*c* is in communication with an inner cavity of the external connection end 131*c*. Referring together to FIG. 21, an overflow installation hole 22*c* is defined on the first rear sidewall 21*c* corresponding to the connector 26*c* and in communication with the inner cavity of the connector 26*c*, and the outlet end 52*c* of the overflow pipe 50*c* is sealingly fixed to the overflow installation hole 22*c*.

Further, in order to facilitate removable installation of the overflow pipe 50*c* with the first rear sidewall 21*c* and to ensure sealing between the overflow pipe 50*c* and the overflow installation hole 22*c*, an outer peripheral surface of the outlet end 52*c* of the overflow pipe 50*c* is arranged with a limiting flange 53*c* and an elastic snap 54*c*; the limiting flange 53*c* and the elastic snap 54*c* are spaced apart in a drainage direction of the overflow pipe 50*c*. The bidet 300 with an integrated built-in water tank further includes a sealing ring (not shown) sleeved on the outer peripheral surface of the outlet end 52*c* of the overflow pipe 50*c*, and the elastic snap 54*c* abuts against the rear surface of the first rear sidewall 21*c*; the sealing ring is pressed and clamped between the limiting flange 53*c* and a front surface of the first rear sidewall 21*c*, and is sealingly mated with the limiting flange 53*c* and the first rear sidewall 21*c*, respectively.

Further, the first rear sidewall 21*c* defines a water inlet installation hole 23*c*, and the water inlet assembly 30*c* further includes a water inlet fitting 36*c*; an outlet of the water inlet fitting 36*c* is in communication with an inlet of the water inlet pipe 31*c*; the water inlet fitting 36*c* is removably connected to the water inlet installation hole 23*c*; the partition 20*c*, the first rear sidewall 21*c*, the shell 14*c*, the bedpan 12*c*, and the connector 26*c* are of an integrated ceramic structure.

In the embodiments, the provision of the water inlet fitting 36*c* can facilitate connection of the water inlet pipe 31*c* to the municipal water pipe and support the water inlet pipe 31*c*. Since the water tank 25*c* is constructed of ceramic material and is integrally structured with the bidet main body 11*c* and the rest of the shell 14*c*, it is less likely to resonate with vibration of the water pump 42*c*, which can provide the user with a better silent experience.

Further, in order that the overflow pipe 50*c* also serves as an odor barrier, the overflow pipe 50*c* has a reservoir section 55*c* in the shape of an arch with a concave side facing upward.

Further, referring again to FIGS. 16 to 18, FIG. 20, and FIG. 25, in some embodiments, the water inlet assembly 30*c* further includes a water replenishment assembly 33*c*; the water replenishment assembly 33*c* includes a water replenishment valve 34*c* and a water replenishment pipe 35*c*; a water replenishment inlet of the water replenishment pipe 35*c* is connected to the water replenishment valve 34*c*, and a water replenishment outlet of the water replenishment pipe 35*c* is connected to the inlet end of the overflow pipe 50*c*.

In the embodiments, since the water level of the water tank 25*c* is too high and a scenario where overflow drainage is required through the overflow pipe 50*c* is in a low frequency, if the reservoir section 55*c* of the overflow pipe 50*c* is left standing for a long period of time after water is first added, an odor is generated from the water stored in the reservoir section 55*c*. When the reservoir section 55*c* is replenished by the water replenishment assembly 33*c* in a timely manner, the water stored in the reservoir section 55*c* can be replaced before the odor is generated. In addition, if the water in the reservoir section 55*c* is left standing for a long period of time, the water may evaporate, resulting in the odor in the drain pipe 13*c* entering the water tank 25*c* through the overflow pipe 50*c* and further overflowing into the ambient air outside the bidet 300 with an integrated built-in water tank. Therefore, by replenishing the water in the reservoir section 55*c* by the replenishment assembly 33*c* at appropriate time, it is possible for the overflow pipe 50*c* to always be in a water-tight condition.

Further, the inlet end of the overflow pipe 50*c* is arranged with an inlet grill defining an insertion hole, and the water replenishment outlet of the water replenishment pipe 35*c* is inserted with the insertion hole.

In the embodiments, by fixing the water replenishment outlet of the water replenishment pipe 35*c*, the bidet 300 with an integrated built-in water tank can be prevented from loosening from the inlet end of the overflow pipe 50*c* in a shaking environment. In addition, the grill hole on the inlet grill does not obstruct the water intake of the overflow pipe 50*c*.

Further, the shell 14*c* further includes a front sidewall 19*c* disposed on the front side of the partition 20*c*; a first opening 27*c* is defined between the front sidewall 19*c* and the partition 20*c* and disposed at the bottom and corresponding to the front portion of the bedpan 12*c*; a second opening 28*c* is defined between the front sidewall 19*c* and the first rear sidewall 21*c* and disposed at the bottom; the partition 20*c*, the first rear sidewall 21*c*, the shell 14*c*, and the bedpan 12*c* are of an integrated ceramic structure.

In the embodiments, since the first opening 27*c* and the second opening 28*c* are reserved and the water tank 25*c* has an opening facing upward, it is easy to reach the outer surface of the bidet main body 11*c* from the outside through the first opening 27*c*, and to reach sides of the first rear sidewall 21*c* and the second rear sidewall 18*c* facing each other through the second opening 28*c*, such that the setting of the water tank 25*c* does not affect the profile of the bidet main body 11*c* and the shaping of additional structures on the first rear sidewall 21*c*, such as the connector 26*c*.

In a fourth embodiment, referring to FIGS. 26 to 30, a bidet 400 with an integrated built-in water tank proposed in the present disclosure includes a seat 10*d*, a water inlet assembly 30*d*, a jetting assembly 40*d*, and an overflow pipe 50*d*.

The seat 10*d* includes a bidet main body 11*d*, a shell 12*d*, and a water tank 19*d*; the bidet main body 11*d* includes a bedpan 111*d* and a drain pipe 112*d* connected to the bedpan 111*d*; the shell 12*d* is disposed at a periphery of the bidet main body 11*d*.

The water inlet assembly 30*d* and the jetting assembly 40*d* are both disposed in the water tank 19*d*; the water inlet assembly 30*d* includes a water inlet pipe 31*d*, a water valve assembly 32*d* connected in series with the water inlet pipe 31*d*, and the jetting assembly 40*d* includes a jetting pipe 41*d* and a water pump 42*d* connected in series with the jetting pipe 41*d*; the jetting pipe 41*d* is in communication with the bedpan 111*d*.

An inlet end of the overflow pipe 50*d* extends into the water tank 19*d*.

In the embodiments, the seat 10*d* is a main structure; the water inlet assembly 30*d* and the jetting assembly 40*d* are disposed on the seat 10*d*; the bidet main body 11*d* and the shell 12*d* of the seat 10*d* may be adopted from the related art; the bedpan 111*d* is configured to receive excrement, and the jetting assembly 40*d* is configured to jet water into an inner cavity of the bidet main body 11*d*, so as to discharge the excrement into a pipe connected to a septic tank through the drain pipe 112*d*. The drain pipe 112*d* is usually arranged with a water reservoir for odor prevention, and the drain pipe 112*d* may be further arranged with an upwardly-arched curved portion to prevent backflow. The shell 12*d* is not only a cosmetic part, but also provides support for the bidet main body 11*d*. The seat 10*d* may be installed either on a bottom surface or on a vertical surface, such as on a wall or on a stand having a vertical installation surface. Both the water inlet assembly 30*d* and the jet assembly 40*d* may be adopted from the related art; the water valve assembly 32*d* may be either a manual valve or an electromechanical automatic valve, such as a solenoid valve, or a purely mechanical automatic valve. The overflow pipe 50*d* may extend into the water tank 19*d* at the inlet end only, or the overflow pipe 50*d* may be located entirely within the water tank 19*d*.

As proposed by the present disclosure, for the bidet 400 with an integrated built-in water tank, the inlet end of the overflow pipe 50*d* extends into the water tank 19*d* arranged with the water inlet assembly 30*d* and the jetting assembly 40*d*, such that even if the water inlet assembly 30*d* malfunctions and results in an overfilling of the water, the excess water can be discharged out of the inlet end of the overflow pipe 50*d*, which thereby reduces the risk of a leakage of the water from the bidet. Furthermore, due to the structure of the overflow pipe 50*d* within the water tank 19*d*, the bidet 400 with an integrated built-in water tank is provided with a water level line defined by a mandatory standard.

Further, the outlet end of the overflow pipe 50*d* is in communication with the drain pipe 112*d*. In this way, the overflow pipe 50*d* and the drain pipe 112*d* can share a common connection to an external pipe.

Figure 31:
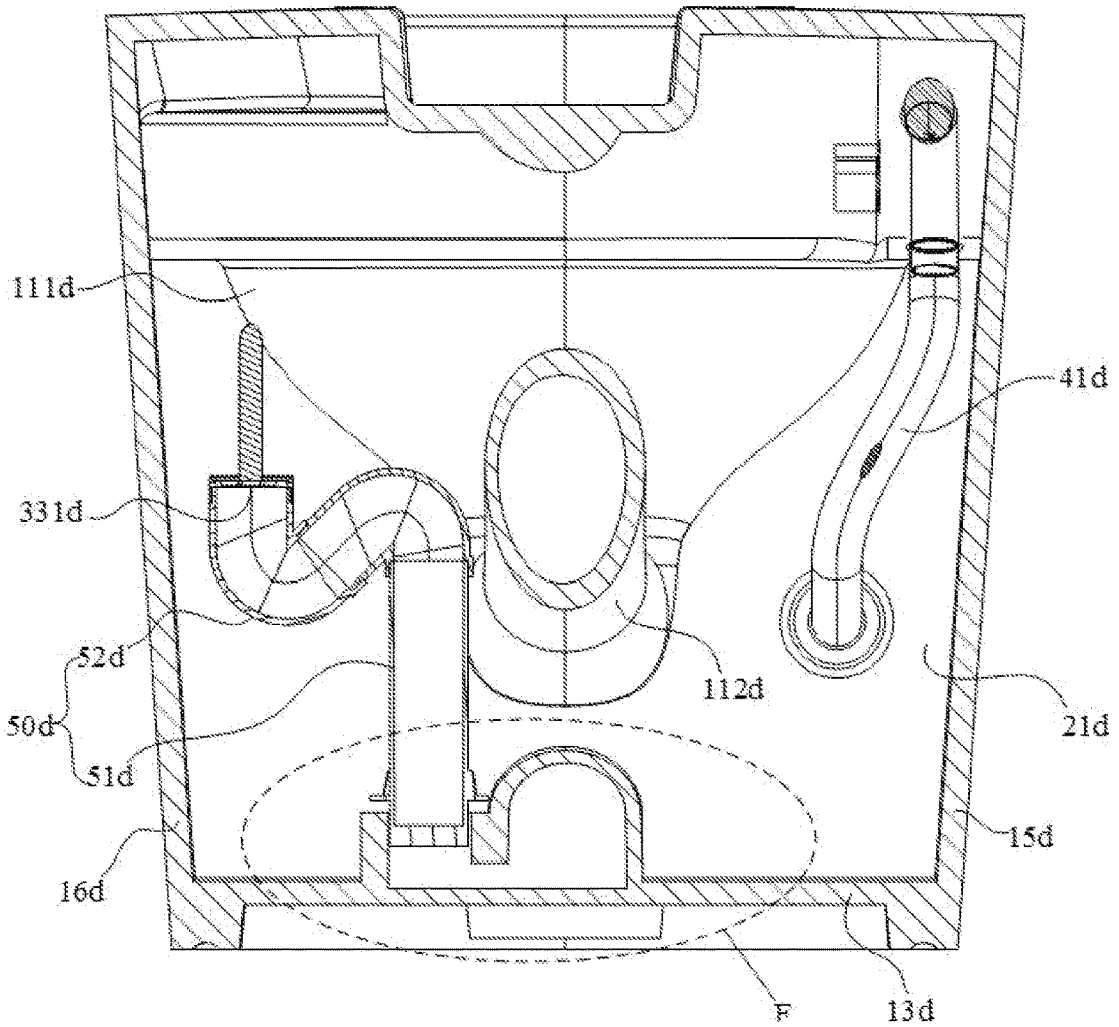
FIG. 31 is a cross-sectional structural schematic view along line E-E in FIG. 29.
Figure 32:
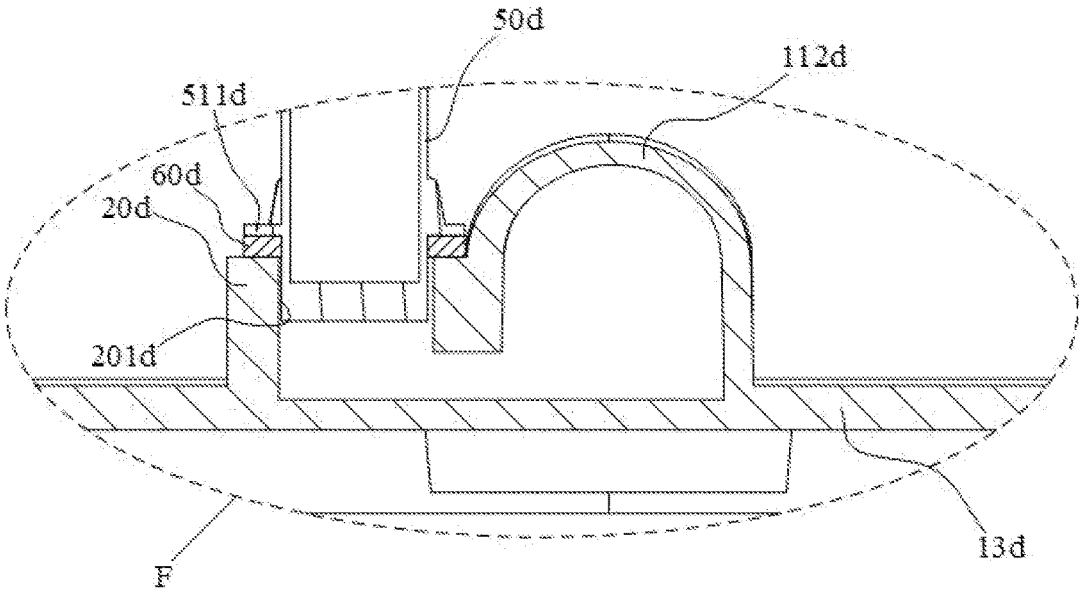
FIG. 32 is a schematic view of a partially enlarged structure at F in FIG. 31.

Further, referring to FIGS. 31 and 32 together, in some embodiments, the shell 12*d* includes a bottom wall 13*d*, and a lower portion of the drain pipe 112*d* is integrally connected to the bottom wall 13*d*; a position, of an upper surface of the bottom wall 13*d*, adjacent to the drain pipe 112*d* is arranged with an installation tab 20*d* being hollow; an inner cavity of the installation tab 20*d* is in communication with the drain pipe 112*d*, a top of the installation tab 20*d* defines an overflow installation hole 201*d* in communication with the inner cavity of the installation tab 20*d*, and a lower end of the overflow pipe 50*d* is sealingly fixed to the overflow installation hole 201*d*.

In the embodiments, the installation tab 20*d* is set such that the overflow pipe 50*d* can be arranged off-set from the drain pipe 112*d*, thereby enabling the realization of easier installation and a relatively compact installation structure.

Further, the shell 12*d* includes a front sidewall 14*d*, a bottom wall 13*d*, a left sidewall 15*d*, a right sidewall 16*d*, and a rear sidewall 17*d*, and a bottom opening 18*d* is defined between the front sidewall 14*d* and the bottom wall 13*d* facing a front portion of the bedpan 111*d*.

The seat 10*d* further includes a partition 21*d* extending upwardly from the bottom wall 13*d*, and the partition 21*d*, the bottom wall 13*d*, the left sidewall 15*d*, the right sidewall 16*d*, and the rear sidewall 17*d* enclose to form the water tank 19*d*; the water tank 19*d* is opened upwardly; the installation tab 20*d*, the partition 21*d*, the shell 12*d*, and the bedpan 111*d* are of an integrated ceramic structure.

In the embodiments, the overflow pipe 50*d* is integrally disposed within the water tank 19*d*. By providing the partition 21*d*, the shell 12*d*, and the bedpan 111*d* of an integrated ceramic structure, while retaining the bottom opening 18*d*, the upwardly-opened water tank is formed by enclosing the partition 21*d*, the bottom wall 13*d*, the left sidewall 15*d*, the right sidewall 16*d*, and the rear sidewall 17*d*, such that the space in a rear portion of the seat 10*d* is fully utilized, and the formed water tank has a large capacity and can cooperate with the water pump 42*d* for a long and stable flushing operation. Moreover, since the bottom opening 18*d* is retained and the water tank has an opening facing upward, an outer surface of the bidet main body 11*d* can be easily accessed from the outside, such that the setting of the water tank does not affect the shaping of the bidet main body 11*d*. The opening on an upper portion of the water tank also facilitates the installation of a smart toilet cover, whereby a lower raised portion at a rear end of the smart toilet cover can be embedded in the water tank, thereby making the overall height of the product lower, which in turn enhances the installation adaptability or reduces the space occupation. Since the water tank is constructed of ceramic material and is integrally structured with the bidet main body 11*d* and the rest of the shell 12*d*, it is less likely to resonate with vibration of the water pump 42*d*, which can provide the user with a better silent experience.

Figure 33:
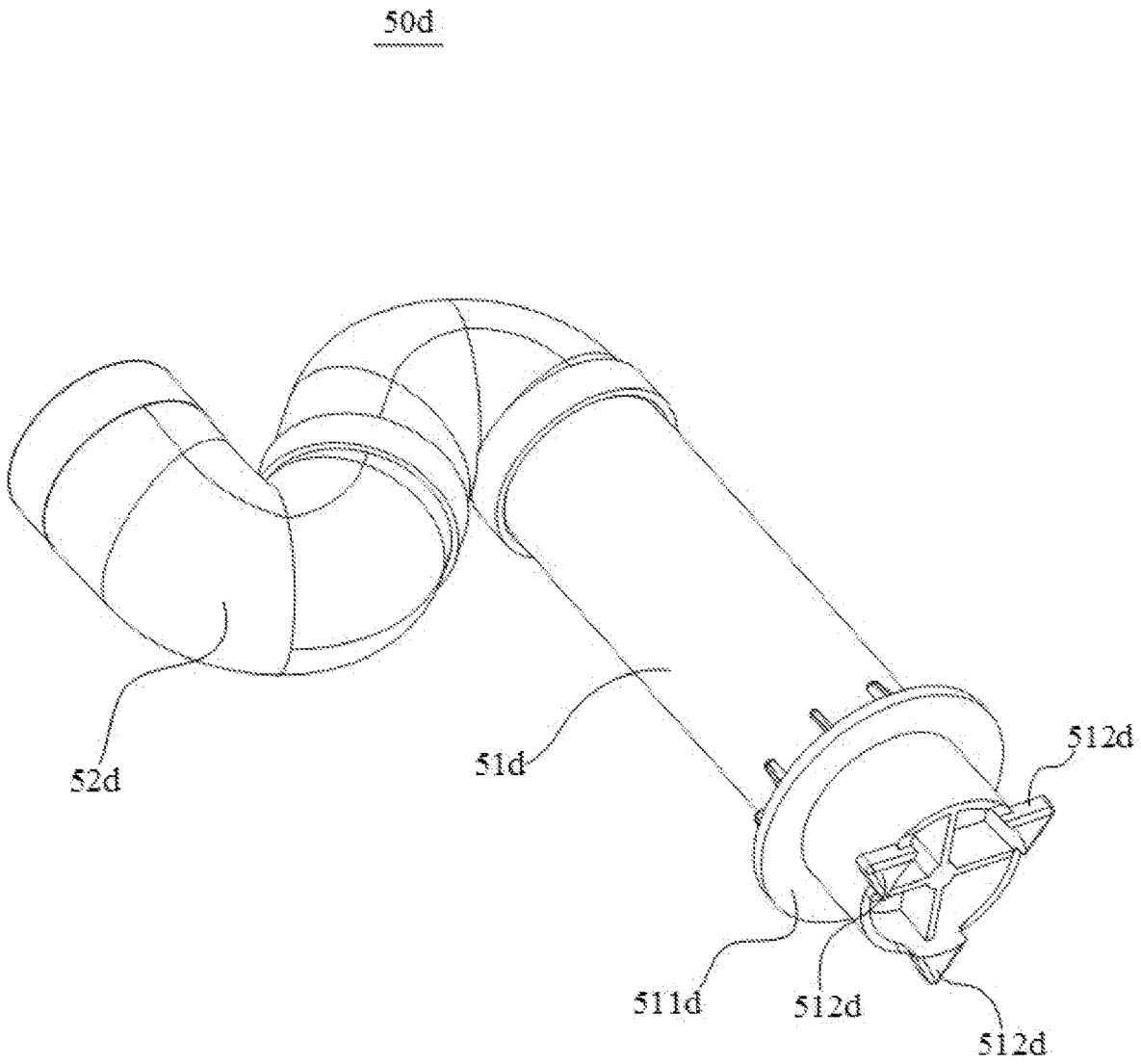
FIG. 33 is a perspective structural schematic view of an overflow pipe in FIG. 26.
Figure 34:
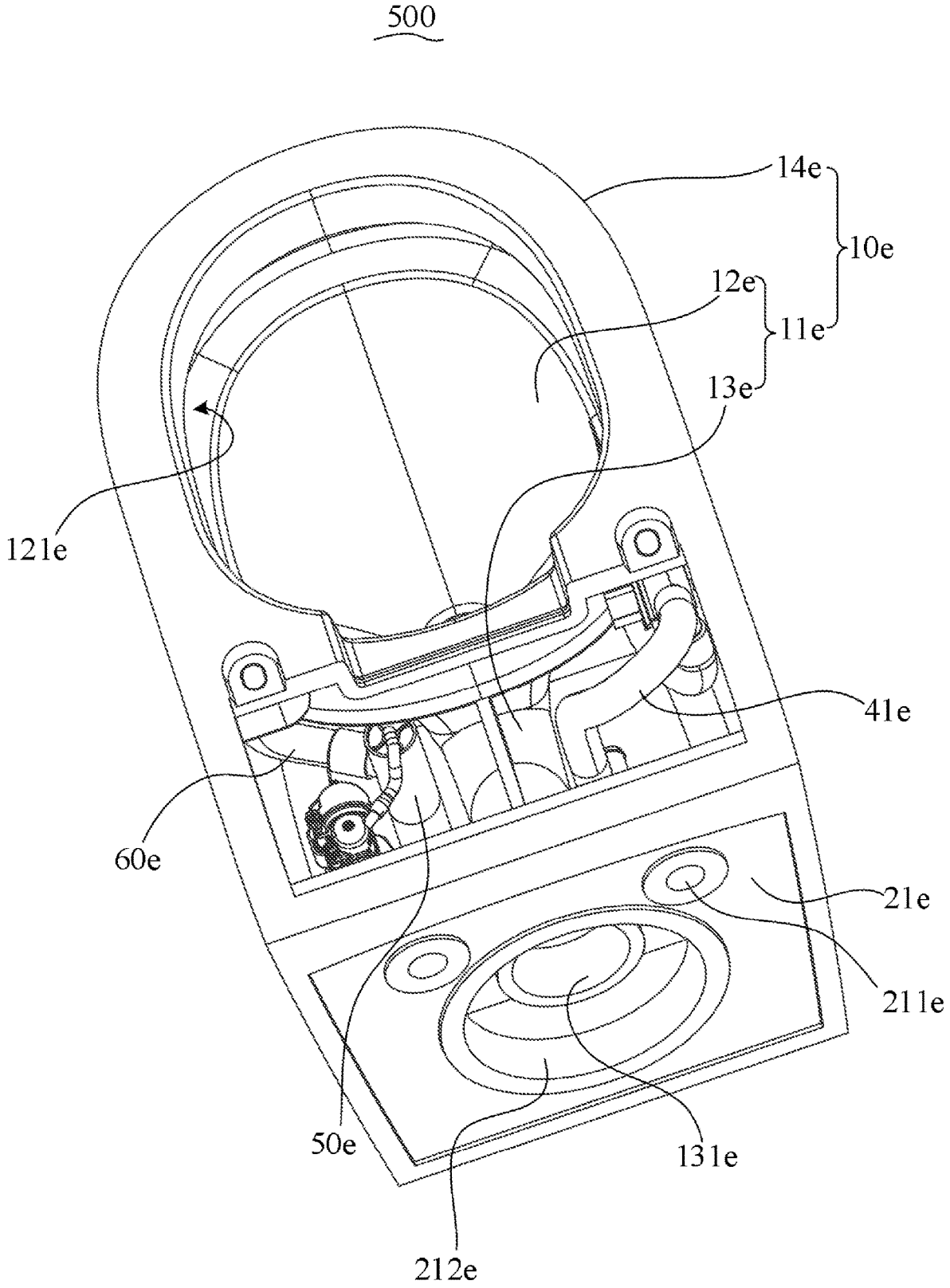
FIG. 34 is a perspective structural schematic view of a bidet with an integrated built-in water tank according to a fifth embodiment of the present disclosure.
Figure 35:
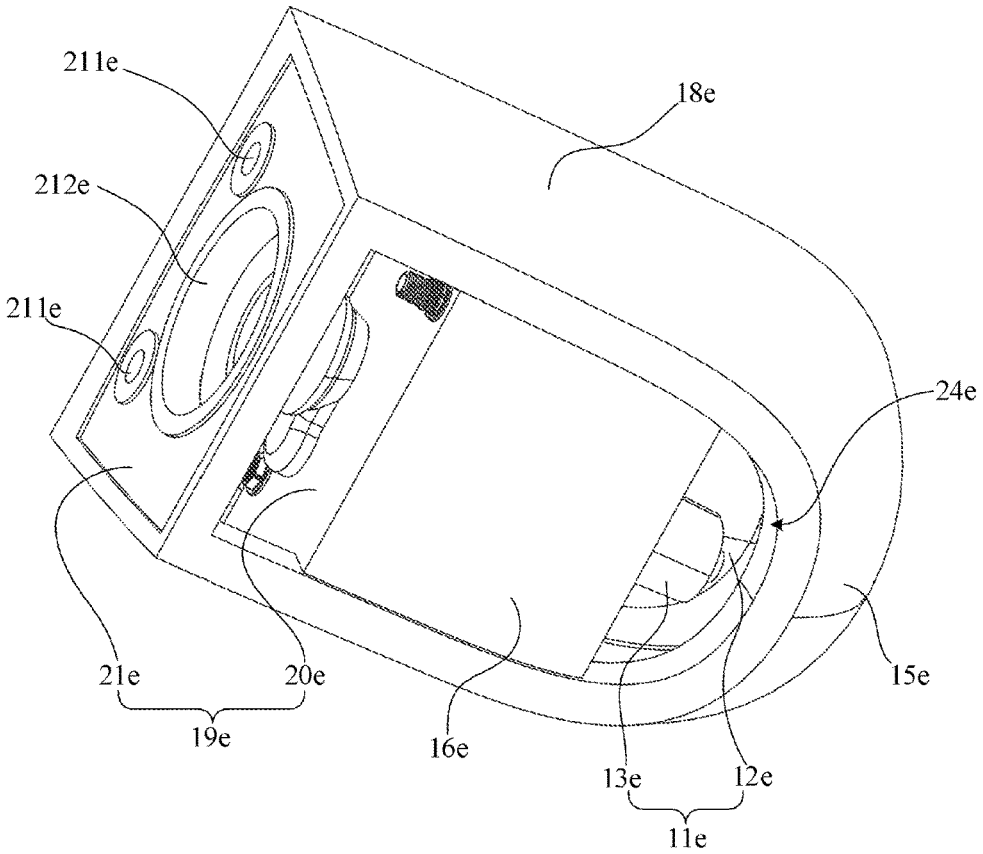
FIG. 35 is a perspective structural schematic view of a bottom of the bidet with an integrated built-in water tank as shown in FIG. 34.
Figure 36:
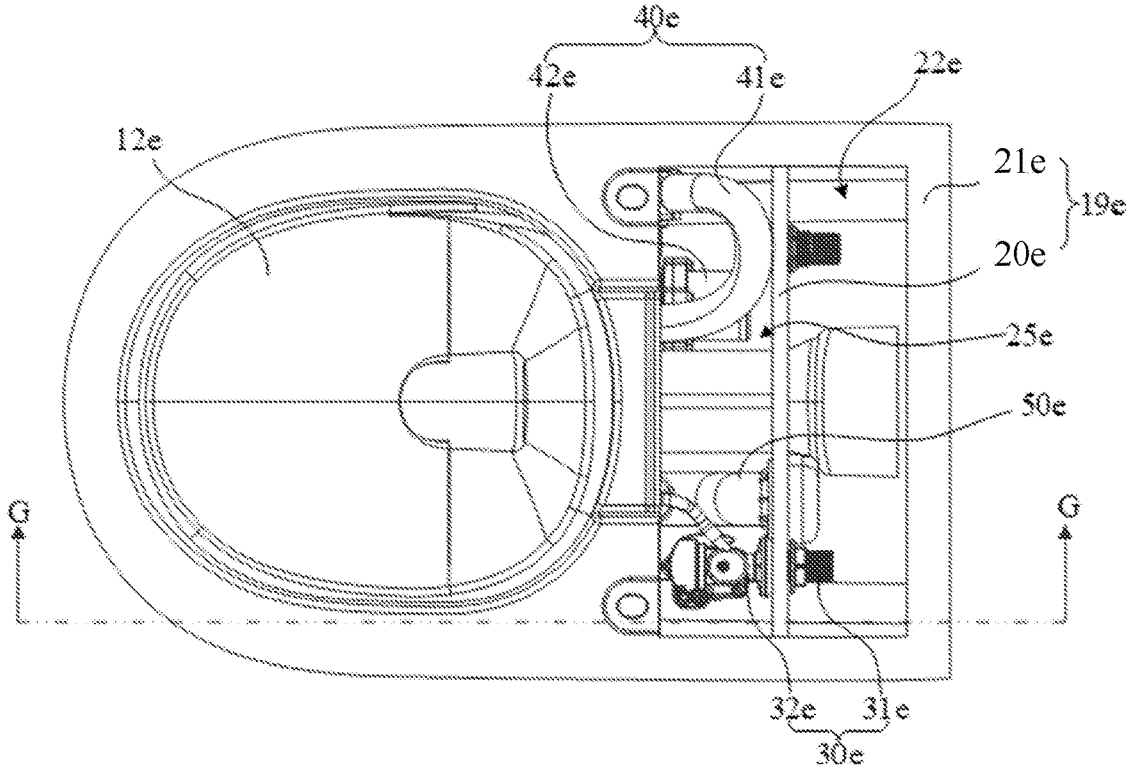
FIG. 36 is a top structural schematic view of the bidet with an integrated built-in water tank as shown in FIG. 34.
Figure 37:
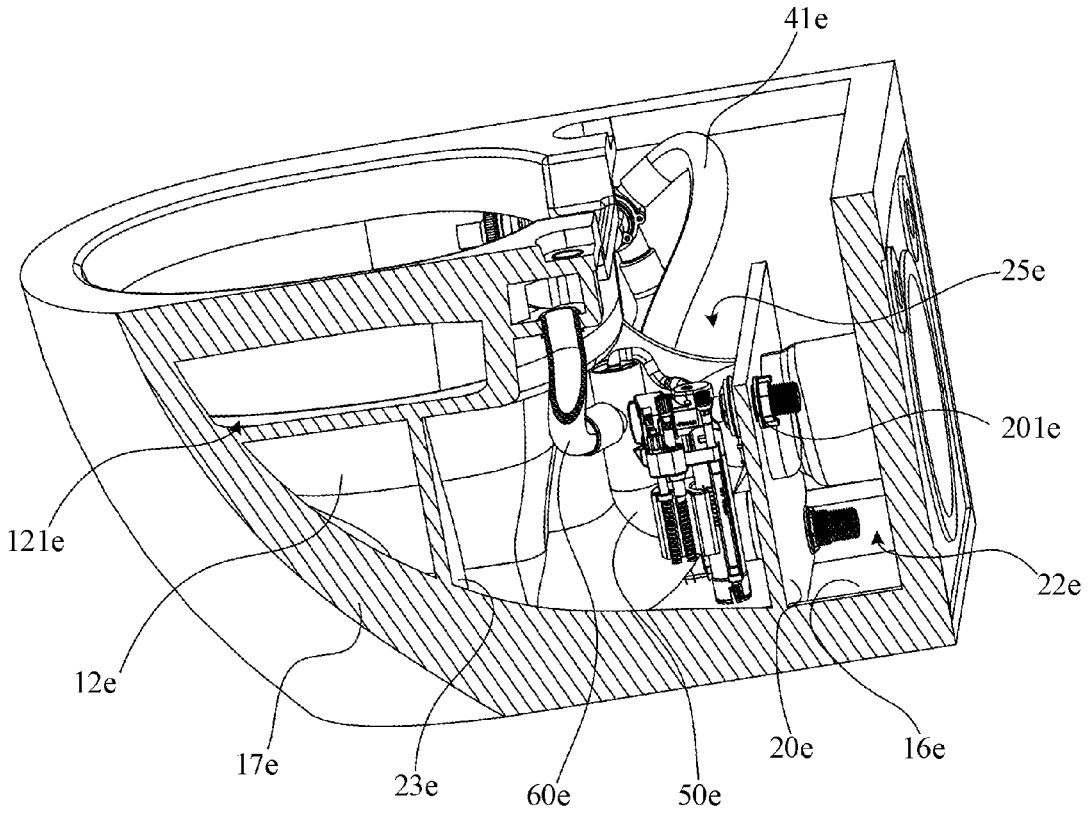
FIG. 37 is a cross-sectional structural schematic view along line G-G in FIG. 36.
Figure 38:
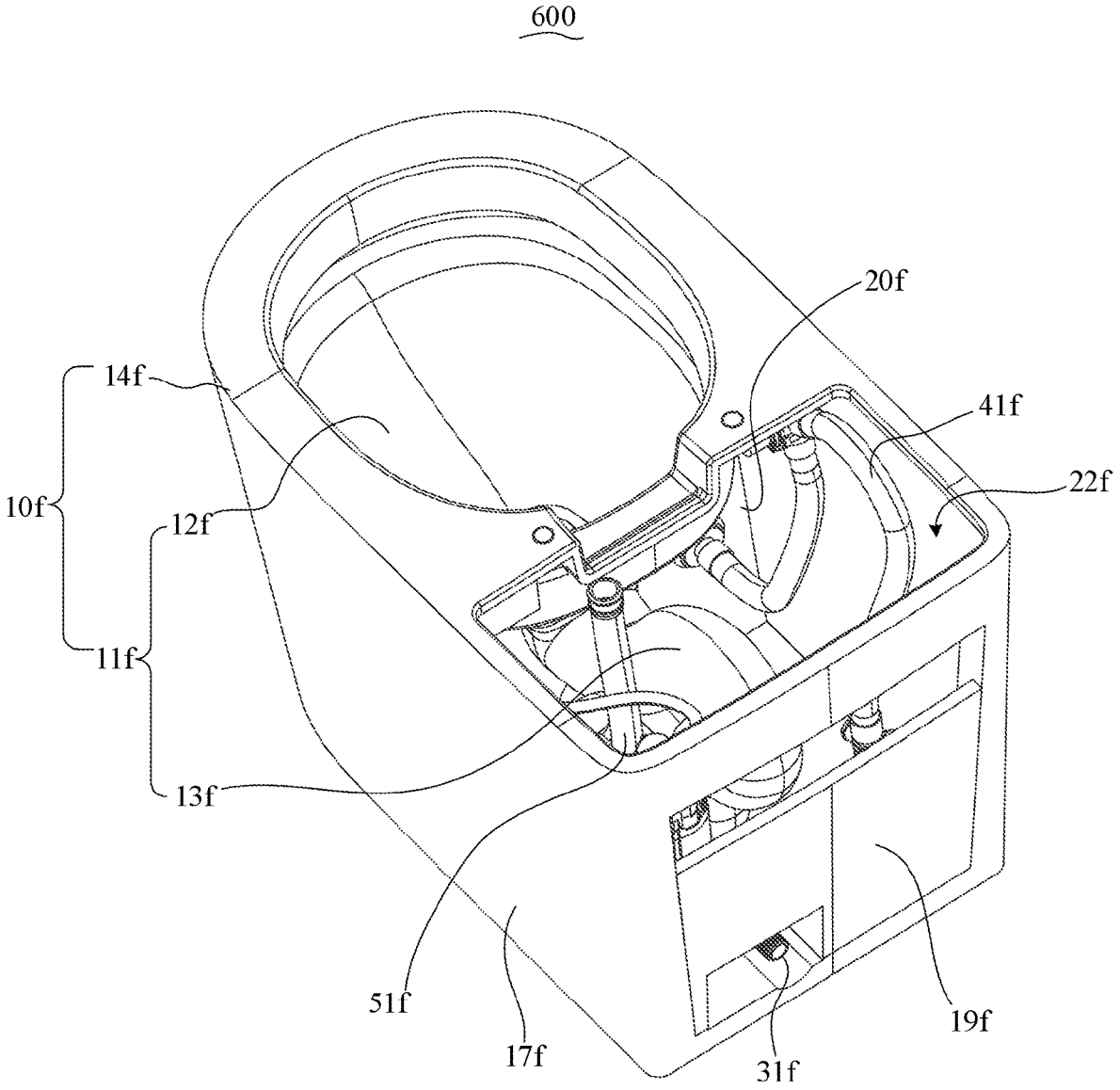
FIG. 38 is a perspective structural schematic view of a bidet with an integrated built-in water tank according to a sixth embodiment of the present disclosure.
Figure 39:
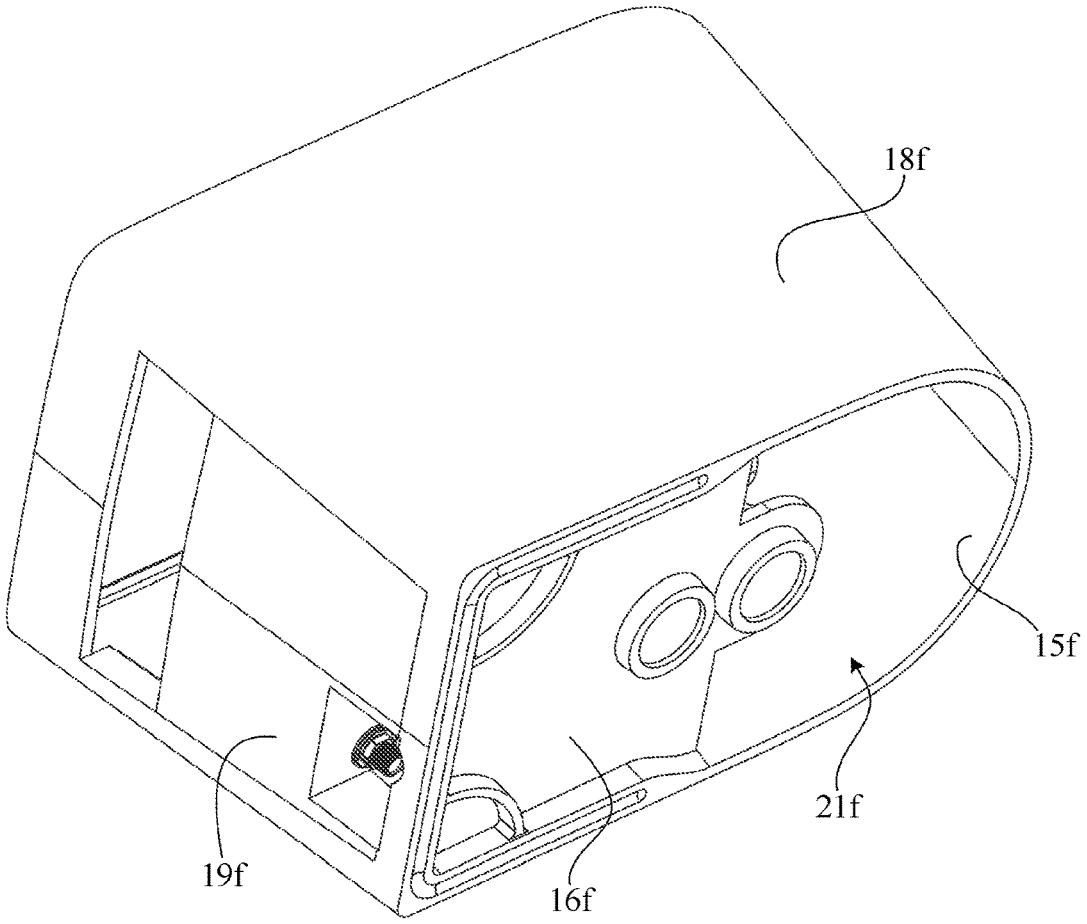
FIG. 39 is a perspective structural schematic view of a bottom of the bidet with an integrated built-in water tank as shown in FIG. 38.
Figure 40:
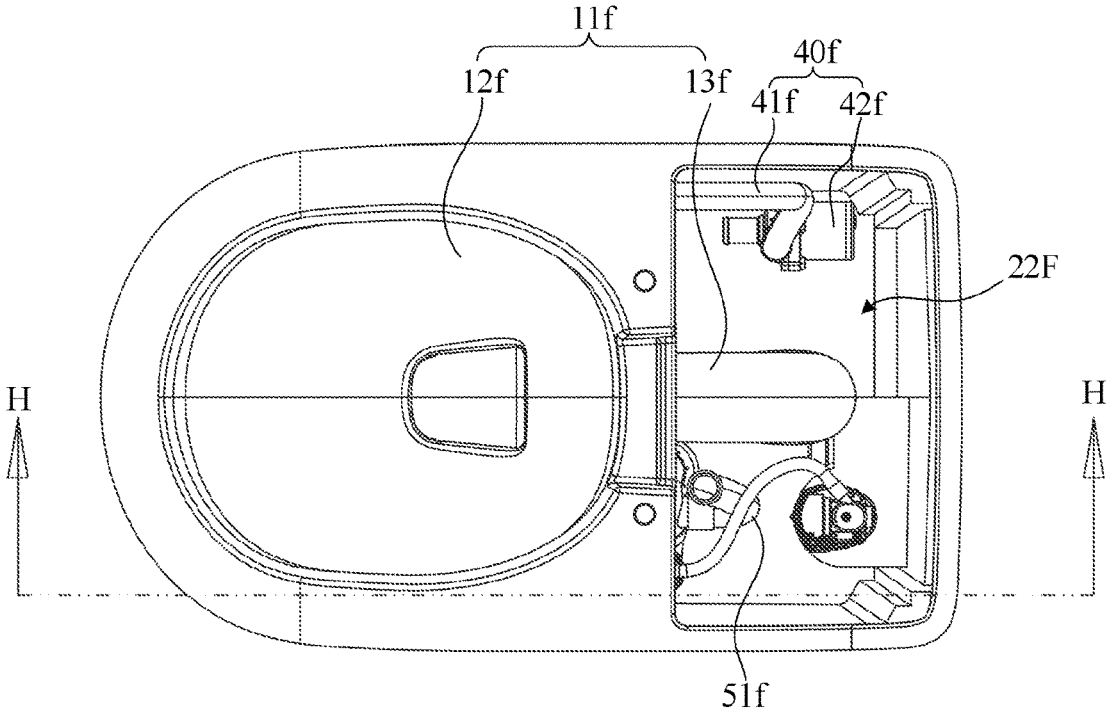
FIG. 40 is a top structural schematic view of the bidet with an integrated built-in water tank as shown in FIG. 38.
Figure 41:
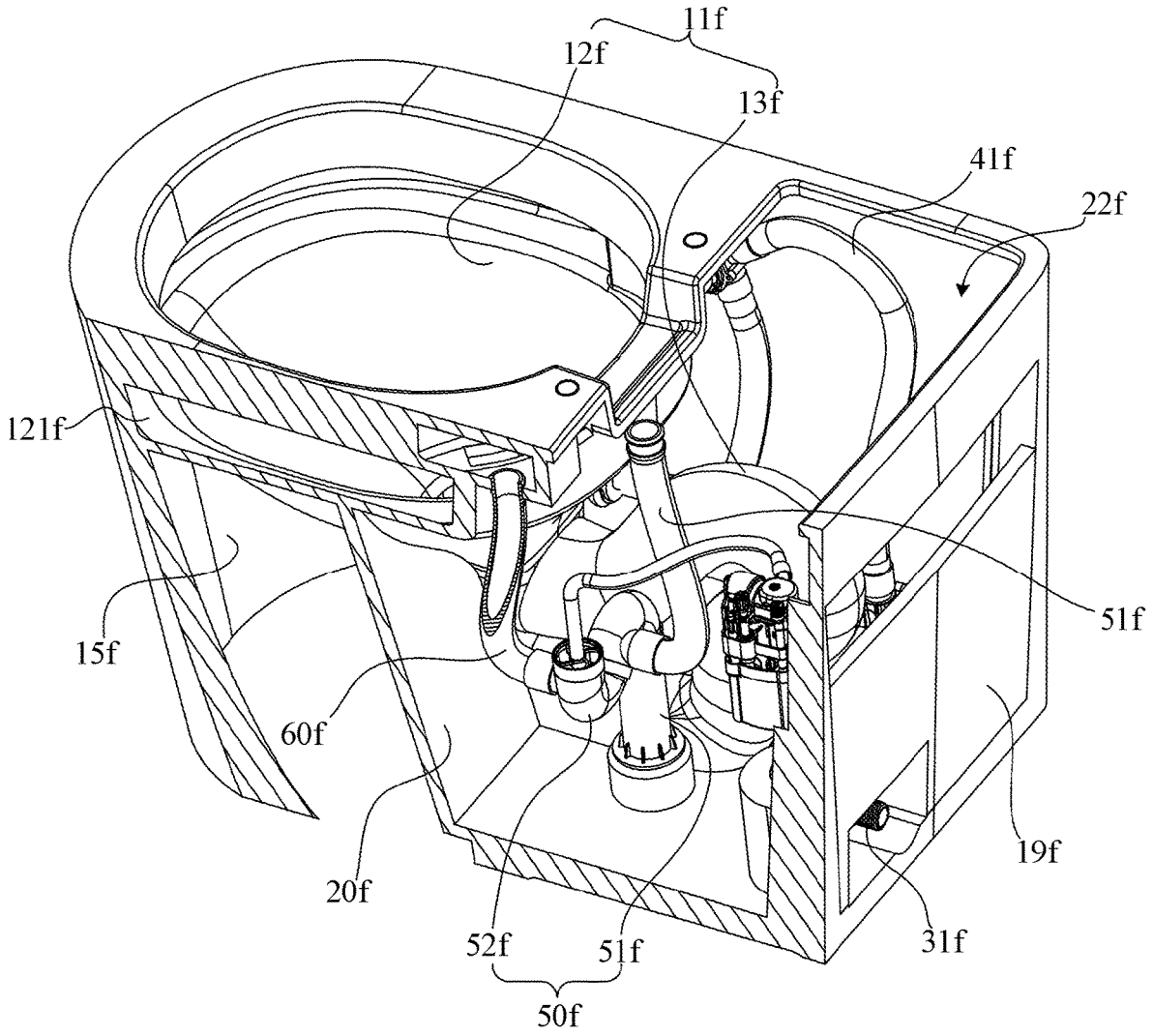
FIG. 41 is a cross-sectional structural schematic view along line H-H in FIG. 40.

Further, referring to FIGS. 32 and 33, in some embodiments, in order to ensure that the overflow pipe 50*d* is quickly installed and the lower end of the overflow pipe 50*d* is sealed, an outer peripheral surface of the outlet end of the overflow pipe 50*d* is arranged with a limiting flange 511*d* and an elastic snap 512*d*; the limiting flange 511*d* and the elastic snap 512*d* are spaced apart in a drainage direction of the overflow pipe 50*d*, and the elastic snap 512*d* is positioned lower than the position of the limiting flange 511*d*; the bidet 400 with an integrated built-in cistern further includes a sealing ring 60*d* sleeved on the outer peripheral surface of the outlet end of the overflow pipe 50*d*, and the elastic snap 512*d* abuts against an inner surface of the installation tab 20*d*; the sealing ring 60*d* is pressed between the limiting flange 511*d* and the installation tab 20*d* and is sealingly mated with an upper surface of the limiting flange 511*d* and an upper surface of the installation tab 512*d*, respectively.

Further, referring to FIG. 26, FIG. 18, FIG. 30, FIG. 31, and FIG. 33, in some embodiments, the overflow pipe includes an odor barrier structure so as to prevent odorous gases within the drain pipe 112*d* from spilling out into the indoor environment through the overflow pipe 50*d*.

Further, the overflow pipe 50*d* includes an inline section 51*d* and a reservoir section 52*d* connected to an upper end of the inline section 51*d*, the inlet end of the overflow pipe 50*d* being formed in the reservoir section 52*d*, and the outlet end of the overflow pipe 50*d* being formed at a lower end of the inline section 51*d*.

In the embodiments, the reservoir section 52*d* is provided such that when water is stored in the reservoir section 52*d*, the odor in the drain pipe 112*d* can be prevented from overflowing into the indoor environment through the overflow pipe 50*d*. The specific shape of the reservoir section 52*d* may not be particularly limited in the embodiments, as long as the water can be smoothly drained and the air communication between the inlet end and the outlet end of the overflow pipe 50*d* can be blocked when the water level of the water tank 19*d* exceeds the inlet end of the overflow pipe 50*d*.

Further, the inline section 51*d* extends in a vertical direction, a main portion of the reservoir section 52*d* is in the shape of an arch with a concave side facing upward, and the reservoir section 52*d* has a connection port arranged downwardly and connected to the upper end of the inline section 51*d*.

In the embodiments, the arched reservoir section 52*d* has less internal resistance such that the overflow pipe 50*d* can drain faster; the reservoir section 52*d* can be more easily connected to the inline section 51*d* by providing the downward-facing connection port.

Further, the inline section 51*d* is disposed adjacent to the drain pipe 112*d* so as to better concentrate the drainage. In order to fully utilize the space of the water tank 19*d* and to avoid interference between the reservoir section 52*d* and the drain pipe 112*d* during installation, the reservoir section 52*d* is arranged on a side of the inline section 51*d* away from the drain pipe 112*d*.

Further, the rear sidewall 17*d* of the shell 12*d* is defines a water inlet installation hole 171*d*, and the water inlet assembly 30*d* further includes a water inlet fitting 34*d*; an outlet of the water inlet fitting 34*d* is in communication with an inlet of the water inlet pipe 31*d*; the water inlet fitting 34*d* is removably connected to the water inlet installation hole 171*d*.

The water inlet assembly 30*d* further includes a water replenishment assembly 33*d*; the water replenishment assembly 33*d* includes a water replenishment valve 332*d*, a water replenishment pipe 333*d*, and a water replenishment outlet 331*d*, the water replenishment valve 332*d* being disposed adjacent to the water inlet fitting 34*d*; a water replenishment inlet of the water replenishment pipe 333*d* is connected to the water replenishment valve 332*d*, and a water replenishment outlet 331*d* of the water replenishment pipe 333*d* is connected to the inlet end of the overflow pipe 50*d*.

In the embodiments, the water inlet fitting 34*d* can facilitate the connection of the water inlet pipe 31*d* to the municipal water pipe and support the water inlet pipe 31*d*. In some embodiments, an outlet of the water inlet pipe 31*d* is disposed close to the bottom wall 13*d*, such that less noise is generated during water replenishment. Since the water level of the water tank 19*d* is too high and a scenario where overflow drainage is required through the overflow pipe 50*d* is in a low frequency, if the reservoir section 52*d* of the overflow pipe 50*d* is left standing for a long period of time after water is first added, an odor is generated from the water stored in the reservoir section 52*d*. When the reservoir section 52*d* is replenished by the water replenishment assembly 33*d* in a timely manner, the water stored in the reservoir section 52*d* can be replaced before the odor is generated.

In a fifth embodiment, referring to FIGS. 34 to 37, a bidet 500 with an integrated built-in water tank proposed in the present disclosure includes a seat 10*e*, a water inlet assembly 30*e*, and a jetting assembly 40*e*; the seat 10*e* includes a bidet main body 11*e*, a shell 14*e*, and a partition 23*e*.

The bidet main body 11*e* includes a bedpan 12*e* and a drain pipe 13*e* connected to the bedpan 12*e*.

The shell 14*e* is disposed at a periphery of the bidet main body 11*e*; the shell 14*e* includes a front sidewall 15*e*, a bottom wall 16*e*, a left sidewall 17*e*, a right sidewall 18*e*, and a rear sidewall 19*e*; a bottom opening 24*e* is defined between the front sidewall 15*e* and the bottom wall 16*e* facing a front portion of the bedpan 12*e*.

The partition 23*e* extends upwardly from the bottom wall 16*e*, and the partition 23*e*, the bottom wall 16*e*, the left sidewall 17*e*, the right sidewall 18*e*, and the rear sidewall 19*e* enclose to form the upwardly-opened water tank 25*e*; the partition 23*e*, the shell 14*e*, and the bedpan 12*e* are of an integrated ceramic structure.

The water inlet assembly 30*e* and the jetting assembly 40*e* are both disposed in the water tank 25*e*; the water inlet assembly 30*e* includes a water inlet pipe 31*e*, a water valve assembly 32*e* connected in series to the water inlet pipe 31*e*, and the jetting assembly 40*e* includes a jetting pipe 41*e* and a water pump 42*e* connected in series to the jetting pipe 41*e*; the jetting pipe 41*e* is in communication with the bedpan 12*e*.

The rear sidewall 19*e* includes a first rear sidewall 20*e* and a second rear sidewall 21*e* disposed facing each other in a front-rear direction, and the second rear sidewall 21*e* defines a hanging hole 211*e* and a drain through hole 212*e*; the first rear sidewall 20*e* defines a water inlet installation hole 201*e*.

The partition 23*e* and the first rear sidewall 20*e* are disposed opposite to each other in the front-rear direction and both extend upwardly from the bottom wall 16*e*, and a front portion of the bedpan 12*e* protrudes from a front surface of the partition 23*e*; the partition 23*e* and the first rear sidewall 20*e* are disposed on a front side of the second rear sidewall 21*e*; an installation cavity 22*e* is defined between the first rear sidewall 20*e* and the second rear sidewall 21*e*, and the drain pipe 13*e* passes through the first rear sidewall 20*e* and has an external connection end 131*e* extending into the installation cavity 22*e*, the external connection end 131*e* being disposed at a position corresponding to the drain through hole 212*e*; the partition 23*e*, the first rear wall 20*e*, the bottom wall 16*e*, the left sidewall 17*e*, and the right sidewall 18*e* enclose to form the water tank 25*e* that is opened upwardly.

The bidet 500 with an integrated built-in water tank further includes an overflow pipe 50*e* passing through the first rear sidewall 20*e*; an inlet end of the overflow pipe 50*e* is disposed in the water tank 25*e*, and an outlet end of the overflow pipe 50*e* extends into the installation cavity 22*e*; the outlet end of the overflow pipe 50*e* is in communication with the external connection end 131*e*.

The bidet 500 with an integrated built-in tank further includes a side branch pipe 60*e*; an end of the side branch pipe 60*e* is in communication with an upper portion of the bedpan 12*e* and the other end of the side branch pipe 60*e* is in communication with the inlet end of the overflow pipe 50*e*.

The upper portion of the bedpan 12*e* defines a diversion groove 121*e* arranged horizontally, and the jetting pipe 41*e* as well as the side branch pipe 60*e* are in communication with the diversion groove 121*e*. The diversion groove 121*e* has two rearwardly disposed corner portions, and the jetting pipe 41*e* and the side branch pipe 60*e* are connected to the two corner portions, respectively.

The overflow pipe 50*e* includes an odor barrier structure; the overflow pipe 50*e* includes an inline section and a reservoir section connected to an upper end of the inline section; the inlet end of the overflow pipe 50*e* is formed in the reservoir section; the odor barrier structure is formed in the reservoir section, the inline section extends along the front-rear direction, and the outlet end of the overflow pipe 50*e* is formed at a rear end of the inline section; a main portion of the reservoir section is in the form of an arch with a concave side facing upward.

The bidet 500 with an integrated built-in water tank further includes an extraction assembly (not shown), the extraction assembly including an extraction pipe and an extraction fan connected in series with the extraction pipe; an end of the extraction pipe is in communication with an upper portion of the bedpan 12*e* and the other end of the extraction pipe is in communication with a downstream portion of a reservoir area of the reservoir section.

In a sixth embodiment, referring to FIGS. 38 to 41, a bidet 600 with an integrated built-in water tank proposed in the present disclosure includes a seat 10*f*, a water inlet assembly, and a jetting assembly 40*f*; the seat 10*f* includes a bidet main body 11*f*, a shell 14*f*, and a partition 20*f*.

The bidet main body 14*f* includes a bedpan 12*f* and a drain pipe 13*f* connected to the bedpan 12*f*.

The shell 14*f* is disposed at a periphery of the bidet main body 11*f*; the shell 14*f* includes a front sidewall 15*f*, a bottom wall 16*f*, a left sidewall 17*f*, a right sidewall 18*f*, and a rear sidewall 19*f*; a bottom opening 21*f* is defined between the front sidewall 15*f* and the bottom wall 16*f* facing a front portion of the bedpan 12*f*.

The partition 20*f* extends upwardly from the bottom wall 16*f*, and the partition 20*f*, the bottom wall 16*f*, the left sidewall 17*f*, the right sidewall 18*f*, and the rear sidewall 19*f* enclose to form an upwardly-opened water tank 22*f*; the partition 20*f*, the shell 14*f*, and the bedpan 12*f* are of an integrated ceramic structure.

The water inlet assembly and the jetting assembly 40*f* are both disposed in the water tank 22*f*; the water inlet assembly includes a water inlet pipe 31*f*, a water valve assembly connected in series with the water inlet pipe 31*f*, and the jetting assembly 40*f* includes a jetting pipe 41*f* and a water pump 42*f* connected in series with the jetting pipe 41*f*; the jetting pipe 41*f* is in communication with the bedpan 12*f*.

The bidet 600 with an integrated built-in water tank further includes an overflow pipe 50*f* and a side branch pipe 60*f*; an inlet end of the overflow pipe 50*f* extends into the water tank 22, and an outlet end of the overflow pipe 50*f* is in communication with the drain pipe 13*f*; an end of the side branch pipe 60*f* is in communication with an upper portion of the bedpan 12*f*, and the other end is in communication with the inlet end of the overflow pipe 50*f*; the upper portion of the bedpan 12*f* defines a diversion groove 121*f* arranged horizontally; both the jetting pipe 41*f* and the side branch pipe 60*f* are in communication with the diversion groove 121*f*.

The bidet 600 with an integrated built-in water tank further includes an overflow pipe 50*f* and an extraction assembly; an inlet end of the overflow pipe 50*f* extends into the water tank 22*f*, and an outlet end of the overflow pipe 50*f* is in communication with the drain pipe 13*f*; the overflow pipe 50*f* includes an odor barrier structure, and the overflow pipe 50*f* includes an inline section 51*f* and a reservoir section 52*f* connected to an upper end of the inline section 51*f*; the inlet end of the overflow pipe 50*f* is formed in the reservoir section 52*f*, the odor barrier structure is formed in the reservoir section 52*f*, and the outlet end of the overflow pipe 50*f* is formed in a lower end of the inline section 51*f*; the inline section 51*f* extends in a vertical direction, and a main portion of the reservoir section 52*f* is in the form of an arch with a concave side facing upward; the reservoir section 52*f* has a connection port arranged downwardly to be connected to the upper end of the inline section 51*f*; the extraction assembly includes an extraction pipe 51*f* and an extraction fan connected in series to the extraction pipe 51*f*; an end of the extraction pipe 51*f* is in communication with an upper portion of the bedpan 12*f*, and the other end is in communication with the inline section 51*f*.

The fifth and sixth embodiments have the same technical effect as one or more of the first to fourth embodiments, respectively, and will not be repeated herein. In the fifth and sixth embodiments, in an event that the drain pipe 13*e*, 13*f* becomes clogged and the user presses the flush button, the water within the bedpan 12*e*, 12*f* can be introduced into the overflow pipe 50*e*, 50*f* from the side branch pipe 60*e*, 60*f*, so as to avoid sewage leakage. In addition, the odor generated in the bedpan 12*e*, 12*f* can be discharged into the overflow pipes 50*e*, 50*f* through the extraction pipe (not shown in the fifth embodiment, labeled as 51*f* in the sixth embodiment), and the water accumulated in the overflow pipe 50*e*, 50*f* can act as a one-way valve for the gas discharged from the extraction pipe, so as to force the odor-bearing gas to be discharged into the downstream of the overflow pipe 50*e*, 50*f*, and thus be discharged to a public sewer or to the outdoor environment.

Finally, it should be noted that the above embodiments are only intended to illustrate the technical solutions of the present disclosure, not to limit them; although the present disclosure has been described in detail referring to the foregoing embodiments, those skilled in the art should understand that it is still possible to modify the technical solutions recorded in the foregoing embodiments or replace some of the technical features therein; and such modifications or replacements do not drive the essence of the corresponding technical solutions out of the spirit and scope of the technical solutions of the various embodiments of the present disclosure.

What is claimed is:

1. A bidet with an integrated built-in water tank, comprising a seat, a water inlet assembly, and a jetting assembly; wherein the seat comprises a bidet main body, a shell, and a partition; the bidet main body comprises a bedpan and a drain pipe in communication with the bedpan; the shell is arranged at a periphery of the bidet main body; the shell comprises a front sidewall, a bottom wall, a left sidewall, a right sidewall, and a rear sidewall; a bottom opening is defined between the front sidewall and the bottom wall facing a front portion of the bedpan;

the partition extends upwardly from the bottom wall; the partition, the bottom wall, the left sidewall, the right sidewall, and the rear sidewall enclose to form a water tank that is opened upwardly; the partition, the shell, and the bedpan are of an integrated ceramic structure;

the water inlet assembly and the jetting assembly are disposed in the water tank; the water inlet assembly comprises a water inlet pipe and a water valve assembly connected in series to the water inlet pipe; the jetting assembly comprises a jetting pipe and a water pump connected in series to the jetting pipe, and the jetting pipe is in communication with the bedpan;

wherein the rear sidewall defines a water inlet installation hole, and the water inlet assembly further comprises a water inlet fitting; an outlet of the water inlet fitting is connected to an inlet of the water inlet pipe; the water inlet fitting is removably connected to the water inlet installation hole.

2. The bidet according to claim 1, wherein the rear sidewall comprises a base and a bulge that bulges inwardly from the base; the bulge defines a cavity that is opened toward an outside; the water inlet installation hole is defined on the bulge and is in communication with the cavity; an outer end of the water inlet fitting is disposed in the cavity.

3. The bidet according to claim 1, wherein the water inlet fitting comprises a fitting body, a sealing ring, and a fastener; the fitting body comprises a tube portion and a limiting flange disposed on an outer peripheral surface of an inner end of the tube portion, and the outer peripheral surface of the tube portion defines an outer thread; the tube portion passes through the water inlet installation hole; the limiting flange is disposed on an inner side of the rear sidewall, the sealing ring is disposed between the limiting flange and the rear sidewall, and the fastener is threadedly mated with the tube portion and disposed on an outer side of the rear sidewall.

4. A bidet with an integrated built-in water tank, comprising a seat, a water inlet assembly, and a jetting assembly; wherein the seat comprises a bidet main body, a shell, and a partition; the bidet main body comprises a bedpan and a drain pipe in communication with the bedpan; the shell is arranged at a periphery of the bidet main body; the shell comprises a front sidewall, a bottom wall, a left sidewall, a right sidewall, and a rear sidewall; a bottom opening is defined between the front sidewall and the bottom wall facing a front portion of the bedpan;

the partition extends upwardly from the bottom wall; the partition, the bottom wall, the left sidewall, the right sidewall, and the rear sidewall enclose to form a water tank that is opened upwardly; the partition, the shell, and the bedpan are of an integrated ceramic structure;

the water inlet assembly and the jetting assembly are disposed in the water tank; the water inlet assembly comprises a water inlet pipe and a water valve assembly connected in series to the water inlet pipe; the jetting assembly comprises a jetting pipe and a water pump connected in series to the jetting pipe, and the jetting pipe is in communication with the bedpan;

wherein the partition extends upwardly to be connected to the bedpan, and an upper portion of the rear sidewall defines a window connected to an outside.

5. The bidet according to claim 4, wherein the drain pipe has a curved portion extending into the water tank; the drain pipe is arranged in the middle in a left-right direction; the water inlet assembly is disposed on a first side of the drain pipe, and the water pump is disposed on a second side of the drain pipe, the first side and the second side being opposite to each other in the left-right direction.

6. A bidet with an integrated built-in water tank, comprising a seat, a water inlet assembly, and a jetting assembly; wherein the seat comprises a bidet main body, a shell, and a partition; the bidet main body comprises a bedpan and a drain pipe in communication with the bedpan; the shell is arranged at a periphery of the bidet main body; the shell comprises a front sidewall, a bottom wall, a left sidewall, a right sidewall, and a rear sidewall; a bottom opening is defined between the front sidewall and the bottom wall facing a front portion of the bedpan;

the partition extends upwardly from the bottom wall; the partition, the bottom wall, the left sidewall, the right sidewall, and the rear sidewall enclose to form a water tank that is opened upwardly; the partition, the shell, and the bedpan are of an integrated ceramic structure;

the water inlet assembly and the jetting assembly are disposed in the water tank; the water inlet assembly comprises a water inlet pipe and a water valve assembly connected in series to the water inlet pipe; the jetting assembly comprises a jetting pipe and a water pump connected in series to the jetting pipe, and the jetting pipe is in communication with the bedpan;

wherein an inner wall surface of an upper portion of the bedpan defines an annular flushing groove; the jetting assembly further comprises a three-way valve; the jetting pipe comprises a main path, a first branch path connected to an outlet of the three-way valve, and a second branch path connected to another outlet of the three-way valve; the main path is connected to an outlet of the water pump and an inlet of the three-way valve; an outlet of the first branch path is in communication with a bottom of the bedpan, and an outlet of the second branch path is in communication with the annular flushing groove on the upper portion of the bedpan.

7. The bidet according to claim 6, wherein the partition extends upwardly to be connected to the bedpan, and the partition defines a through hole for the second branch path to pass through.

8. The bidet according to claim 1, wherein, the rear sidewall comprises a first rear sidewall and a second rear sidewall disposed facing each other in a front-rear direction, the second rear sidewall defines a hanging hole and a drain through hole, and the first rear sidewall defines the water inlet installation hole; the partition and the first rear sidewall are disposed opposite to each other in the front-rear direction and both extend upwardly from the bottom wall, and a front portion of the bedpan protrudes from a front surface of the partition; the partition and the first rear sidewall are disposed on a front side of the second rear sidewall; an installation cavity is defined between the first rear sidewall and the second rear sidewall, and the drain pipe passes through the first rear sidewall and has an external connection end extending into the installation cavity, the external connection end being disposed at a position corresponding to the drain through hole; the partition, the first rear sidewall, the bottom wall, the left sidewall, and the right sidewall enclose to form a water tank that is opened upwardly.

9. The bidet according to claim 8, further comprising an overflow pipe passing through the first rear sidewall; wherein an inlet end of the overflow pipe is disposed in the water tank, and an outlet end of the overflow pipe extends into the installation cavity and is in communication with the external connection end.

10. The bidet according to claim 9, wherein the seat further comprises a connector protruding on a rear surface of the first rear sidewall and connected to an outer peripheral surface of the external connection end; an inner cavity of the connector is in communication with an inner cavity of the external connection end; an overflow installation hole is defined on the first rear sidewall corresponding to the connector and in communication with the inner cavity of the connector, and the outlet end of the overflow pipe is sealingly fixed to the overflow installation hole; the partition, the first rear sidewall, the shell, the bedpan, and the connector are of an integrated ceramic structure.

11. The bidet according to claim 9, wherein the overflow pipe comprises an odor barrier structure; the overflow pipe further comprises an inline section and a reservoir section connected to an upper end of the inline section; the inlet end of the overflow pipe is formed at the reservoir section; the odor barrier structure is formed at the reservoir section, and the outlet end of the overflow pipe is formed at a lower end of the inline section; the inline section extends in a vertical direction, and a main portion of the reservoir section is in a form of an arch with a concave side facing upward; the reservoir section has a connection port arranged downwardly to be connected to the upper end of the inline section; the water inlet assembly further comprises a water replenishment assembly; the water replenishment assembly comprises a water replenishment valve, and a water replenishment pipe; a water replenishment inlet of the water replenishment pipe is connected to the water replenishment valve, and a water replenishment outlet of the water replenishment pipe is connected to the inlet end of the overflow pipe.

12. The bidet according to claim 9, further comprising a side branch pipe; wherein an end of the side branch pipe is in communication with an upper portion of the bedpan, and the other end of the side branch pipe is in communication with the inlet end of the overflow pipe.

13. The bidet according to claim 12, wherein, the overflow pipe comprises an odor barrier structure; the overflow pipe further comprises an inline section and a reservoir section connected to an upper end of the inline section; the inlet end of the overflow pipe is formed at the reservoir section; the odor barrier structure is formed at the reservoir section, the inline section extends along a front-rear direction, and the outlet end of the overflow pipe is formed at a rear end of the inline section; a main portion of the reservoir section is in a form of an arch with a concave side facing upward;

the bidet further comprises an extraction assembly, the extraction assembly comprising an extraction pipe and an extraction fan connected in series with the extraction pipe; an end of the extraction pipe is in communication with the upper portion of the bedpan, and the other end of the extraction pipe is in communication with a downstream portion of a reservoir area of the reservoir section.

14. The bidet according to claim 8, wherein the shell further comprises the front sidewall disposed on the front side of the partition; a first opening is defined between the front sidewall and the partition and disposed at a bottom and corresponding to the front portion of the bedpan; a second opening is defined between the front sidewall and the first rear sidewall and disposed at the bottom; the partition, the first rear sidewall, the shell, and the bedpan are of an integrated ceramic structure.

15. The bidet according to claim 1, further comprising an overflow pipe; wherein an inlet end of the overflow pipe extends into the water tank, and an outlet end of the overflow pipe is in communication with the drain pipe;

the shell comprises the bottom wall, and a lower portion of the drain pipe is integrally connected to the bottom wall; a position, of an upper surface of the bottom wall, adjacent to the drain pipe is arranged with an installation tab being hollow; an inner cavity of the installation tab is in communication with the drain pipe, a top of the installation tab defines an overflow installation hole in communication with the inner cavity of the installation tab, and a lower end of the overflow pipe is sealingly fixed to the overflow installation hole;

the installation tab, the partition, the shell, and the bedpan are of an integrated ceramic structure.

16. The bidet according to claim 15, wherein, an outer peripheral surface of the outlet end of the overflow pipe is arranged with a limiting flange and an elastic snap; the limiting flange and the elastic snap are spaced apart in a drainage direction of the overflow pipe, and the elastic snap is positioned lower than a position of the limiting flange;

the bidet further comprises a sealing ring sleeved on the outer peripheral surface of the outlet end of the overflow pipe, and the elastic snap abuts against an inner surface of the installation tab; the sealing ring is pressed between the limiting flange and the installation tab and is sealingly mated with an upper surface of the limiting flange and an upper surface of the installation tab, respectively.

17. The bidet according to claim 15, wherein, the overflow pipe comprises an odor barrier structure; the overflow pipe further comprises an inline section and a reservoir section connected to an upper end of the inline section; the inlet end of the overflow pipe is formed at the reservoir section; the odor barrier structure is formed at the reservoir section, and the outlet end of the overflow pipe is formed at a lower end of the inline section; the inline section extends in a vertical direction, and a main portion of the reservoir section is in a form of an arch with a concave side facing upward; the reservoir section has a connection port arranged downwardly to be connected to the upper end of the inline section.

18. The bidet according to claim 1, further comprising an overflow pipe and a side branch pipe; wherein an inlet end of the overflow pipe extends into the water tank, and an outlet end of the overflow pipe is in communication with the drain pipe; an end of the side branch pipe is in communication with an upper portion of the bedpan, and the other end of the side branch pipe is in communication with the inlet end of the overflow pipe; the upper portion of the bedpan defines a diversion groove arranged horizontally; both the jetting pipe and the side branch pipe are in communication with the diversion groove.

19. The bidet according to claim 1, wherein, the bidet further comprises an overflow pipe and an extraction assembly; an inlet end of the overflow pipe extends into the water tank, and an outlet end of the overflow pipe is in communication with the drain pipe;

the overflow pipe comprises an odor barrier structure, and the overflow pipe comprises an inline section and a reservoir section connected to an upper end of the inline section; the inlet end of the overflow pipe is formed at the reservoir section, the odor barrier structure is formed at the reservoir section, and the outlet end of the overflow pipe is formed at a lower end of the inline section; the inline section extends in a vertical direction, and a main portion of the reservoir section is in a form of an arch with a concave side facing upward; the reservoir section has a connection port arranged downwardly to be connected to the upper end of the inline section;

the extraction assembly comprises an extraction pipe and an extraction fan connected in series to the extraction pipe; an end of the extraction pipe is in communication with an upper portion of the bedpan, and the other end of the extraction pipe is in communication with the inline section.

* * * * *